US007250927B2

(12) United States Patent
Yamazaki et al.

(10) Patent No.: US 7,250,927 B2
(45) Date of Patent: Jul. 31, 2007

(54) PORTABLE INFORMATION APPARATUS AND METHOD OF DRIVING THE SAME

(75) Inventors: Shunpei Yamazaki, Tokyo (JP); Jun Koyama, Kanagawa-ken (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 652 days.

(21) Appl. No.: 09/919,832

(22) Filed: Aug. 2, 2001

(65) Prior Publication Data

US 2002/0036604 A1 Mar. 28, 2002

(30) Foreign Application Priority Data

Aug. 23, 2000 (JP) ..... 2000-253188

(51) Int. Cl.
*G09G 3/30* (2006.01)
*G09G 3/36* (2006.01)
*G09G 3/10* (2006.01)

(52) U.S. Cl. ..... 345/76; 345/98; 315/169.3

(58) Field of Classification Search ..... 345/76, 345/98, 100; 315/169.1, 169.3
See application file for complete search history.

(56) References Cited

U.S. PATENT DOCUMENTS 4,432,610 A 2/1984 Kobayashi et al.
4,636,788 A 1/1987 Hilbrink
4,752,118 A 6/1988 Johnson
4,752,188 A 6/1988 Gurega
4,773,738 A 9/1988 Hayakawa et al.
4,996,523 A 2/1991 Bell et al.
5,091,722 A 2/1992 Kitajima et al.
5,125,045 A 6/1992 Murakami et al.
5,200,846 A 4/1993 Hiroki et al.
5,225,823 A 7/1993 Kanaly
5,247,190 A 9/1993 Friend et al.
5,339,090 A 8/1994 Crossland et al.
5,349,366 A 9/1994 Yamazaki et al.
5,376,944 A 12/1994 Mogi et al.

(Continued)

FOREIGN PATENT DOCUMENTS

EP 0 566 408 10/1993

(Continued)

OTHER PUBLICATIONS

Shimoda et al.; "Current Status and Future of Light-Emitting Polymer Display Driven by Poly-Si TFT"; *SID 99 Digest*; pp. 372-375; 1999.

(Continued)

*Primary Examiner*—Richard Hjerpe
*Assistant Examiner*—M. Fatahiyar
(74) *Attorney, Agent, or Firm*—Fish & Richardson P.C.

(57) ABSTRACT

There is provided a portable information apparatus including an EL display device which can reduce consumed electric power at the time when a still picture is displayed. In the EL display device included in the portable information apparatus, a plurality of memory circuits and a D/A converter are arranged in a pixel. When the EL display device displays the still picture, picture display functions other than the EL display device and control circuits for controlling the EL display device are stopped, so that the portable information apparatus capable of reducing the consumed electric power can be obtained.

73 Claims, 38 Drawing Sheets

U.S. PATENT DOCUMENTS

| | | | | |
|---|---|---|---|---|
| 5,424,752 | A | 6/1995 | Yamazaki et al. | |
| 5,471,225 | A | 11/1995 | Parks | |
| 5,479,283 | A | 12/1995 | Kaneko et al. | |
| 5,483,366 | A | 1/1996 | Atherton | |
| 5,515,187 | A | 5/1996 | Nakamura et al. | |
| 5,600,169 | A | 2/1997 | Burgener et al. | |
| 5,608,549 | A | 3/1997 | Usami | |
| 5,642,129 | A | 6/1997 | Zavracky et al. | |
| 5,673,422 | A | 9/1997 | Kawai et al. | |
| 5,699,078 | A | 12/1997 | Yamazaki et al. | |
| 5,712,562 | A | 1/1998 | Berg | |
| 5,771,031 | A | 6/1998 | Kinoshita et al. | |
| 5,793,344 | A | 8/1998 | Koyama | |
| 5,798,746 | A * | 8/1998 | Koyama | 345/98 |
| 5,818,898 | A | 10/1998 | Tsukamoto et al. | |
| 5,841,482 | A | 11/1998 | Wang et al. | |
| 5,854,628 | A | 12/1998 | Nakagawa | |
| 5,907,313 | A | 5/1999 | Kubota et al. | |
| 5,945,866 | A | 8/1999 | Fonash et al. | |
| 5,945,972 | A * | 8/1999 | Okumura et al. | 345/98 |
| 5,959,598 | A | 9/1999 | McKnight | |
| 5,977,940 | A | 11/1999 | Akiyama et al. | |
| 5,990,629 | A | 11/1999 | Yamada et al. | |
| 6,078,364 | A | 6/2000 | Atherton | |
| 6,115,017 | A | 9/2000 | Mikami et al. | |
| 6,115,019 | A | 9/2000 | Perner | |
| 6,165,824 | A | 12/2000 | Takano et al. | |
| 6,246,386 | B1 | 6/2001 | Perner | |
| 6,256,024 | B1 | 7/2001 | Maekawa | |
| 6,259,846 | B1 | 7/2001 | Roach et al. | |
| 6,274,887 | B1 | 8/2001 | Yamazaki et al. | |
| 6,333,737 | B1 | 12/2001 | Nakajima | |
| 6,335,728 | B1 | 1/2002 | Kida et al. | |
| 6,335,778 | B1 | 1/2002 | Kubota et al. | |
| 6,344,672 | B2 | 2/2002 | Huffman | |
| 6,344,843 | B1 | 2/2002 | Koyama et al. | |
| 6,356,028 | B1 | 3/2002 | Legagneux et al. | |
| 6,366,026 | B1 | 4/2002 | Saito et al. | |
| 6,380,876 | B1 | 4/2002 | Nagao | |
| 6,384,818 | B1 | 5/2002 | Yamazaki et al. | |
| 6,392,618 | B1 | 5/2002 | Kimura | |
| 6,433,767 | B1 | 8/2002 | Murade | |
| 6,433,841 | B1 | 8/2002 | Murade et al. | |
| 6,441,829 | B1 | 8/2002 | Blalock et al. | |
| 6,445,368 | B1 | 9/2002 | Nakajima | |
| 6,452,139 | B1 | 9/2002 | Kanno | |
| 6,456,267 | B1 * | 9/2002 | Sato et al. | 345/92 |
| 6,496,130 | B2 | 12/2002 | Nagao | |
| 6,535,192 | B1 | 3/2003 | Sung et al. | |
| 6,545,654 | B2 | 4/2003 | Jacobsen et al. | |
| 6,545,708 | B1 | 4/2003 | Tamayama et al. | |
| 6,549,196 | B1 * | 4/2003 | Taguchi et al. | 345/210 |
| 6,556,176 | B1 | 4/2003 | Okuyama et al. | |
| 6,563,480 | B1 * | 5/2003 | Nakamura | 345/82 |
| 6,564,237 | B2 | 5/2003 | Ohashi et al. | |
| 6,579,736 | B2 | 6/2003 | Yamazaki | |
| 6,580,454 | B1 | 6/2003 | Perner et al. | |
| 6,583,775 | B1 | 6/2003 | Sekiya et al. | |
| 6,611,301 | B2 | 8/2003 | Murade et al. | |
| 6,621,477 | B1 | 9/2003 | Inoue et al. | |
| 6,630,916 | B1 | 10/2003 | Shinoda | |
| 6,636,191 | B2 | 10/2003 | Cok | |
| 6,636,194 | B2 * | 10/2003 | Ishii | 345/98 |
| 6,664,943 | B1 | 12/2003 | Nakajima et al. | |
| 6,670,938 | B1 | 12/2003 | Yoshida | |
| 6,683,596 | B2 | 1/2004 | Ozawa | |
| 6,693,616 | B2 | 2/2004 | Koyama et al. | |
| 6,703,997 | B2 | 3/2004 | Murade | |
| 6,730,966 | B2 | 5/2004 | Koyama | |
| 6,731,264 | B2 | 5/2004 | Koyama et al. | |
| 6,731,272 | B2 | 5/2004 | Huang | |
| 6,738,054 | B1 * | 5/2004 | Yamaguchi | 345/204 |
| 6,747,623 | B2 | 6/2004 | Koyama | |
| 6,750,836 | B1 * | 6/2004 | Katayama et al. | 345/92 |
| 6,753,834 | B2 | 6/2004 | Mikami et al. | |
| 6,765,562 | B2 | 7/2004 | Yamazaki et al. | |
| 6,774,876 | B2 | 8/2004 | Inukai | |
| 6,775,246 | B1 | 8/2004 | Kuribayashi et al. | |
| 6,819,317 | B1 | 11/2004 | Komura et al. | |
| 6,897,932 | B2 | 5/2005 | Murade et al. | |
| 6,940,482 | B2 | 9/2005 | Ishii et al. | |
| 6,958,741 | B2 | 10/2005 | Tsutsui | |
| 6,987,496 | B2 | 1/2006 | Koyama et al. | |
| 6,992,652 | B2 | 1/2006 | Koyama | |
| 2001/0005193 | A1 | 6/2001 | Yokoyama | |
| 2002/0000969 | A1 | 1/2002 | Ozawa | |
| 2002/0003521 | A1 | 1/2002 | Matsueda et al. | |
| 2002/0018029 | A1 | 2/2002 | Koyama | |
| 2002/0018131 | A1 | 2/2002 | Kochi | |
| 2002/0021274 | A1 | 2/2002 | Koyama et al. | |
| 2002/0021295 | A1 | 2/2002 | Koyama et al. | |
| 2002/0024054 | A1 | 2/2002 | Koyama et al. | |
| 2002/0024485 | A1 | 2/2002 | Koyama | |
| 2002/0036611 | A1 | 3/2002 | Ishii | |
| 2002/0039087 | A1 | 4/2002 | Inukai | |
| 2002/0041266 | A1 | 4/2002 | Koyama et al. | |
| 2002/0057244 | A1 | 5/2002 | Koyama et al. | |
| 2002/0067327 | A1 | 6/2002 | Ozawa et al. | |
| 2002/0089483 | A1 | 7/2002 | Yamazaki et al. | |
| 2002/0113763 | A1 | 8/2002 | Koyama | |
| 2002/0130828 | A1 | 9/2002 | Yamazaki et al. | |
| 2003/0067632 | A1 | 4/2003 | Ohta et al. | |
| 2003/0071772 | A1 | 4/2003 | Kimura | |
| 2003/0098875 | A1 | 5/2003 | Kurokawa et al. | |
| 2003/0103025 | A1 | 6/2003 | Kurokawa et al. | |
| 2003/0234755 | A1 | 12/2003 | Koyama et al. | |
| 2004/0085269 | A1 | 5/2004 | Mikami et al. | |
| 2004/0164322 | A1 | 8/2004 | Kondo et al. | |
| 2004/0183766 | A1 | 9/2004 | Koyama et al. | |
| 2004/0222955 | A1 | 11/2004 | Koyama | |
| 2005/0078073 | A1 | 4/2005 | Mikami et al. | |
| 2006/0066765 | A1 | 3/2006 | Koyama | |
| 2006/0098003 | A1 | 5/2006 | Koyama et al. | |

FOREIGN PATENT DOCUMENTS

| | | |
|---|---|---|
| EP | 0 717 445 | 6/1996 |
| EP | 0 797 182 | 9/1997 |
| EP | 0 999 595 A2 | 5/2000 |
| EP | 1 098 290 A2 | 5/2001 |
| EP | 1 139 327 | 10/2001 |
| JP | 04-350627 | 12/1992 |
| JP | 06-011734 | 1/1994 |
| JP | 06-102530 | 4/1994 |
| JP | 08-101609 | 4/1996 |
| JP | 08-101669 | 4/1996 |
| JP | 08-194205 | 7/1996 |
| JP | 08-241048 | 9/1996 |
| JP | 08-286170 | 11/1996 |
| JP | 09-212140 | 8/1997 |
| JP | 09-243996 | 9/1997 |
| JP | 09-258168 | 10/1997 |
| JP | 10-503032 | 3/1998 |
| JP | 10-092576 | 4/1998 |
| JP | 10-214060 | 8/1998 |
| JP | 10-228012 | 8/1998 |
| JP | 10-068931 | 9/1998 |
| JP | 10-232649 | 9/1998 |
| JP | 10-247735 | 9/1998 |
| JP | 10-253941 | 9/1998 |
| JP | 10-312173 | 11/1998 |
| JP | 11-064814 | 3/1999 |
| JP | 11-085111 | 3/1999 |
| JP | 11-218781 | 8/1999 |

| | | |
|---|---|---|
| JP | 2001-281635 | 10/2001 |
| WO | WO96-002866 | 2/1996 |

OTHER PUBLICATIONS

Shimoda et la.; "High Resolution Light Emitting Polymer Driven by Low Temperature Polysilicon Thin Film Transistor with Integrated Driver"; *ASIA Display 98*; pp. 217-220; 1998.
Han et al.; "Green OLED with low temperature poly Si TFT"; *Euro Display 99 Late-news Papers*; pp. 27-30; 1999.
Schenk et al.; *Polymers for Light Emitting Diodes*; EuroDisplay '99; The 19th International Display Research Conference; Sep. 6-9, 1999; pp. 33-37.
U.S. Appl. No. 09/923,433, mailed Jul. 28, 2004.
U.S. Appl. No. 09/930,956, mailed Nov. 4, 2004.
U.S. Appl. No. 09/930,956, mailed Apr. 19, 2004.
U.S. Appl. No. 09/969,591, mailed Jun. 30, 2005.
U.S. Appl. No. 09/930,956, mailed Oct. 28, 2003.
U.S. Appl. No. 09/916,306, mailed Jan. 25, 2005.
U.S. Appl. No. 09/931,061, mailed Mar. 22, 2005.
U.S. Appl. No. 09/930,956, mailed May 2, 2005.
China Patent Application Office Action (Application No. 001126012.2) mailed Mar. 18, 2005.
Jun Koyama et al.; "A 4.0-in. Poly Si TFT-LCD with Integrated 6-bit Digital Data Driver Using CGS Technology"; *AMLCD 1999*; pp. 29-32; 1999.
Tsutsui et al.; "Electroluminescence in Organic Thin Films"; *Photochemical Processes in Organized Molecular Systems*; pp. 437-450; 1991.
M.A. Baldo et al.; "Very High-Efficiency Green Organic Light-Emitting Devices Based on Electrophosphorescence"; *Applied Physics Letters*, vol. 75(1); pp. 4-6; Jul. 5, 1999.
M.A. Baldo et al.; "Highly Efficient Phosphorescent Emission from Organic Electroluminescent Devices"; *Nature*, vol. 395; pp. 151-154; Sep. 10, 1998.
Tsutsui et al.; "High Quantum Efficiency in Organic Light-Emitting Devices with Irdium-Complex as a Triplet Emissive Center"; *Japanes Journal of Applied Physics*; vol. 38, Part 12B; pp. L1502-L1504; Dec. 15, 1999.
Shimoda et al.; "Current Status and Future of Light-Emitting Polymer Display Driven by Poly-Si TFT"; *SID 99 Digest*; pp. 372-375; 1999.
Shimoda et la.; "High Resolution Light Emitting Polymer Driven by Low Temperature Polysilicon Thin Film Transistor with Integrated Driver"; *ASIA Display 98*; pp. 217-220; 1998.
Han et al.; "Green OLED with low temperature poly Si TFT"; *Euro Display 99 Late-news Papers*; pp. 27-30; 1999.

* cited by examiner

PORTABLE INFORMATION APPARATUS AND METHOD OF DRIVING THE SAME

BACKGROUND OF THE INVENTION

1. Field of the Invention

The present invention relates to a portable information apparatus, and more particularly, to a portable information apparatus incorporating a display device using an organic EL (electroluminescence) element, such as a portable telephone, a PDA, a portable personal computer, a portable navigation system, and an electronic book.

Note that, in the present specification, the EL element indicates both an element using light emission (fluorescence) from a singlet exciton and an element using light emission (phosphorescence) from a triplet exciton.

2. Description of the Related Art

In recent years, a portable telephone has become popular by the development of a communication technique. In future, electrical transmission of moving pictures, and transmission of a larger amount of information are expected. On the other hand, a personal computer is also made lightweight, and a product for mobile use is produced. A number of information instruments called personal digital assistants (PDA) starting with electronic notebooks are also produced and are coming into wide use. Further, an EL display device and the like is developed, so that most of the portable information instruments are equipped with flat displays.

Further, in a recent technique, there is a tendency that an active matrix type display device is used as an EL display device employed for those.

In the active matrix type display device, a thin film transistor (hereinafter referred to as a TFT) is arranged for each pixel, and an image is controlled. As compared with a passive matrix type display device, such an active matrix type display device has merits in that high definition can be achieved, picture quality can be improved, moving pictures can be handled, and the like. Therefore, in future, it appears that the EL display device of a portable information apparatus is changed from the passive matrix type to the active matrix type.

Further, in the active matrix type display devices, in recent years, a display device using low temperature polysilicon has been realized as a product. In a low temperature polysilicon technique, in addition to pixel TFTs constituting pixels, a driving circuit can be formed at the peripheral portion of a pixel portion by using TFTs at the same time, which greatly contributes to miniaturization of a device and reduction in consumed electric power. Accordingly, the EL display device becomes an indispensable device for a display portion of a mobile instrument or the like the application field of which is remarkably expanded in recent years.

FIG. 15 is a block diagram of a conventional portable information terminal incorporating an EL display device.

The portable information terminal is required to extract information demanded by user as the need arises. The information is stored in a memory device (a DRAM 1509, a flash memory 1510, etc.) in the portable information terminal, is stored in a memory card 1503 inserted into the portable information terminal, or is obtained through connection to an external instrument via an external interface portion 1505. The information is processed by a CPU 1506 on the basis of instructions of the user inputted from a pen input tablet 1501, and an EL display device 1513 carries out a display.

Specifically, a signal inputted from the pen input tablet 1501 is detected by a detection circuit 1502, and is inputted to a tablet interface 1518. This input signal is processed by the tablet interface 1518, and is inputted to a picture signal processing circuit 1507 and the like. The CPU 1506 processes necessary data, converts it into image data on the basis of an image format stored in a VRAM 1511, and sends it to an EL controller 1512. Here, the EL controller 1512 generates a signal for driving the EL display device 1513 and inputs it to the display device 1513. In this way, the display device 1513 is driven to carry out a display.

FIG. 16 is a block diagram of a conventional portable telephone incorporating an EL display device. The portable telephone includes a transmit-receive circuit 1615, a voice processing circuit 1602 for voice processing a received signal, a speaker 1614, a mike 1608, a keyboard 1601 for inputting data, a keyboard interface 1618 for processing a signal inputted from the keyboard 1601, and the like.

On the basis of the instructions of the user inputted from the keyboard, the CPU 1606 processes information stored in the memory device (a DRAM 1609, a flash memory 1610, etc.), information stored in a memory card 1603 inserted in the portable information terminal, or information obtained through connection to an external instrument via an external interface port 1605, and an EL display device 1613 carries out a display.

Specifically, a signal inputted from the keyboard 1601 is processed by the keyboard interface 1618 and is inputted to a picture signal processing circuit 1607 and the like. A CPU 1606 processes necessary data, converts it into image data on the basis of an image format stored in a VRAM 1611, and sends it to an EL controller 1612. Here, the EL controller 1612 generates a signal for driving the EL display device 1613, and inputs it to the display device. In this way, the display device is driven to carry out a display.

An example of a structure of the transmit-receive circuit 1615 is shown in FIG. 26.

The transmit-receive circuit 1615 includes an antenna 2602, filters 2603, 2607, 2608, 2612, and 2616, a switch 2604, amplifiers 2605, 2606 and 2617, a first frequency changing circuit 2609, a second frequency changing circuit 2613, a frequency changing circuit 2611, oscillation circuits 2610 and 2614, a chopper 2615, a data demodulation circuit 2618, and a data modulation circuit 2619.

Here, as a display device incorporated in the portable information terminal or the portable telephone, a conventional digital system EL display device will be described. FIG. 13 is its schematic view. A pixel portion 1308 is arranged at the center. A source signal line driving circuit 1301 for controlling source signal lines is arranged at the upper side of a pixel portion. The source signal line driving circuit 1301 includes a shift register circuit 1303, a first latch circuit 1304, a second latch circuit 1305, a D/A converter (D/A conversion circuit) 1306, an analog switch 1307, and the like. Gate signal line driving circuits 1302 for controlling gate signal lines are arranged at both sides of the pixel portion. Note that, in FIG. 13, although the gate signal line driving circuits 1302 are arranged at both sides of the pixel portion, they may be arranged at one side. However, the arrangement at both sides is desirable in view of driving efficiency and driving reliability.

The source signal line driving circuit 1301 has a structure as shown in FIG. 14. The driving circuit shown as an example in FIG. 14 is a source signal line driving circuit corresponding to a horizontal resolution of 1024 pixels and a display of 3-bit digital gradation signal, and includes shift register circuits (SR) 1401, first latch circuits (LAT 1) 1402, second latch circuits (LAT 2) 1403, D/A converters (D/A)

1404, and the like. Note that, although not shown in FIG. 14, a buffer circuit, a level shifter circuit, and the like may be arranged as the need arises.

The operation of the display device will be described in brief with reference to FIGS. 13 and 14. First, clock signals (S-CLK, S-CLKb) and a start pulse (S-SP) are inputted to the shift register circuit 1303 (expressed as SR in FIG. 14), and pulses (sampling pulses) are sequentially outputted. Subsequently, the pulses are inputted to the first latch circuit 1304 (expressed as LAT 1 in FIG. 14), and digital signals (Digital Data) inputted to the same first latch circuit 1304 are respectively held. Here, Dl is the most significant bit (MSB) and D3 is the least significant bit (LSB). In the first latch circuit 1304, when holding of the digital signals for one horizontal period is completed, the digital signals held in the first latch circuit 1304 are transferred in the retrace period to the second latch circuit 1305 (expressed as LAT 2 in FIG. 14) all at once in accordance with the input of a latch signal (Latch Pulse).

Thereafter, the shift register circuit 1303 is again operated, and holding of digital signals for a next horizontal period is started. At the same time, the digital signals held in the second latch circuit 1305 are converted into analog signals by the D/A converter 1306 (expressed as D/A in FIG. 14). The analog signals are inputted to the pixels through the source signal lines. This operation is repeated, so that an image is displayed.

Subsequently, driving of the pixel portion 1308 will be described. FIGS. 29A and 29B show a part of the pixel portion 1308 of FIG. 13. FIG. 29A shows a matrix of 3×3 pixels. A portion surrounded by a dotted line frame 1900 is one pixel, and FIG. 29B is an enlarged view thereof. In FIG. 29B, reference numeral 1901 designates a TFT (hereinafter referred to as a switching TFT) functioning as a switching element when a signal is written into the pixel. Any polarity of an N-channel type and a P-channel type may be used for the switching TFT 1901. Reference numeral 1902 designates a TFI (hereinafter referred to as an EL driving TFT) functioning as an element (current control element) for controlling an electric current supplied to an EL element 1903. In the case where the P-channel type is used for the EL driving TFT 1902, it is arranged between an anode 1909 of the EL element 1903 and a current supply line 1907. As another constitution method, the N-channel type is used for the EL driving TFT 1902, and it can also be arranged between a cathode 1910 of the EL element 1903 and a cathode electrode 1908. However, since the grounded source is excellent for the operation of a TFI, and in view of the restriction in the manufacture of the EL element 1903, a system is generally often adopted, in which the P-channel type is used for the EL driving TFT 1902 and as shown in FIG. 29B, the EL driving TFT 1902 is arranged between the anode 1909 of the EL element 1903 and the current supply line 1907. Reference numeral 1904 designates a storage capacitor for holding a signal (voltage) inputted from a source signal line 1906. Although one terminal of the storage capacitor 1904 in FIG. 29B is connected to the current supply line 1907, there is also a case where a dedicated wiring line is used. A gate electrode of the switching TFT 1901 is connected to a gate signal line 1905, one of a source region and a drain region is connected to the source signal line 1906, and the other is connected to a gate electrode of the EL driving TFT.

Next, the operation of a circuit of an active matrix type EL display device will be described with reference to FIGS. 29A and 29B. First, when the gate signal line 1905 is selected, a voltage is applied to the gate electrode of the switching TFT 1901, and the switching TFT 1901 comes to have a conductive state. Then, the signal (voltage) of the source signal line 1906 is inputted to the storage capacitor 1904. Since the voltage of the storage capacitor 1904 becomes a voltage $V_{GS}$ between the gate and source of the EL driving TFT 1902, a current corresponding to the voltage of the storage capacitor 1904 flows through the EL driving TFT 1902 and the EL element 1903. As a result, the EL element 1903 lights up.

The brightness of the EL element 1903, that is, the amount of current flowing through the EL element 1903 is controlled by the voltage $V_{GS}$ of the EL driving TFT 1902. The voltage $V_{GS}$ is the voltage of the storage capacitor 1904, and is the signal (voltage) inputted to the source signal line 1906. That is, by controlling the signal (voltage) inputted to the source signal line 1906, the brightness of the EL element 1903 is controlled. Finally, the gate signal line 1905 is made to have the non-selected state, the gate of the switching TFT 1901 is closed, and the switching TFT 1901 is made to have the non-conduction state. At that time, the electric charge stored in the storage capacitor 1904 is held. Thus, the voltage $V_{GS}$ of the EL driving TFT 1902 is held as it is, and the current corresponding to the voltage $V_{GS}$ continues flowing through the EL driving TFT 1902 to the EL element 1903.

The driving of the EL element etc. is reported in SID99 Digest: P372: "Current Status and future of Light-Emitting Polymer Display Driven by Poly-Si TFT", ASIA DISPLAY98: P217: "High Resolution Light Emitting Polymer Display Driven by Low Temperature Polysilicon Thin Film Transistor with Integrated Driver", Euro Display99 Late News: P27: "3.8 Green OLED with Low Temperature Poly-Si TFT", and the like.

In the conventional portable information apparatus as described above, in the case where the incorporated display device displays an image, even if the image is a still image, data of the same picture continues to be transmitted to the display device 60 times per second. That is, in FIG. 15, the portions (the picture signal processing circuit 1507 in the CPU 1506, the VRAM 1511, the EL controller 1512, the source signal line driving circuit and the gate signal line driving circuit of the EL display device 1513, the pen input tablet 1501, the detection circuit 1502, and the tablet interface 1518) surrounded by dotted lines continue the operation as long as the image is displayed. Further, in FIG. 16, the portions (the picture signal processing circuit 1607 in the CPU 1606, the VRAM 1611, the EL controller 1612, the source signal line driving circuit and the gate signal line driving circuit of the EL display device 1613, the keyboard 1601, and the keyboard interface 1618) surrounded by dotted lines continue the operation as long as the image is displayed.

Here, in some of the passive matrix type display devices having a small number of pixels, a driver IC of a display device or a controller has a built-in memory circuit, and a VRAM is stopped. However, in the display device using a large number of pixels, such as an active matrix type display device, to incorporate a memory circuit in a driver or a controller is impractical in view of the chip size. Thus, in the conventional portable information apparatus, even in the case where a still picture is displayed, many circuits must continue the operation, which prevents the reduction in consumed electric power.

Further, in a mobile instrument, reduction in consumed electric power is greatly desired. Further, in the mobile instrument, in spite of the fact that it is mostly used in a still picture mode (still picture is continuously displayed), since the driving circuit continues the operation even at the time of displaying the still picture as described above, this is an obstacle to the reduction in consumed electric power.

SUMMARY OF THE INVENTION

An object of the present invention is therefore to reduce consumed electric power of a driving circuit at the time of displaying a still picture in an instrument desired to reduce consumed electric power, such as a portable information terminal or a portable telephone.

In order to achieve the above object, the present invention adopts the following means.

A plurality of memory circuits are disposed in a pixel of a display device incorporated in a portable information apparatus, and digital signals are stored in each pixel. In the case of a still picture, when writing is once carried out, thereafter, since information written in the pixel is the same, even if the input of a signal is not carried out for each frame, the still picture can be continuously displayed by reading out the signals stored in the memory circuits.

That is, when the still picture is displayed, after a processing operation of signals for at least one frame is carried out, a source signal line driving circuit, an image signal processing circuit and the like can be stopped, and accordingly, power consumption can be greatly reduced.

Hereinafter, the structures of a portable information apparatus of the present invention will be described.

According to the present invention, there is provided a portable information apparatus having an EL display device, characterized in that:

the EL display device includes a plurality of pixels;

each of the plurality of pixels includes a plurality of memory circuits and a D/A converter.

According to the present invention, there is provided a portable information apparatus having an EL display device, characterized in that;

the EL display device includes a plurality of pixels;

each of the plurality of pixels includes n (n is a natural number not less than 2) memory circuits and a D/A converter for converting digital signals stored in the n memory circuits into an analog signal.

According to the present invention, there is provided a portable information apparatus having an EL display device, characterized in that;

the EL display device includes a plurality of pixels and a power supply line;

each of the plurality of pixels includes a TFT to a gate electrode of which an analog signal is inputted, and an EL element;

one of a source region and a drain region of the TFT is connected to the power supply line and the other is connected to the El element;

each of the plurality of pixels includes n (n is a natural number not less than 2) memory circuits and a D/A converter for converting digital signals stored in the n memory circuits into the analog signal.

According to the present invention, there is provided a portable information apparatus having an EL display device, characterized in that:

the EL display device includes a plurality of pixels and a power supply line;

each of the plurality of pixels includes a TFT to a gate electrode of which an analog signal is inputted, and an EL element;

one of a source region and a drain region of the TFT is connected to the power supply line and the other is connected to the El element;

each of the plurality of pixels includes n×m (n is a natural number not less than 2, m is a natural number not less than 2) memory circuits and a D/A converter for converting n-bit digital signals stored in the n×m memory circuits into the analog signal.

According to the present invention, there is provided a portable information apparatus having an EL display device, characterized in that:

the EL display device includes a plurality of pixels;

each of the plurality of pixels includes a TFT to a gate electrode of which an analog signal is inputted, a power supply line, and an EL element;

one of a source region and a drain region of the TFT is connected to the power supply line and the other is connected to the El element;

each of the plurality of pixels includes n×m (n is a natural number not less than 2, m is a natural number not less than 2) memory circuits and a D/A converter for converting n-bit digital signals stored in the n×m memory circuits into the analog signal;

each of the plurality of pixels stores the digital signals for m frames.

A portable information apparatus may have a feature such that the EL display device includes a source signal line, and the memory circuits and the D/A converter are disposed to overlap with the source signal line.

A portable information apparatus may have a feature such that the EL display device includes a gate signal line, and the memory circuits and the D/A converter are disposed to overlap with the gate signal line.

According to the present invention, there is provided a portable information apparatus having an EL display device, characterized in that:

the EL display device includes a plurality of pixels;

each of the plurality of pixels includes an EL element;

each of the plurality of pixels includes a source signal line, n (n is a natural number not less than 2) gate signal lines, a power supply line, n first TFTs, n memory circuits, a second TFT, and a D/A converter;

each of gate electrodes of the n first TFTs is connected to any different one of the n gate signal lines, one of a source region and a drain region is connected to the source signal line, and the other is connected to any different one of input terminal of the n memory circuits;

each of output terminals of the n memory circuits is connected to an input terminal of the D/A converter;

an output terminal of the D/A converter is connected to a gate electrode of the second TFT;

one of a source region and a drain region of the second TFT is connected to the power supply line, and the other is connected to the EL element.

According to the present invention, there is provided a portable information apparatus having an EL display device, characterized in that:

the EL display device includes a plurality of pixels;

each of the plurality of pixels includes an EL element;

each of the plurality of pixels includes n source signal lines (n is a natural number not less than 2), a gate signal line, a power supply line, n first TFTs, n memory circuits, a second TFT, and a D/A converter;

each of gate electrodes of the n first TFTs is connected to the gate signal line, one of a source region and a drain region is connected to any different one of the n source signal lines, and the other is connected to any different one of input terminal of the n memory circuits;

each of output terminals of the n memory circuits is connected to an input terminal of the D/A converter;

an output terminal of the D/A converter is connected to a gate electrode of the second TFT;

one of a source region and a drain region of the second TFT is connected to the power supply line, and the other is connected to the EL element.

A portable information apparatus may have a feature such that the EL display device includes a source signal line driving circuit, and the source signal line driving circuit includes shift registers, first latch circuits for holding n-bit digital signals by sampling pulses from the shift registers, second latch circuits to which the n-bit digital signals held in the first latch circuits are transferred, and switches for sequentially selecting one bit by one bit the n-bit digital signals transferred to the second latch circuits to input them to the source signal line.

A portable information apparatus may have a feature such that the EL display device includes a source signal line driving circuit, and the source signal line driving circuit includes shift registers, first latch circuits for holding one-bit digital signals by sampling pulses from the shift registers, and second latch circuits to which the one-bit digital signals held in the first latch circuits are transferred.

A portable information apparatus may have a feature such that the EL display device includes a source signal line driving circuit, and the source signal line driving circuit includes shift registers, and latch circuits for holding n-bit digital signals by sampling pulses from the shift registers.

A portable information apparatus may have a feature such that the EL display device includes a source signal line driving circuit, and the source signal line driving circuit includes shift registers, latch circuits for holding n-bit digital signals by sampling pulses from the shift registers, and n switches for inputting the n-bit digital signals held in the latch circuits to the n source signal lines.

A portable information apparatus may have a feature such that the memory circuit is a memory selected from the group consisting of a static memory (SRAM), a ferroelectric memory (FRAM) and a dynamic memory (DRAM).

A portable information apparatus may have a feature such that the memory circuits are formed on a substrate selected from the group consisting of a glass substrate, a plastic substrate, a stainless substrate, and a single crystal wafer.

A portable information apparatus may have a feature such that the portable information apparatus is one selected from the group consisting of a portable telephone, a personal computer, a navigation system, a PDA, and an electronic book.

According to the present invention, there is provided a method of driving a portable information apparatus incorporating an EL display device including a plurality of pixels, the method having the steps of:

storing digital signals in a plurality of memory circuits included in each of the plurality of pixels;

reading out the stored digital signals repeatedly;

converting the repeatedly read digital signals into corresponding analog signals;

inputting the analog signals to an EL element.

A method of driving a portable information apparatus may have a feature such that the plurality of pixels are arranged in a matrix form, and only the stored digital signals of the plurality of memory circuits included in a pixel at a specific row or a pixel at a specific column among the plurality of pixels are rewritten.

According to the present invention, there is provided a method of driving a portable information apparatus incorporating an EL display device including a plurality of pixels and a source signal line driving circuit for inputting picture signals to the plurality of pixels, the method having the steps of:

storing digital signals in a plurality of memory circuits included in each of the plurality of pixels;

reading out the stored digital signals repeatedly;

converting the repeatedly read digital signals into corresponding analog signals;

inputting the analog signals to an EL element;

stopping an operation of the source signal line driving circuit.

According to the present invention, there is provided a method of driving a portable information apparatus including an EL display device and a CPU, characterized in that:

the EL display device includes a plurality of pixels and a first circuit for outputting signals to the plurality of pixels;

the CPU includes a second circuit for controlling the first circuit;

digital signals are stored in a plurality of memory circuits included in each of the plurality of pixels;

the stored digital signals are repeatedly read out;

the repeatedly read digital signals are converted into corresponding analog signals;

the signals are inputted to an EL element;

an operation of the second circuit is stopped.

According to the present invention, there is provided a method of driving a portable information apparatus incorporating an EL display device including a plurality of pixels, and a VRAM, characterized in that:

digital signals are stored in a plurality of memory circuits included in each of the plurality of pixels;

the stored digital signals are repeatedly read out;

the repeatedly read digital signals are converted into corresponding analog signals;

the analog signals are inputted to an EL element;

a data readout operation of the VRAM is stopped.

A method of driving a portable information apparatus may have a feature such that one readout operation is carried out for one frame period in the plurality of memory circuits.

A method of driving a portable information apparatus may have a feature such that the memory circuit is a memory selected from the group consisting of a static memory (SRAM), a ferroelectric memory (FRAM) and a dynamic memory (DRAM).

A method of driving a portable information apparatus may have a feature such that the memory circuits are formed on a substrate selected from the group consisting of a glass substrate, a plastic substrate, a stainless substrate, and a single crystal wafer.

A method of driving a portable information apparatus may have a feature such that the portable information apparatus is one selected from the group consisting of a portable telephone, a personal computer, a navigation system, a PDA, and an electronic book.

DETAILED DESCRIPTION OF THE PREFERRED EMBODIMENTS

An embodiment mode of the invention will be described below.

First, a display device included in a portable information apparatus of the present invention will be described.

Figure 1:
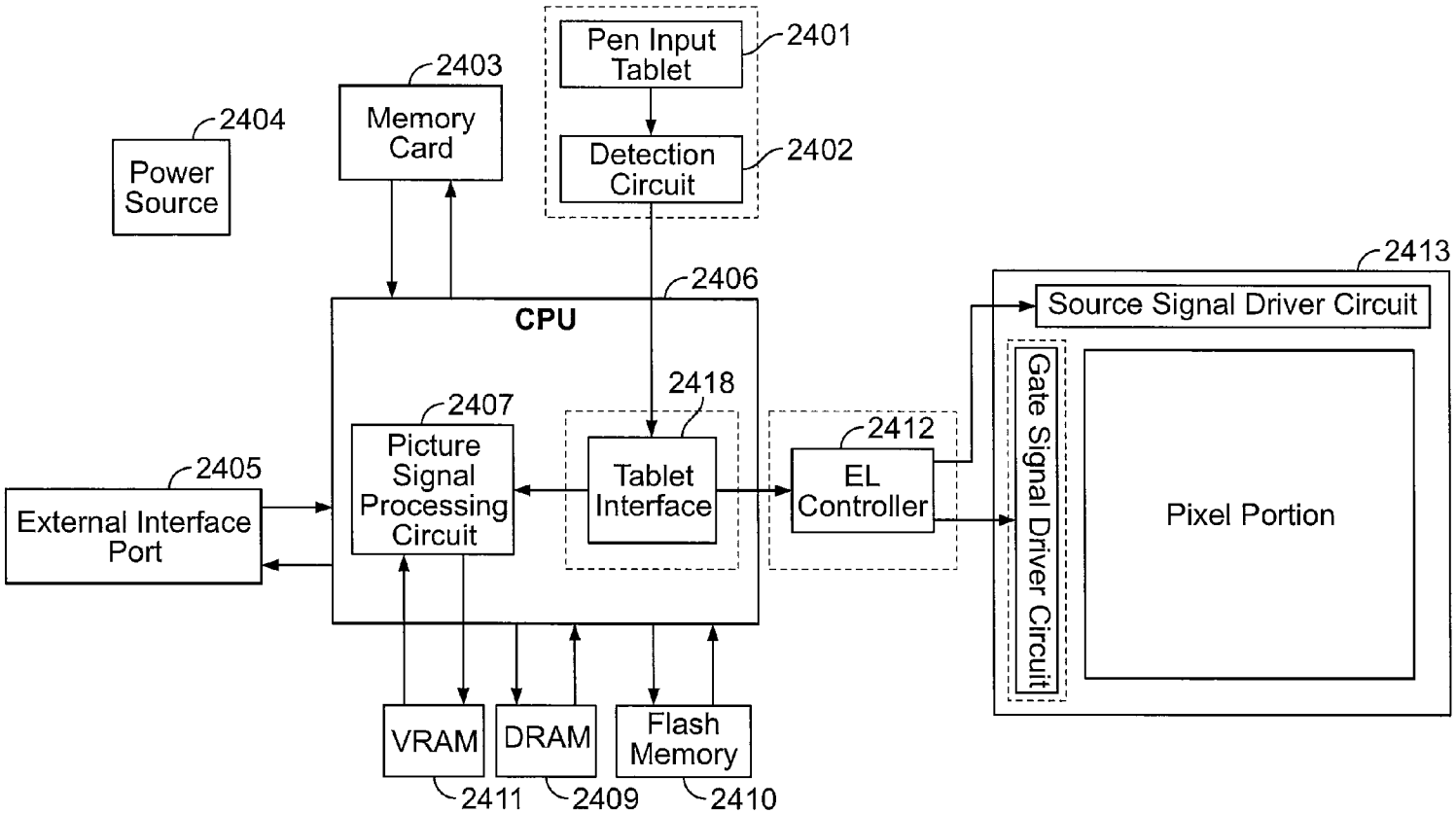
FIG. 1 is a block diagram of a portable information terminal of the present invention including a plurality of memory circuits in its inside.

FIG. 1 shows a structure of the present invention. In the present invention, in the case where a still picture is displayed, picture signals are stored in memory circuits in the inside of a pixel of a display device 2413, and the stored picture signals are called, so that a display is carried out. Thus, a picture signal processing circuit 2407 in inner circuits of a CPU 2406, a VRAM 2411, a source signal line driving circuit in the display device 2413, which are conventionally operated, can be stopped.

Hereinafter, the contents will be specifically described. In the case where an input from a pen input tablet 2401 is not made for a certain time, or a signal input to cause a picture display to be changed is not made for a certain time from an external interface port 2405, the CPU 2406 judges that a mode is a still picture mode. In the case where the CPU 2406 makes such judgement, the CPU 2406 carried out an operation as described below. The source signal line driving circuit of the display device 2413 is stopped through an EL controller 2412. Specifically, supply of a start pulse, a clock signal, and a picture data signal to the source signal line driving circuit is stopped, so that the operation of the source signal line driving circuit can be stopped. At this time, the gate signal line driving circuit is not stopped, but receives signals and executes an operation to send data of the memory circuits to the EL driving TFF.

Like this, in the case where readout of the signals held in the memory circuits is carried out by using the gate signal line driving circuit, the EL controller 2412 continues to supply a clock signal, a start pulse, and the like to the gate signal line driving circuit, and the gate signal line driving circuit continues the operation.

Since the gate signal line driving circuit is generally driven at a frequency of 1/100 or less as compared with the source signal line driving circuit, even if the operation is not stopped, consumed electric power does not become problematic. Of course, the gate signal line driving circuit may be stopped. By the operation like this, the display device 2413 stops only the source signal line driving circuit or both the signal line driving circuits of the source signal line driving circuit and the gate signal line driving circuit, and carries out a display.

Next, the CPU 2406 stops the picture signal processing circuit 2407 in the CPU 2406 and the VRAM 2411. As described above, since the display device 2413 carries out a display by using the picture data stored in the inner memory circuits, it is not necessary to newly send picture data to the display device. Thus, it does not matter if the picture signal processing circuit 2407, the VRAM 2411 and the like which generate and process picture data do not operate.

That is, it is possible to stop the operation of the picture signal processing circuit 2407, the VRAM 2411 and the like.

From the above, reduction in electric power of the inside of the CPU 2406, reduction in electric power of the VRAM 2411, and reduction in electric power of the source signal line driving circuit can be achieved.

When the EL display device displays a still picture, in the case where an input is made to the pen input tablet 2401, and an image displayed by the EL display device is changed according to a picture signal corresponding to this input, instructions to change display contents are issued from a detection circuit 2402 of the pen input tablet through a tablet interface 2418 to the CPU 2406, and the CPU 2406 operates the VRAM 2411 and the picture signal processing circuit 2407 which were stopped. Then, a start pulse, a clock signal, and picture data are supplied to the source signal line driving circuit of the display device 2413 by the EL controller 2412, and the stopped source signal line driving circuit is operated, so that a new picture signal can be written into a pixel.

Like this, in FIG. 1, if the portions (the gate signal line driving circuit, the EL controller 2412, the pen input tablet 2401, the detection circuit 2402, and the tablet interface 2418) surrounded by dotted lines operate, the portable information terminal continues to display a still picture.

Figure 2:
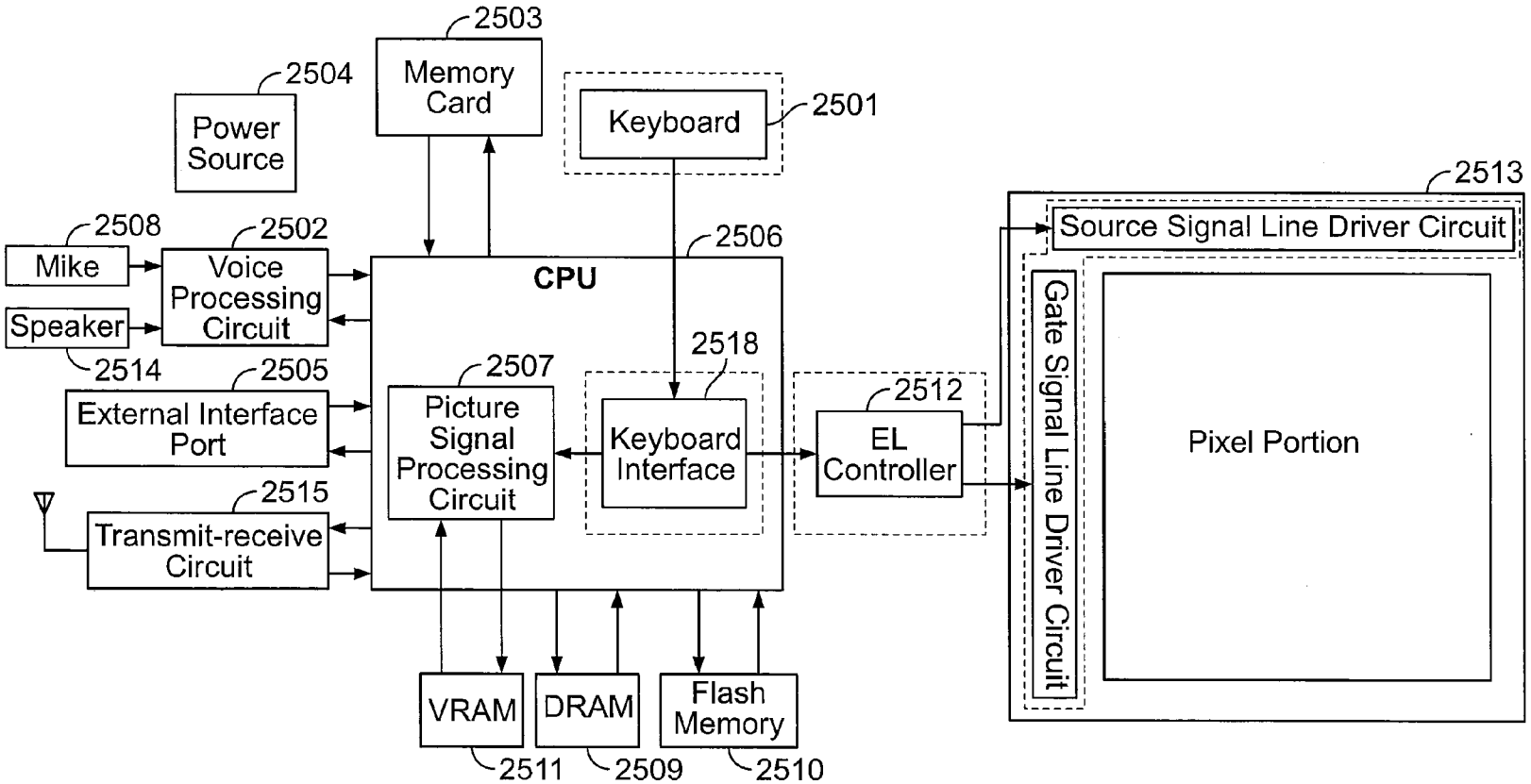
FIG. 2 is a block diagram of a portable telephone of the present invention including a plurality of memory circuits in its inside.

FIG. 2 shows an example of a portable telephone using the present invention. The outline of the operation is substantially equal to that of the portable information terminal of FIG. 1. The difference between the portable telephone and the portable information terminal is that in the portable telephone, an input is made through a keyboard 2501 and inputted information is inputted to a CPU 2506 through a keyboard interface 2518, and information inputted to an antenna through a communication system of a telephone company is subjected to amplification and the like by a transmit-receive circuit 2515, and then, it is inputted to the CPU 2506.

In the case where a still picture is displayed, similarly to the foregoing portable information terminal, a picture signal processing circuit 2507, a VRAM 2511, a source signal line driving circuit, and the like can be stopped.

Like this, in FIG. 2, if the portions (a gate signal line driving circuit, an EL controller 2512, the keyboard 2501, and the keyboard interface 2518) surrounded by dotted lines operate, the portable telephone continues to display the still picture.

Next, a display device included in a portable information apparatus of the present invention will be described.

Figure 25:
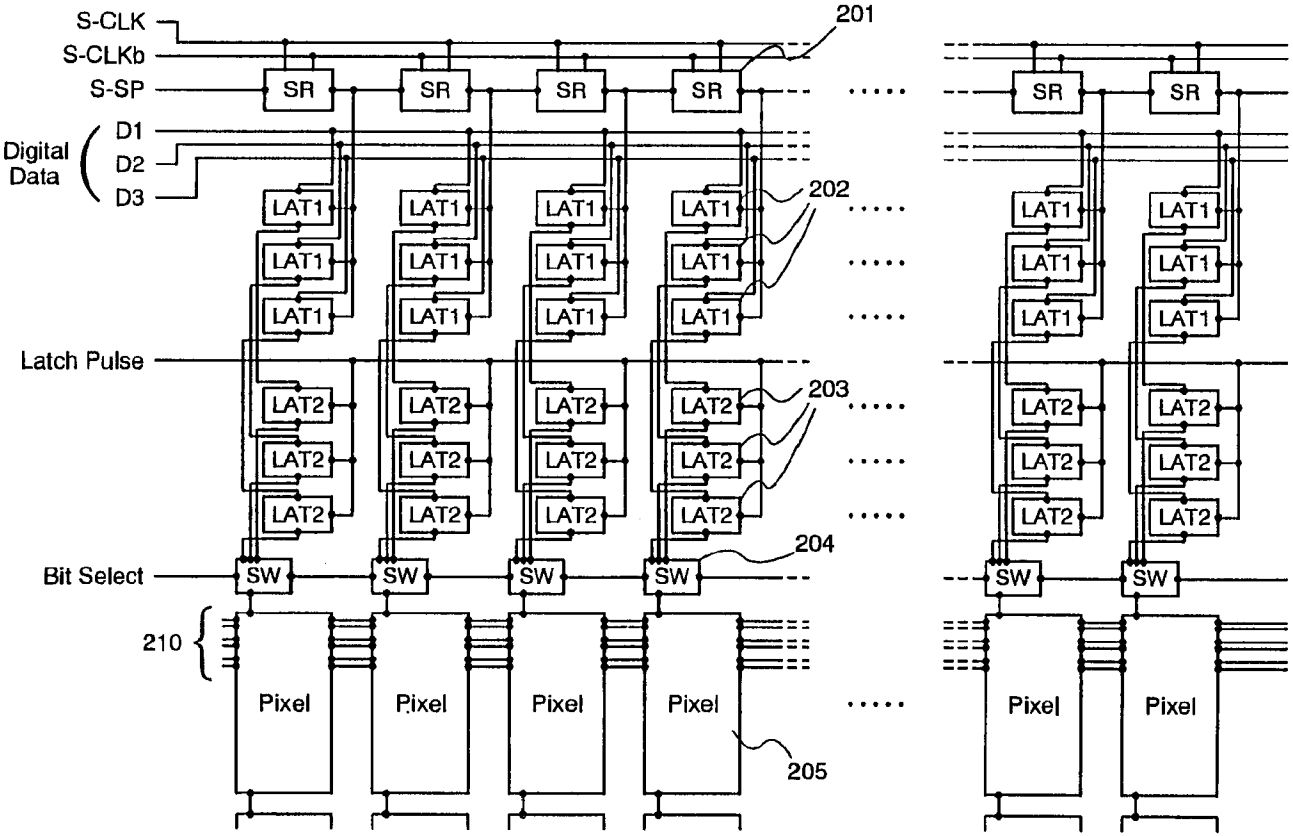
FIG. 25 is a view showing a circuit structural example of a source signal line driving circuit.
Figure 26:
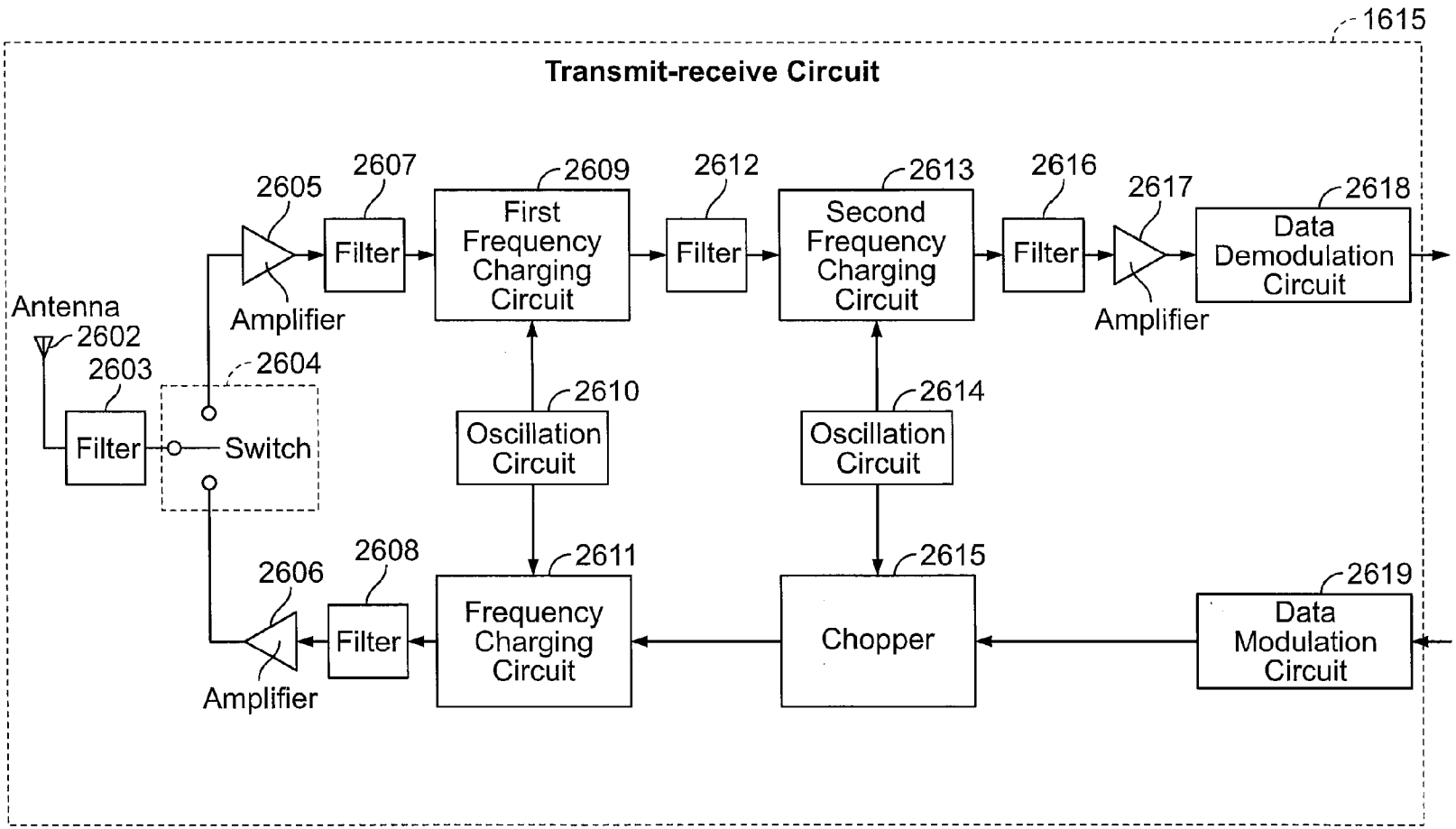
FIG. 26 is a block diagram of a transmit-receive portion of a portable telephone.

FIG. 25 shows a structure of a source signal line driving circuit and some pixels in the display device including pixels having memory circuits. This circuit corresponds to a 3-bit digital gradation signal, and includes shift register circuits 201, first latch circuits 202, second latch circuits 203, bit signal selection switches 204, and pixels 205. Reference numeral 210 designates a signal supplied from a gate signal line driving circuit or directly from the outside, and is described later together with the description of the pixel.

Figure 24:
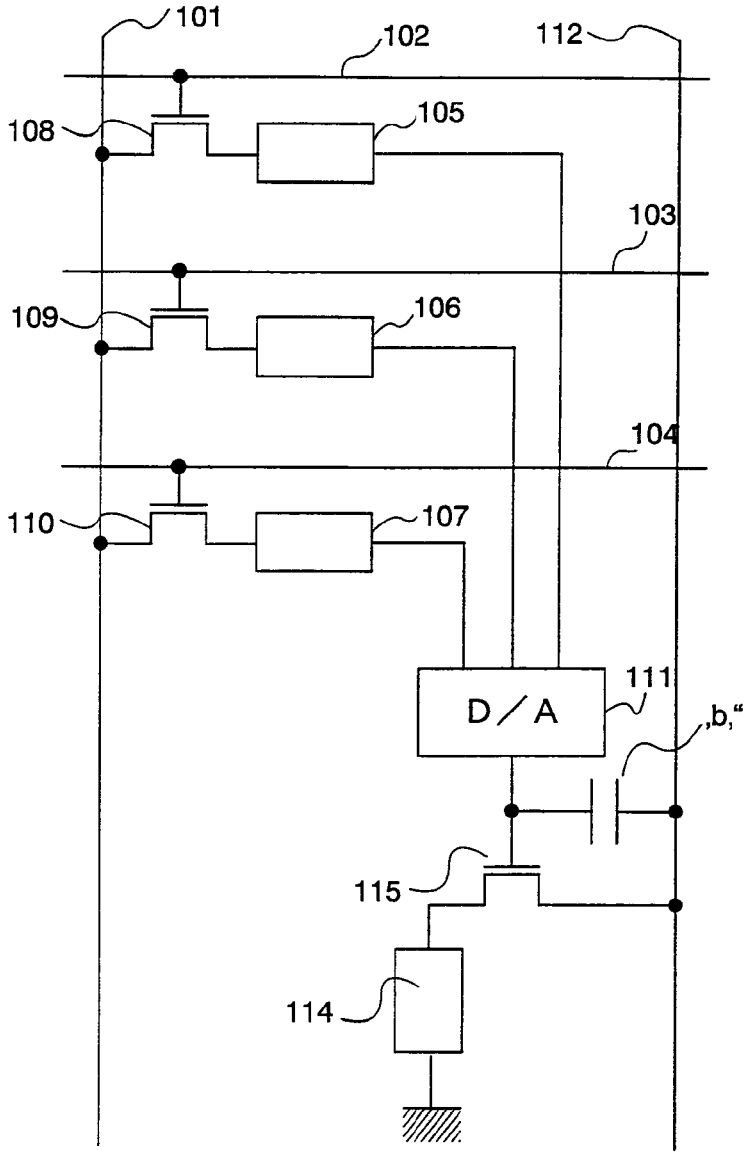
FIG. 24 is a view showing a structure of a pixel of an EL display device of a portable information apparatus of the present invention.

FIG. 24 shows a circuit structure of the pixel 205 in FIG. 25 in detail. This pixel corresponds to 3-bit digital gradation, and includes an EL element (114), a storage capacitor (Cs), memory circuits (105 to 107), a D/A converter (D/A: 111), an EL driving TFT (115), a power supply line (112), and the like. Reference numeral 101 designates a source signal line; 102 to 104, writing gate signal lines; and 108 to 110, writing TFTs.

Figure 3A:
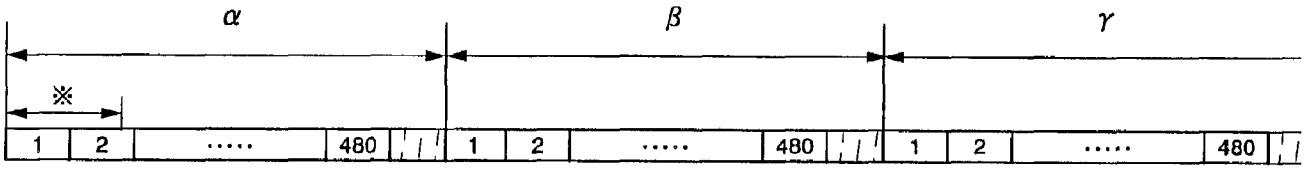
FIGS. 3A and 3B are views showing timing charts for carrying out a display by using pixels of an EL display device of a portable information apparatus of the present invention.
Figure 3B:
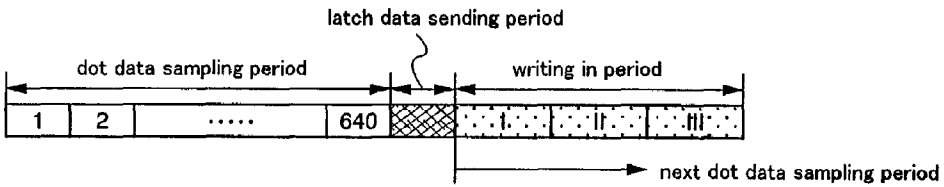

FIGS. 3A and 3B are timing charts in the display device shown in FIG. 24. The display device corresponds to a 3-bit digital gradation signal, and is for VGA. A driving method will be described with reference to FIGS. 3, 24 and 25. Note that, the characters in FIGS. 3, 24 and 25 are used as they are (drawing number is omitted).

Reference will be made to FIG. 25 and FIGS. 3A and 3B. In FIG. 3A, respective frame periods are denoted by α, β and γ, and the description will be given. First, the circuit operation in the frame period a will be described.

Similarly to the case of the conventional digital system driving circuit, clock signals (S-CLK, S-CLKb) and a start pulse (S-SP) are inputted to the shift register circuits 201, and sampling pulses are sequentially outputted. Subsequently, the sampling pulses are inputted to the first latch circuits 202 (LAT 1), which respectively hold digital signals (Digital Data) inputted to the same first latch circuits 202. This period is expressed as a dot data sampling period in this specification. The dot data sampling period for one horizontal period is each period indicated by 1 to 480 in FIG. 3A. The digital signal has 3 bits, D1 is the MSB (Most Significant Bit), and D3 is the LSB (Least Significant Bit). In the first latch circuits 202, when holding of the digital signals for one horizontal period is completed, in a retrace period, the digital signals held in the first latch circuits 202 are transferred to the second latch circuits 203 (LAT 2) all at once in accordance with the input of a latch signal (Latch Pulse).

Subsequently, again, in accordance with the sampling pulses outputted from the shift registers 201, the holding operation of digital signals for a next horizontal period is carried out.

On the other hand, the digital signals transferred to the second latch circuits 203 are written into the memory circuits arranged in the pixels. As shown in FIG. 3B, a next line dot data sampling period is divided into three periods I, II and III, and the digital signals held in the second latch circuits are outputted to the source signal lines. At this time, they are selectively connected by the bit signal selection switch 204 so that the signal of each bit is successively outputted to the source signal line.

In the period I, a pulse is inputted to the writing gate signal line 102, the TFT 108 is turned on, and the digital signal is written into the memory circuit 105. Subsequently, in the period II, a pulse is inputted to the writing gate signal line 103, the TFT 109 is turned on, and the digital signal is written into the memory circuit 106. Finally, in the period III, a pulse is inputted to the writing gate signal line 104, the TFT 110 is turned on, and the digital signal is written into the memory circuit 107.

Here, the processing of the digital signals for one horizontal period is completed. The period of FIG. 3B is a period indicated by the mark ·X· in FIG. 3A. The above operation is carried out to the final stage, so that the digital signals for one frame are written into the memory circuits 105 to 107.

The written digital signals are converted into analog signals by the D/A converter 111, and are inputted to the gate electrode of the EL driving TFT 115. Electric current corresponding to the analog signal is inputted to the EL element 114 from the power supply line 112 through the EL driving TFT 115. In this way, the brightness of the EL element 114 is changed and the gradation is displayed. Here, since three bits are used, eight stages of 0 to 7 can be obtained for the brightness.

The above operation is repeated, and a display of an image is continuously carried out. Here, in the case where a still picture is displayed, after the digital signals are once stored in the memory circuits 105 to 107 by the first operation, the digital signals stored in the memory circuits 105 to 107 have only to be read out repeatedly in the respective frame periods.

The operation in which the digital signals stored in the memory circuits are repeatedly read out and are converted into analog signals by the D/A 111 in each frame period, may be controlled by using a DAC controller.

Otherwise, the output of each of the memory circuits is inputted to the D/A 111 through a reading TFT (not shown). By turning on and off the reading TFT, the digital signals stored in the memory circuits may be repeatedly read out in each frame period.

At this time, an operation for inputting a signal to the reading gate signal line (not shown) to which the gate electrode of the reading TFT is connected is carried out by using a reading gate signal line driving circuit (not shown).

Accordingly, in the period when the still picture is displayed, driving of the source signal line driving circuit can be stopped in the EL display device.

Further, writing of the digital signals into the memory circuits or reading of the digital signals from the memory circuits can be carried out in the unit of one gate signal line. That is, it is also possible to adopt such a display method that the source signal line driving circuit is made to operate only for a short time, and only a part of a screen is rewritten.

Further, in this embodiment mode, although one pixel includes three memory circuits and has the function to store the 3-bit digital image signals for only one frame, the present invention is not limited to this number. That is, in order to store n-bit (n is a natural number not less than 2) digital image signals for only m (m is a natural number not less than 2) frames, one pixel has only to include n×m memory circuits.

As described above, the digital signals are stored by using the memory circuits mounted in the pixel, and when a still picture is displayed, the digital image signals stored in the memory circuits are repeatedly used in the respective frame periods. In this way, the still picture can be continuously displayed without driving the source signal line driving circuit. Thus, the invention can greatly contribute to reduction in consumed electric power of the EL display device.

Further, with respect to the source signal line driving circuit, in view of the problem of the arrangement of latch circuits and the like which are increased in accordance with the number of bits, it is not always necessary to integrally form the circuit on the insulator, but a part thereof or all may be constructed externally.

Further, in the source signal line driving circuit described in this embodiment mode, although the latch circuits corresponding to the number of bits are arranged, it is also possible to arrange the latch circuit for only one bit and to make it operate. In this case, digital signals from the upper bit to the lower bit have only to be serially inputted to the latch circuit.

Figure 23:
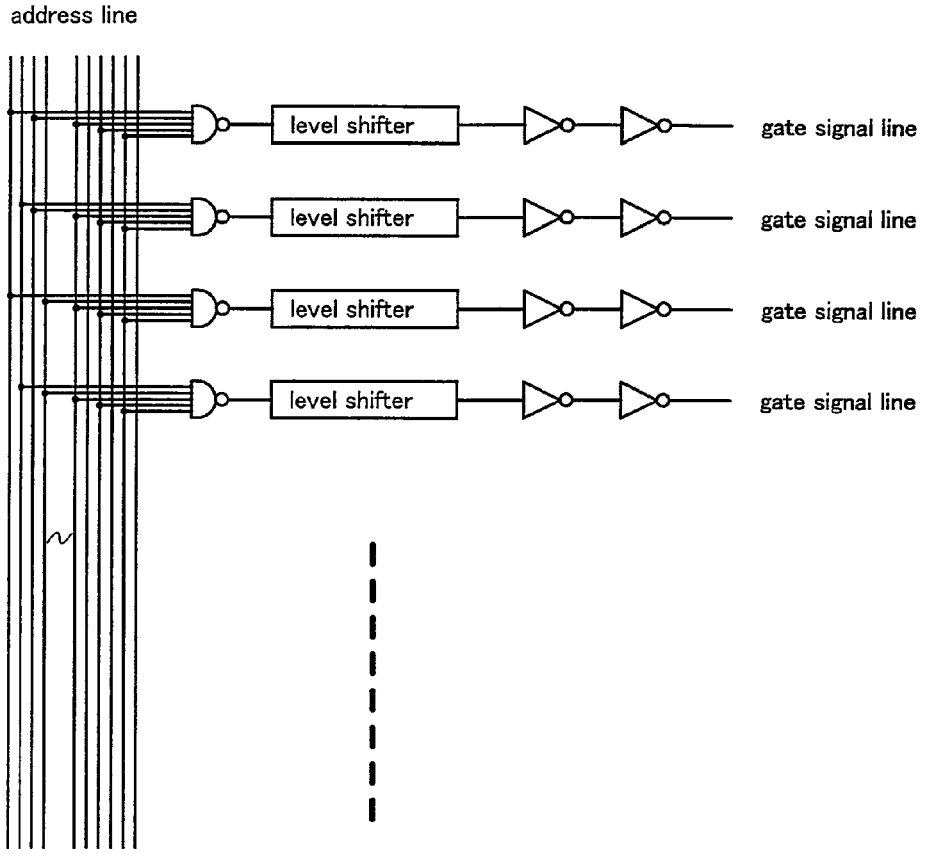
FIG. 23 is a view showing an example of a gate signal line driving circuit using a decoder.

In the present invention, as described above, rewriting of signals in the unit of one gate signal line is also enabled. In this case, it is desirable to use a decoder as the gate signal line driving circuit. FIG. 23 shows an example in which the decoder is used as the gate signal line driving circuit.

In the case where the decoder is used, a circuit disclosed in Japanese Patent Application Laid-open No. Hei 8-101669 may be used.

Further, this is also used for the source signal line driving circuit, and partial rewriting can be made.

By the structure like this, in the portable information apparatus of the present invention, parts, which continue to operate in the display of a still picture, can be decreased and the consumed electric power can be reduced.

Hereinafter, embodiments of the present invention will be described.

[Embodiment 1]

In this embodiment, an example will be given in which the memory circuits and the D/A converters in the circuit of the pixel portion of the EL display device included in the portable information apparatus of the present invention described in this embodiment mode are specifically constructed by using transistors and the like, and the operation will be described.

Figure 8:
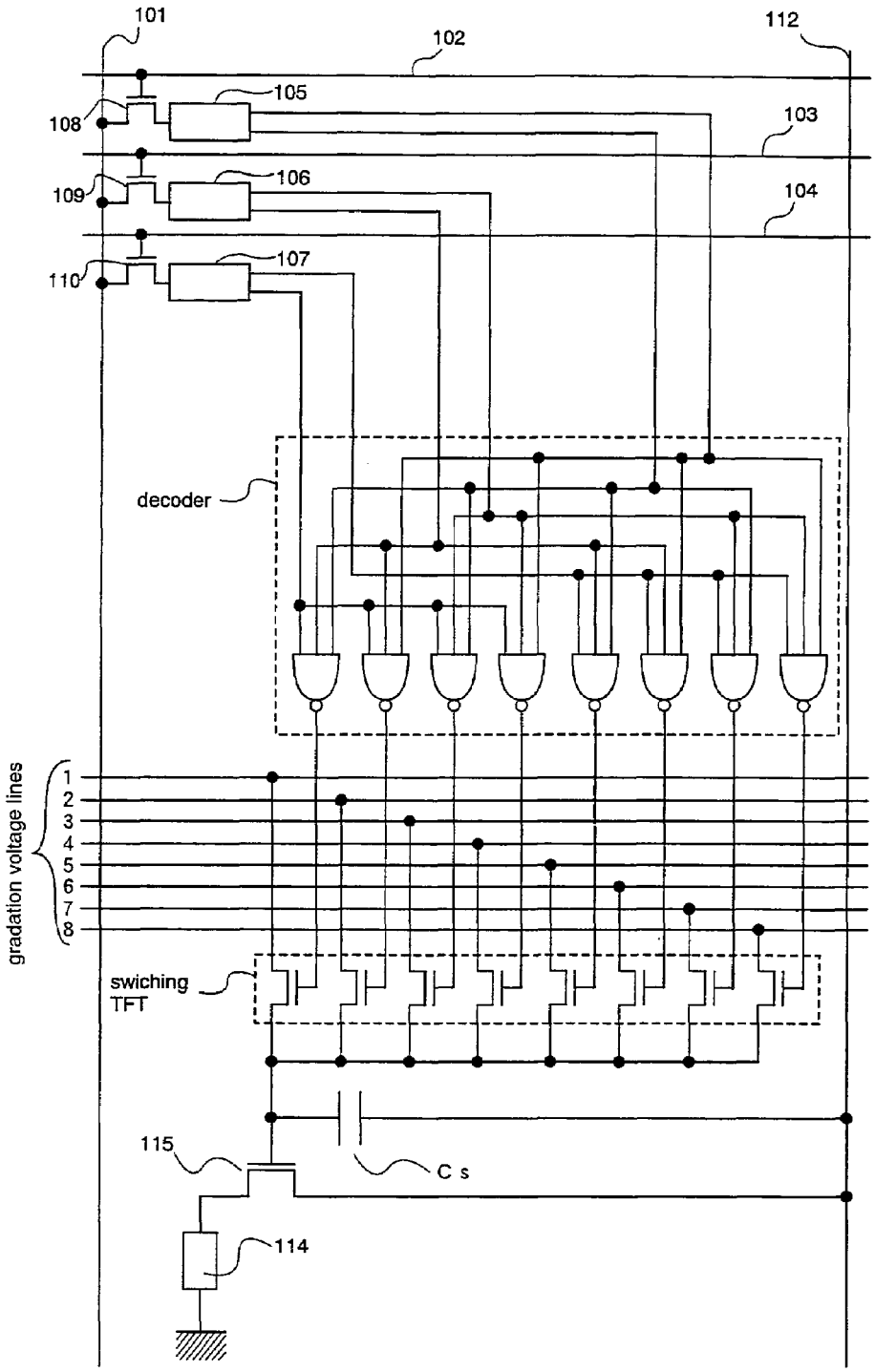
FIG. 8 is a view showing a structure of a D/A converter of an EL display device of a portable information apparatus of the present invention.

FIG. 8 shows an example similar to the pixel shown in FIG. 24, and the D/A converter 111 is actually constructed by circuits. As the D/A converter 111, a system for selecting a plurality of gradation voltage lines is used. Note that, the same portions as those of FIG. 24 are designated by the same characters.

In the case where a 3-bit digital signal is processed, there are eight gradation voltage lines and they are respectively connected to switch TFTs. Outputs from memory circuits 105 to 107 selectively drive the switch TFTs through a decoder. By this operation, gradation voltages corresponding to the digital signals inputted from the memory circuits are inputted to a gate electrode of an EL driving TFT 115.

In the drawing, in the characters given to the respective portions, the same portions as those of FIG. 24 are given the same numbers as FIG. 24. Writing selection TFTs 108 to 110 are respectively provided for the memory circuits 105 to 107, and control is made through memory circuit selecting signal lines (writing gate signal lines) 102 to 104.

Note that, in FIG. 8, the output from each of the memory circuits 105 to 107 is constituted by a signal stored in the memory circuit and an inversion signal of the signal.

Figure 4:
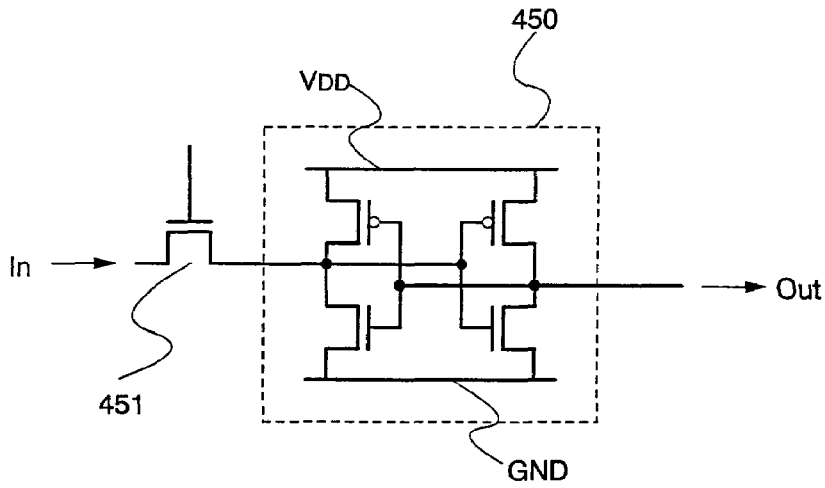
FIG. 4 is a circuit diagram of a memory circuit included in a pixel of an EL display device included in a portable information apparatus of the present invention.

FIG. 4 shows an example of the memory circuit. A portion indicated by a dotted line frame 450 is the memory circuit (respective portions indicated by 105 to 107 in FIG. 8), and reference numeral 451 designates the writing TFT (respective portions indicated by 108 to 110 in FIG. 8). In the memory circuit 450 shown here, although a static memory (Static RAM: SRAM) using a flip-flop is used, the memory circuit is not limited to this structure.

The circuit shown in FIG. 8 in this embodiment can be driven in accordance with the timing charts shown in FIGS. 3A and 3B in this embodiment mode. The circuit operation, together with an actual driving method of the memory circuit selection portion (writing TFTs 108 to 110), will be described with reference to FIGS. 3A and 3B and FIG. 8. Note that, the respective characters in FIGS. 3A and 3B and FIG. 8 are used as they are (drawing number is omitted).

Reference will be made to FIGS. 3A and 3B. In FIG. 3A, the respective frame periods are denoted by α, β, and γ, and the explanation will be given. First, the circuit operation in the frame period á will be described.

Since a driving method from the shift register circuits to the second latch circuits is the same as that shown in this embodiment mode, the method follows that.

In the period I, a pulse is inputted to the writing gate signal line 102, the TFT 108 is turned on, and the digital image signal is written into the memory circuit 105. Subsequently, in the period II, a pulse is inputted to the writing gate signal line 103, the TFT 109 is turned on, and the digital image signal is written into the memory circuit 106. Finally, in the period III, a pulse is inputted to the writing gate signal line 104, the TFT 110 is turned on, and the digital image signal is written into the memory circuit 107.

Here, the processing of the digital image signals for one horizontal period is completed. The period of FIG. 3B is a period indicated by the mark ·X· in FIG. 3A. The above operation is carried out to the final stage, so that the digital image signals for one frame are written into the memory circuits 105 to 107.

The written digital signals are converted into analog signals by the D/A converter 111 and are inputted to the gate electrode of the EL driving TFT 115. Current corresponding to the analog signal is inputted to an EL element 114 from a power supply line 112 through the EL driving TFT 115. In this way, the brightness of the EL element 114 is changed and the gradation is expressed. Here, since the 3-bit digital signal is inputted, eight stages of 0 to 7 can be obtained for the brightness.

In the manner as described above, a display for one frame period is carried out. On the other hand, at the side of the driving circuit, the processing of digital image signals of a next frame period is carried out at the same time.

The above procedure is repeated, and a display of an image is carried out. Note that, in the case where a still picture is displayed, after writing of the digital image signals of a certain frame into the memory circuits is completed, the source signal line driving circuit is stopped, the signals stored in the same memory circuits are read out for each frame, and a display is carried out.

At this time, although not shown in FIG. 8, the output of each of the memory circuits of each pixel is inputted to the D/A circuit through a reading TFT, and by operating the reading TFT, the signals of the memory circuits can be repeatedly read out for each frame period. A circuit of a well-known structure can be freely used for a circuit for operating the reading TFT.

Further, a signal inputted to the memory circuit is always inputted to the D/A circuit, and a corresponding analog signal is outputted to a liquid crystal element, so that a still picture can also be displayed. In this case, till the writing TFT is selected and information is newly written into the memory circuits, the pixel continues the display at the same brightness. In this driving method, the foregoing reading TFT and the like are not necessary.

By the method like this, the consumed electric power during the display of a still picture can be greatly reduced.

[Embodiment 2]

In this embodiment, a description will be given of an example in which writing into memory circuits of a pixel portion is carried out in dot sequence, so that second latch circuits of a source signal line driving circuit are omitted.

Figure 5:
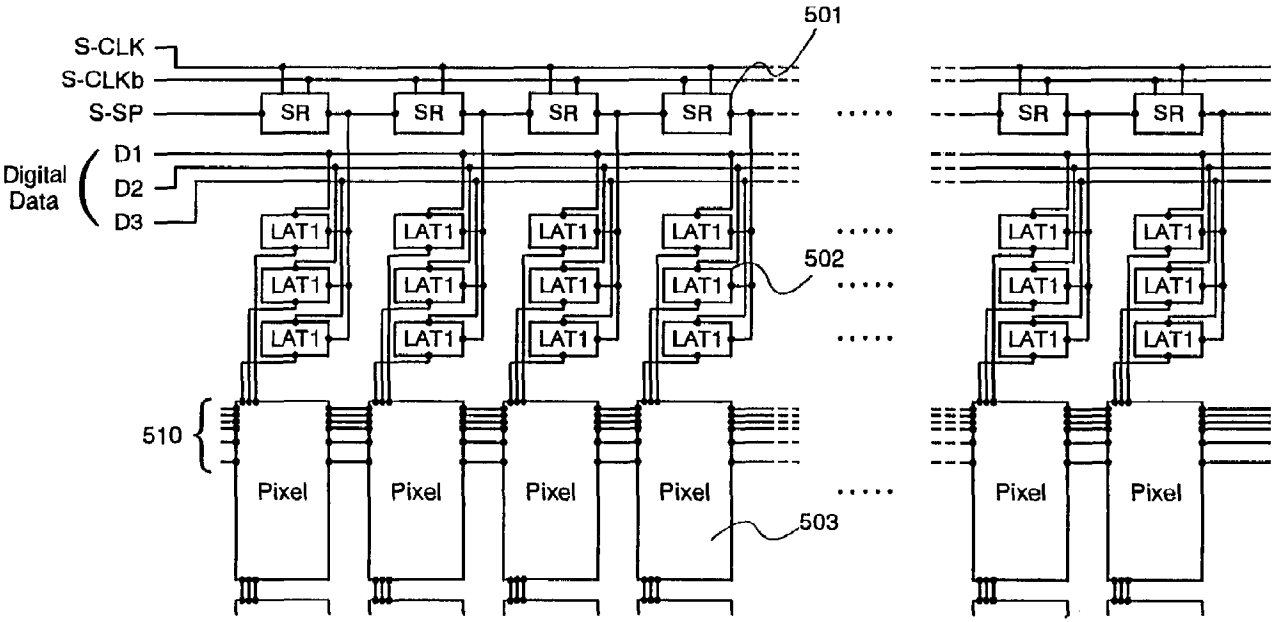
FIG. 5 is a view showing a circuit structural example of a source signal line driving circuit having no second latch circuit.

FIG. 5 shows a structure of a source signal line driving circuit and some pixels in an EL display device using a pixel including memory circuits. This circuit corresponds to a 3-bit digital gradation signal, and includes shift register circuits 501, latch circuits 502, and pixels 503. Reference numeral 510 designates a signal supplied from a gate signal line driving circuit or directly from the outside, and is described later together with the description of the pixel.

Figure 6:
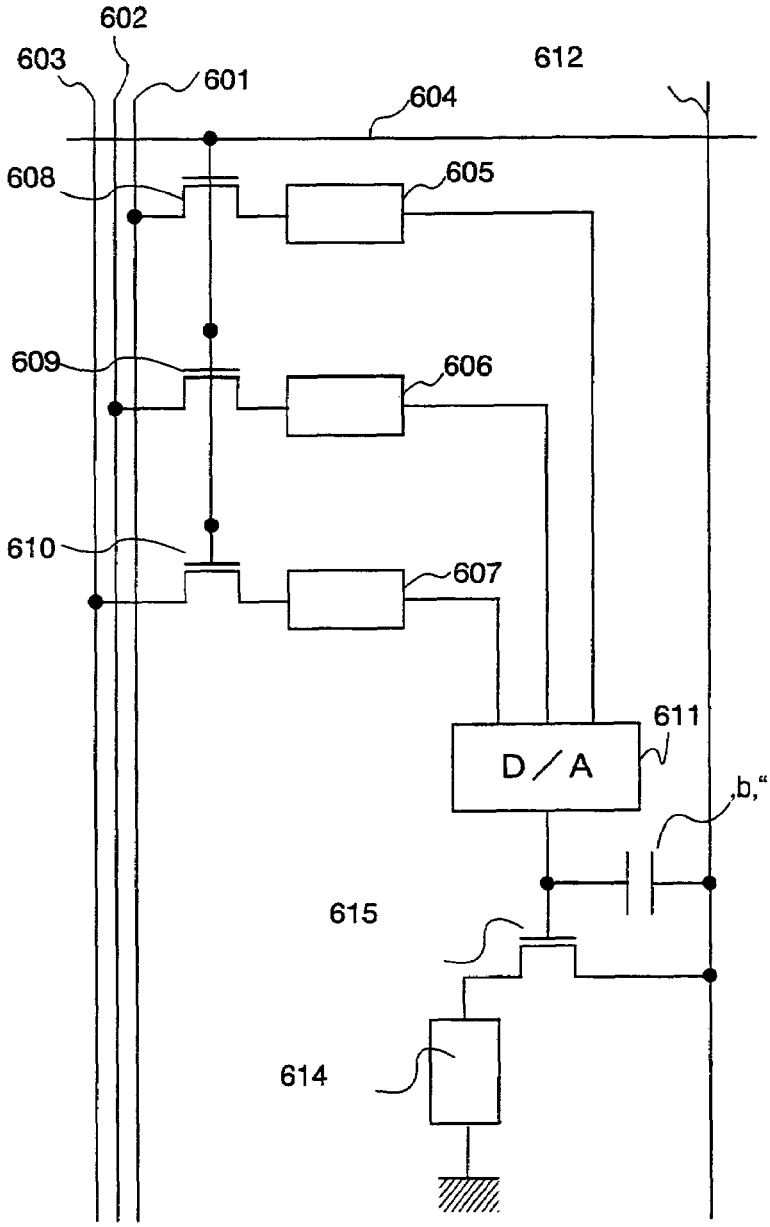
FIG. 6 is a detailed circuit diagram of a pixel of an EL display device of a portable information apparatus of the present invention, which is driven by the source signal line driving circuit of FIG. 5.

FIG. 6 is a detailed view of a circuit structure of the pixel 503 shown in FIG. 5. Similarly to the embodiment 1, this pixel corresponds to 3-bit digital gradation, and includes an EL element 614, a memory circuits (605 to 607) and a D/A converter (D/A: 611). Reference numeral 601 designates a source signal line for a first bit (MSB) signal; 602, a source signal line for a second bit signal; 603; a source signal line for a third bit (LSB) signal; 604, a writing gate signal line and 608 to 610, writing TFTs.

Figure 7A:
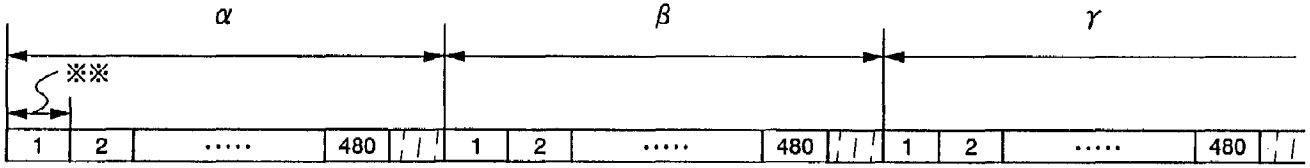
FIGS. 7A and 7B are views showing timing charts for carrying out a display by using the circuits shown in FIGS. 5 and 6.
Figure 7B:
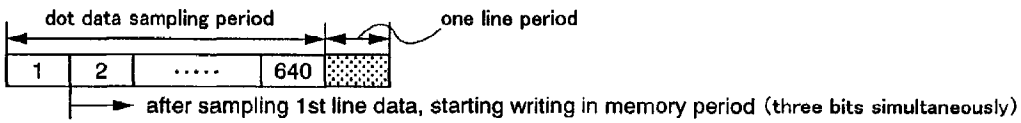

FIGS. 7A to 7C are timing charts with respect to the driving of the circuit shown in this embodiment. The description will be given with reference to FIG. 6 and FIGS. 7A to 7C.

The operation from the shift register circuits 501 to the latch circuits (LAT 1) 502 is carried out similarly to the mode for carrying out the invention and the embodiment 1. As shown in FIG. 7B, when the latch operation at the first stage is ended, writing into the memory circuits of the pixel is immediately started. A pulse is inputted to the writing gate signal line 604, the writing TFTs 608 to 610 are turned on. The digital image signals for the respective bits held in the latch circuits 502 are simultaneously written through the three source signal lines 601 to 603.

When the digital image signals held in the latch circuits is being stored into the memory circuits at the first stage, at the next stage, the digital image signals are held in the latch circuits in accordance with sampling pulses. In this way, writing into the memory circuits is sequentially carried out.

The above operation is repeated till the last stage and thus one horizontal period is completed.

This serial operation is repeated at all horizontal periods 1 to 480.

Here, the display period of the first frame is completed. In the frame period , the processing of digital image signals in a next frame is carried out at the same time.

The period shown by FIG. 7B is corresponding to the period indicated by ·X·X· in FIG. 7A.

According to repeating the above procedure, display of an image is carried out. Note that, in case of displaying a still image, after a digital signal of certain frame is written into a memory circuit, a source signal line driver circuit is stopped. A display is carried out by reading out the signal written into the memory circuit per a frame. By the above method, in displaying of still picture, the consumed electric power can be greatly reduced. Further, as compared with the circuit shown in the Embodiment mode, the number of latch circuits can be reduced ½, which contributes miniaturization of a device according to reduce space of circuit arrangement.

[Embodiment 3]

In this embodiment, a description will be given of an example of an EL display device which uses a circuit structure of the EL display device in which the second latch circuits shown in Embodiment 2 are omitted, and uses a method of carrying out writing into memory circuits in a pixel by linear sequential driving.

Figure 17:
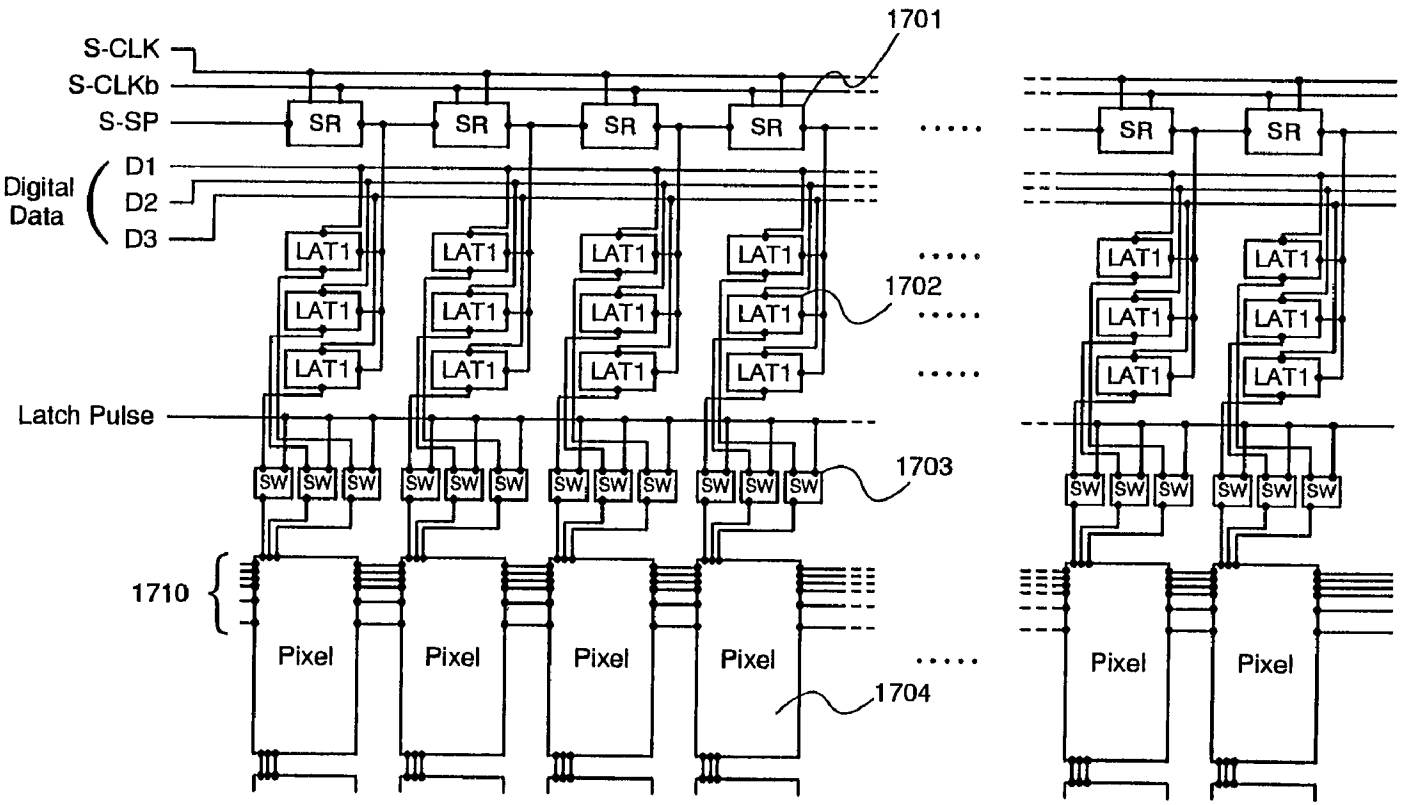
FIG. 17 is a view showing a circuit structural example of a source signal line driving circuit having no second latch circuit.

FIG. 17 shows a circuit structural example of a source signal line driving circuit of an EL display device to be described in this embodiment. This circuit corresponds to a 3-bit digital gradation signal, and includes shift register circuits (SR) 1701, latch circuits (LAT1) 1702, switch circuits (SW) 1703, and pixels 1704. Reference numeral 1710 designates a signal supplied from a gate signal line driving circuit or directly from the outside. Since the circuit structure of the pixel may be the same as that of Embodiment 2, reference will be made to FIG. 6 as it is.

Figure 18A:
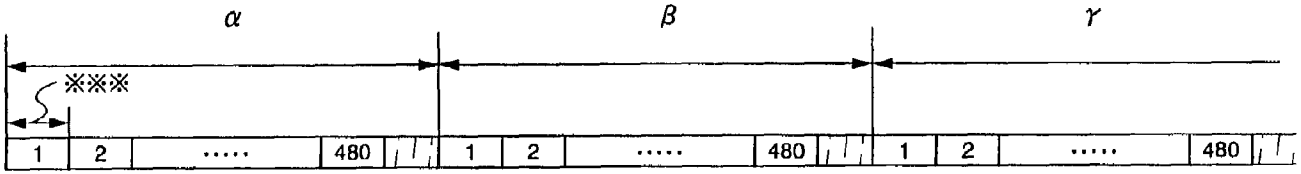
FIGS. 18A and 18B are views showing timing charts for carrying out a display by using the circuit shown in FIG. 17.
Figure 18B:
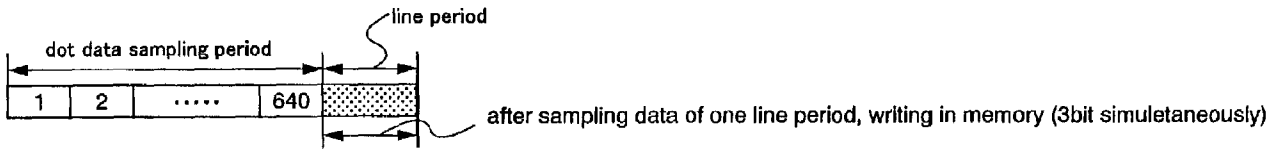

FIGS. 18A and 18B are timing charts with respect to the driving of the circuit shown in this embodiment. The description will be given with reference to FIG. 6, FIG. 17 and FIGS. 18A and 18B.

The operation in which sampling pulses are outputted from the shift register circuits 1701 and digital signals are held in the latch circuits 1702 in accordance with the sampling pulses, is the same as that of Embodiments 1 and 2. In this embodiment, since the switch circuits 1703 are provided between the latch circuits 1702 and the memory circuits in the pixels 1704, even if holding of the digital signals in the latch circuits is completed, writing into the memory circuits is not immediately started. The switch circuits 1703 remain closed till a dot data sampling period is completed, and the latch circuits continue to hold the digital image signals.

As shown in FIG. 18B, when the holding of the digital image signals for one horizontal period is completed, a latch signal (Latch Pulse) is inputted in a subsequent retrace period, the switch circuits 1703 are opened all at once, and the digital signals held in the latch circuits 1702 are written into the memory circuits in the pixels 1704 all at once. Since the operation in the pixels 1704 with respect to the writing operation at this time, and the operation in the pixels 1704 with respect to the reading operation at the time of display in a next frame period may be the same as those of Embodiment 2, the description is omitted here.

The period shown in FIG. 18B corresponds to a period indicated by the mark ⊠⊠⊠ in FIG. 18A.

By the above method, even in the source signal line driving circuit in which the second latch circuits are omitted, the linear sequential writing drive can be easily made.

[Embodiment 4]

Figure 9:
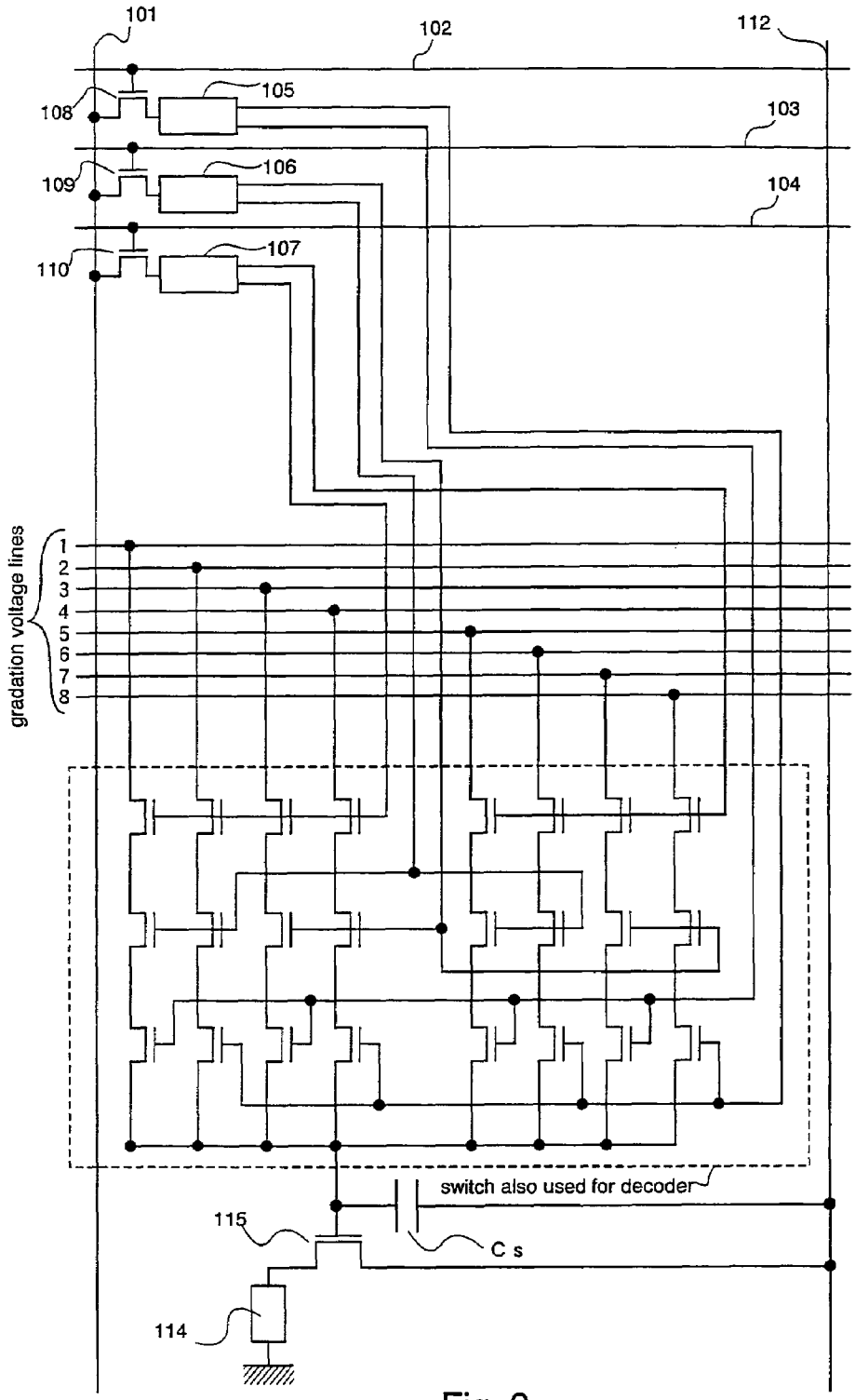
FIG. 9 is a view showing a structure of a D/A converter of an EL display device of a portable information apparatus of the present invention.

In this embodiment, an example of a pixel using a structure different from the D/A converter shown in FIG. 8 will be given. FIG. 9 is a circuit diagram thereof. Note that, the same portions as those of FIG. 8 are designated by the same characters.

Similarly to that shown in FIG. 8, although this system selects gradation voltage lines, in FIG. 8, the number of elements is large, and an occupied area of the elements in a pixel becomes large. Thus, in FIG. 9, switches are connected in series and are also used as decoders, so that the number of elements is decreased.

Note that, in FIG. 9, the output from each of memory circuits 105 to 107 is constituted by a signal stored in the memory circuit and an inversion signal of the signal.

This embodiment can be freely combined with Embodiments 1 to 3 and can be carried out.

[Embodiment 5]

Figure 20:
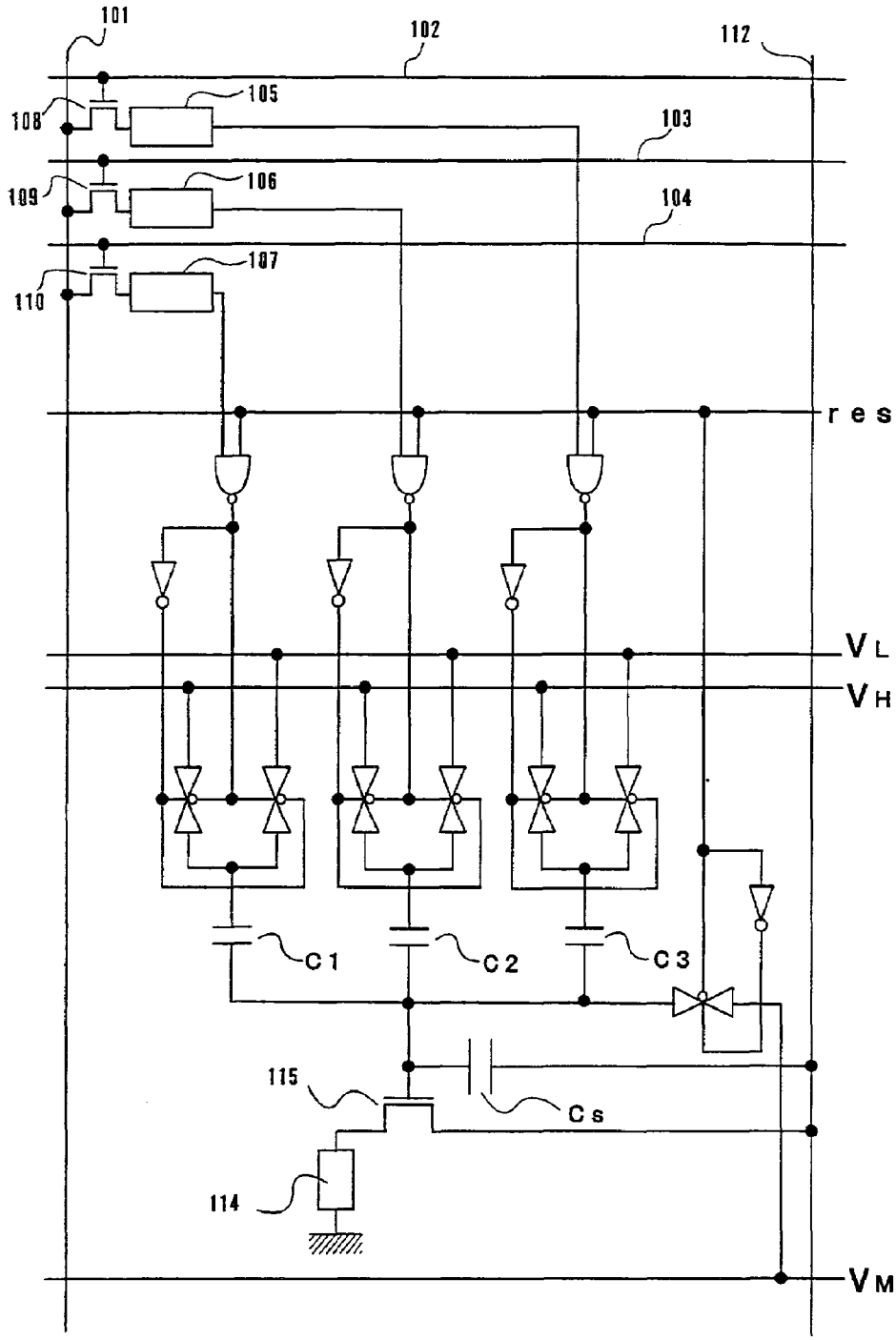
FIG. 20 is a view showing a structure of a D/A converter of an EL display device of a portable information apparatus of the present invention.

In this embodiment, an example of a pixel using a structure different from the D/A converter shown in FIG. 8 or 9 will be described. FIG. 20 is a circuit diagram thereof. Note that, the same portions as those of FIGS. 8 and 9 are designated by the same characters.

In the D/A converter shown in FIG. 8 or 9, since the gradation voltage lines are used, it becomes necessary to provide wiring lines the number of which is equal to the number of gradations, and it is not suitable for realization of multi-gradation. Thus, in FIG. 20, a reference voltage is divided by a combination of capacitors C1 to C3, and a gradation voltage is formed. In such a capacitance division system, since a gradation is formed by the ratio of the capacitors C1 to C3, a variety of gradations can be expressed.

The D/A converter of the capacitance division system like this is disclosed in "AMLCD99 Digest of Technical Papers p29 to 32".

This embodiment can be freely combined with Embodiments 1 to 3 and can be carried out.

[Embodiment 6]

Figure 21:
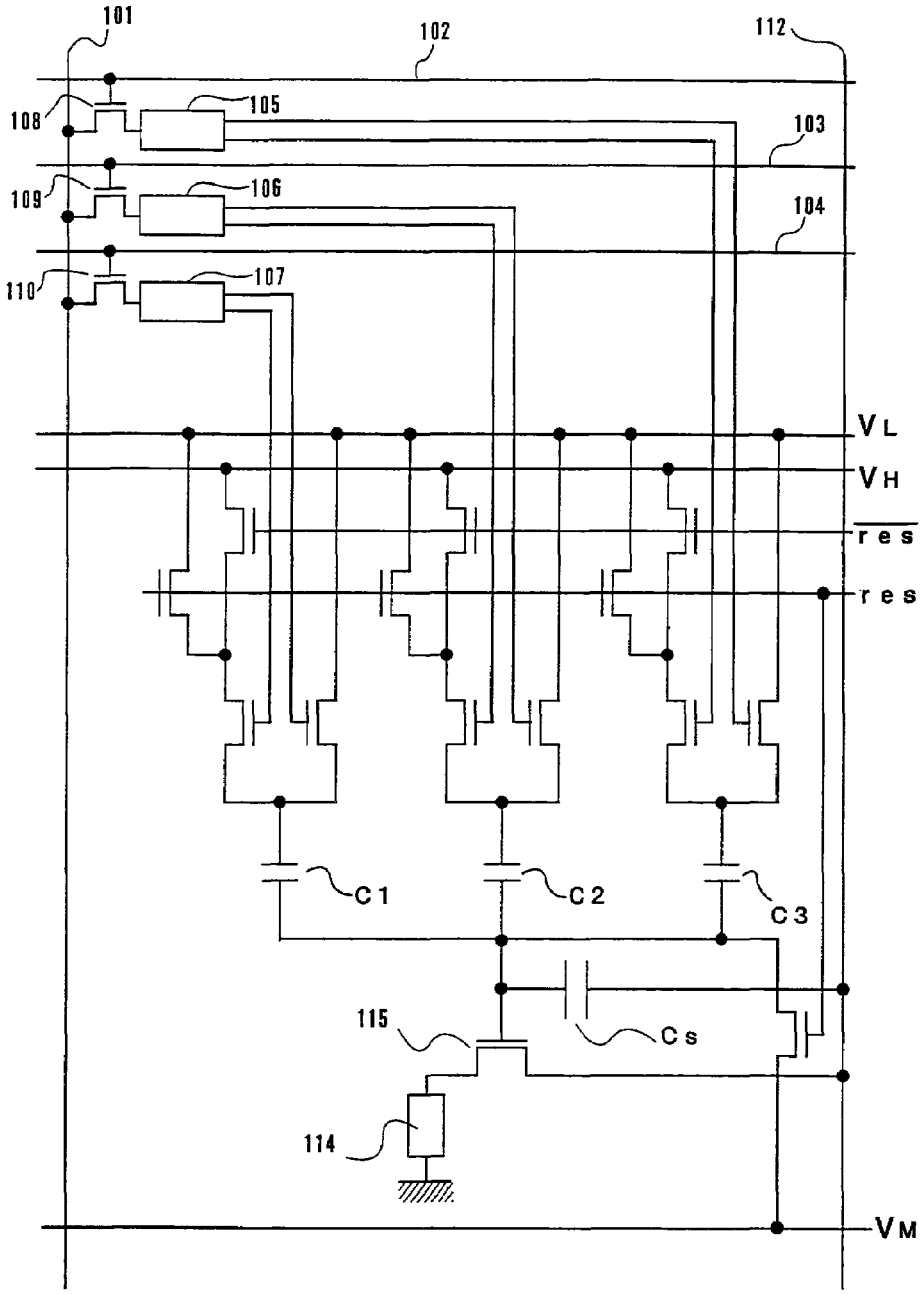
FIG. 21 is a view showing a structure of a D/A converter of an EL display device of a portable information apparatus of the present invention.

In this embodiment, an example of a pixel using a D/A converter having a structure different from the D/A converters shown in FIG. 8, 9 and 20 will be described. FIG. 21 is a circuit diagram thereof. Note that, the same portions as those of FIGS. 8, 9 and 20 are designated by the same characters.

FIG. 21 shows a D/A converter obtained by further simplifying the D/A converter of FIG. 20. In two electrodes of each of capacitors C1 to C3, the electrode not connected to an EL element is connected to $V_L$ at the time of reset and is connected to one of $V_H$ and $V_L$ at the time of non-reset, and the connection can be constructed by only a switch.

Note that, in FIG. 21, the output from each of the memory circuits 105 to 107 is constituted by a signal stored in the memory circuit and an inversion signal of the signal.

This embodiment can be freely combined with Embodiments 1 to 3 and can be carried out.

[Embodiment 7]

In this embodiment, an example of a source signal line driving circuit having a structure different from that of FIG. 25 described in this embodiment mode, will be described.

Figure 22:
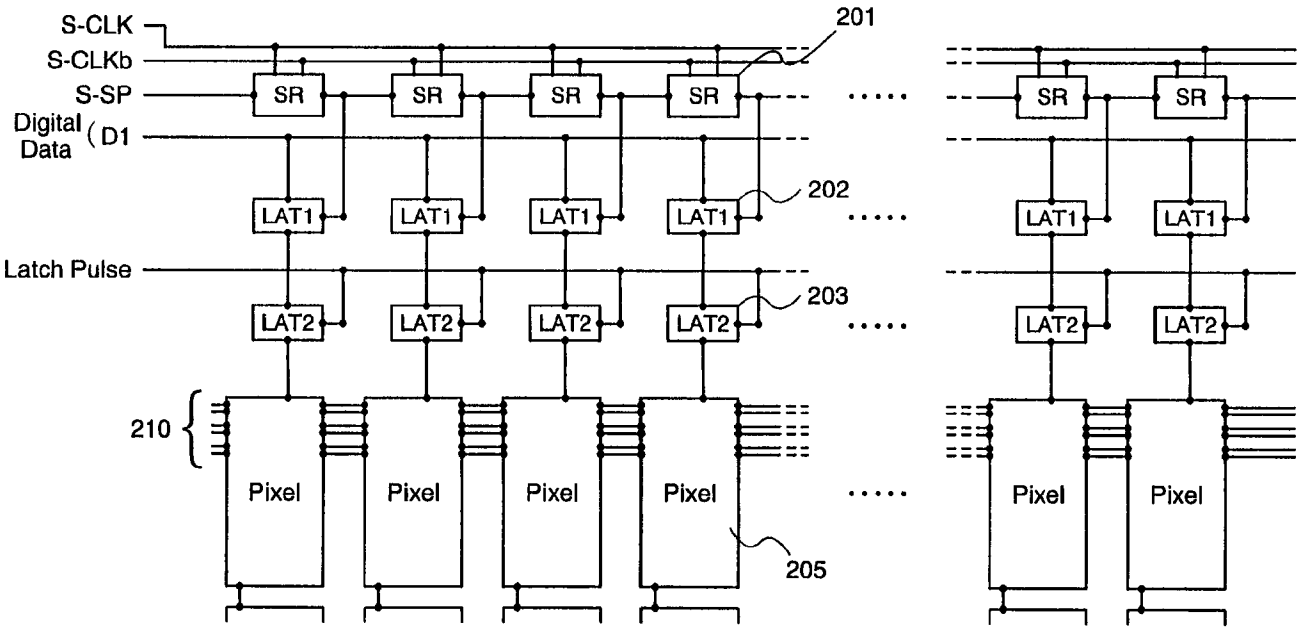
FIG. 22 is a view showing a circuit structural example of a source signal line driving circuit including latch circuits for one bit processing.

As shown in FIG. 22, latch circuits of a source signal line driving circuit for only one bit are included, and instead, the source signal line driving circuit is operated at a speed three times as fast, and data is inputted first bit data, second bit data, and third bit data in the stated order to the source signal line driving circuit in one line period, so that the same effect as the source signal line driving circuit of FIG. 25 described in this embodiment mode can be obtained.

Although this system requires an external circuit for exchanging the data in sequence, the source signal line driving circuit can be made small.

[Embodiment 8]

Note that a description is set forth regarding a step for fabricating TFTs for driver circuit (a source signal line driver circuit, a gate signal line driver circuit, or the like) provided in the pixel portion and periphery portion of the pixel portion of the EL display device of the portable information device of the present invention. For the simplicity of the explanation, a CMOS circuit is shown in figures, which is a fundamental structure circuit for the driver circuit portion.

Figures 10A, 10B, 10C:
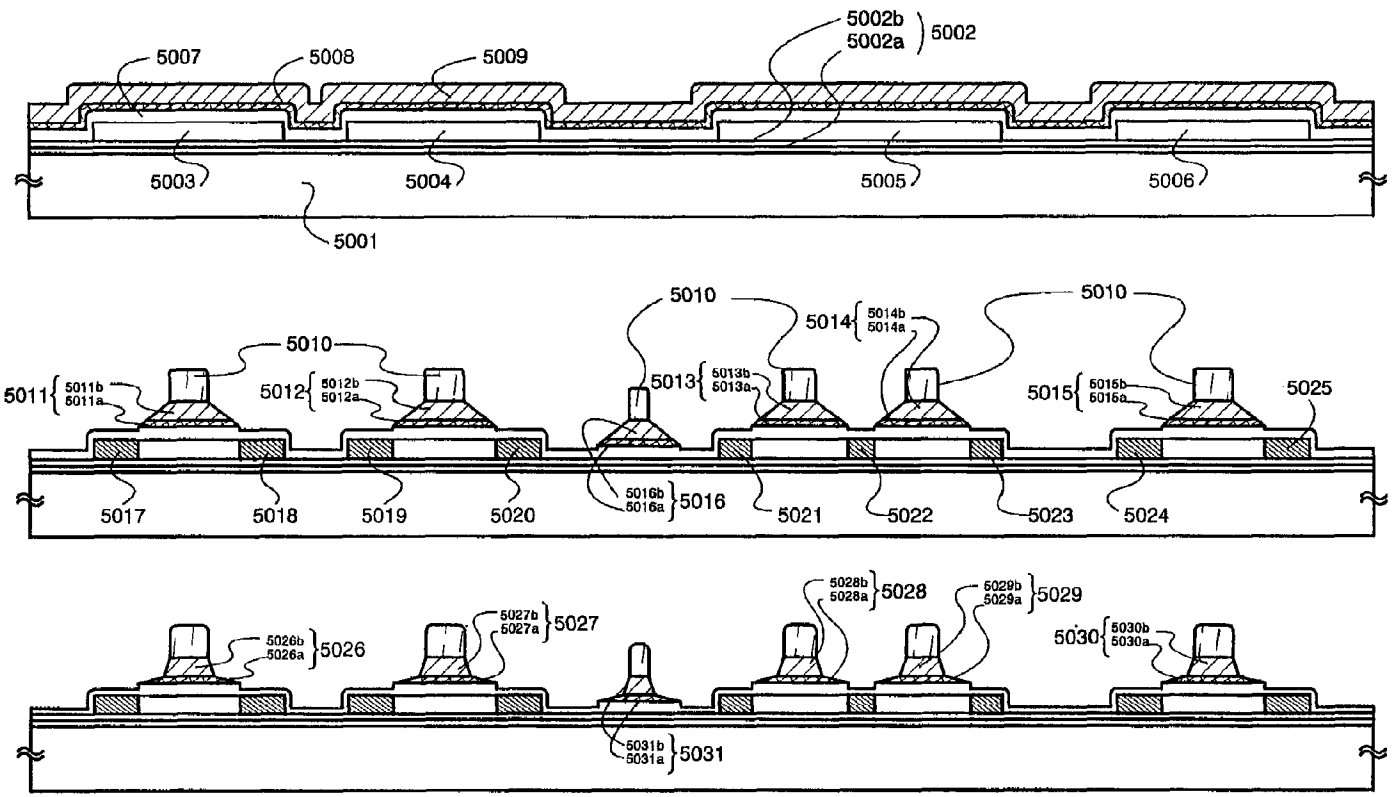
FIGS. 10A to 10C are views showing an example of a fabricating process of an EL display device of a portable information apparatus of the present invention.

First, as shown in FIG. 10A, a base film 5002 made of an insulating film such as a silicon oxide film, a silicon nitride film, or a silicon oxynitride film, is formed on a substrate 5001 made of a glass such as barium borosilicate glass or aluminum borosilicate glass, typically a glass such as Corning Corp. #7059 glass or #1737 glass. For example, a lamination film of a silicon oxynitride film 5002*a*, manufactured from $SiH_4$, $NH_3$, and $N_2O$ by plasma CVD, and formed having a thickness of 10 to 200 nm (preferably between 50 and 100 nm), and a hydrogenated silicon oxynitride film 5002*b*, similarly manufactured from $SiH_4$ and $N_2O$, and formed having a thickness of 50 to 200 nm (preferably between 100 and 150 nm), is formed. A two layer structure is shown for the base film 5002 in Embodiment 8, but a single layer film of the insulating film, and a structure in which more than two layers are laminated, may also be formed.

Island shape semiconductor layers 5003 to 5006 are formed by crystalline semiconductor films made from a semiconductor film having an amorphous structure, using a laser crystallization method or a known thermal crystallization method. The thickness of the island shape semiconductor layers 5003 to 5006 may be formed from 25 to 80 nm (preferably between 30 and 60 nm). There are no limitations placed on the materials for forming a crystalline semiconductor film, but it is preferable to form the crystalline semiconductor films by silicon or a silicon germanium (SiGe) alloy.

A laser such as a pulse oscillation type or continuous light emission type excimer laser, a YAG laser, or a $YVO_4$ laser can be used to fabricate the crystalline semiconductor films by the laser crystallization method. A method of condensing laser light emitted from a laser oscillator into a linear shape by an optical system and then irradiating the light to the semiconductor film may be used when these types of lasers are used. The crystallization conditions may be suitably selected by the operator, but when using the excimer laser, the pulse oscillation frequency is set to 30 Hz, and the laser energy density is set form 100 to 400 mJ/cm$^2$ (typically between 200 and 300 mJ/cm$^2$). Further, when using the YAG laser, the second harmonic is used and the pulse oscillation frequency is set from 1 to 10 kHz, and the laser energy density may be set from 300 to 600 mJ/cm$^2$ (typically between 350 and 500 mJ/cm$^2$). The laser light condensed into a linear shape with a width of 100 to 1000 μm, for example 400 μm, is then irradiated over the entire surface of the substrate. This is performed with an overlap ratio of 80 to 98% for the linear laser light.

A gate insulating film 5007 is formed covering the island shape semiconductor layers 5003 to 5006. The gate insulating film 5007 is formed of an insulating film containing silicon with a thickness of 40 to 150 nm by plasma CVD or sputtering. A 120 nm thick silicon oxynitride film is formed in Embodiment 8. The gate insulating film is not limited to this type of silicon oxynitride film, of course, and other insulating films containing silicon may also be used in a single layer or in a lamination structure. For example, when using a silicon oxide film, it can be formed by plasma CVD with a mixture of TEOS (tetraethyl orthosilicate) and $O_2$, at a reaction pressure of 40 Pa, with the substrate temperature set from 300 to 400° C., and by discharging at a high frequency (13.56 MHZ) electric power density of 0.5 to 0.8 W/cm$^2$. Good characteristics as a gate insulating film can be obtained by subsequently performing thermal annealing, at between 400 and 500° C., of the silicon oxide film thus manufactured.

A first conductive film 5008 and a second conductive film 5009 are then formed on the gate insulating film 5007 in order to form gate electrodes. The first conductive film 5008 is formed of a Ta film with a thickness of 50 to 100 nm, and the second conductive film 5009 is formed of a W film having a thickness of 100 to 300 nm, in Embodiment 8.

The Ta film is formed by sputtering, and sputtering of a Ta target is performed by Ar. If appropriate amounts of Xe and Kr are added to Ar, the internal stress of the Ta film is relaxed, and film peeling can be prevented. The resistivity of an α phase Ta film is about 20 μΩcm, and it can be used in the gate electrode, but the resistivity of β phase Ta film is about 180 μΩcm and it is unsuitable for the gate electrode. The a phase Ta film can easily be obtained if a tantalum nitride film, which possesses a crystal structure similar to that of α phase Ta, is formed with a thickness of about 10 to 50 nm as a base for a Ta film in order to form the a phase Ta film.

The W film is formed by sputtering with a W target, which can also be formed by thermal CVD using tungsten hexafluoride ($WF_6$). Whichever is used, it is necessary to make the film become low resistance in order to use it as the gate electrode, and it is preferable that the resistivity of the W film be made equal to or less than 20 μΩcm The resistivity can be lowered by enlarging the crystal grains of the W film, but for cases in which there are many impurity elements such as oxygen within the W film, crystallization is inhibited, thereby the film becomes high resistance. A W target having a purity of 99.9999% is thus used in sputtering. In addition, by forming the W film while taking sufficient care that no impurities from the gas phase are introduced at the time of film formation, the resistivity of 9 to 20 μΩcm can be achieved.

Note that, although the first conductive film 5008 is a Ta film and the second conductive film 5009 is a W film in Embodiment 8, both may also be formed from an element selected from the group consisting of Ta, W, Ti, Mo, Al, and Cu, or from an alloy material having one of these elements as its main constituent, and a chemical compound material. Further, a semiconductor film, typically a polycrystalline silicon film into which an impurity element such as phosphorus is doped, may also be used. Examples of preferable combinations other than that used in Embodiment 8 include: forming the first conductive film 5008 by tantalum nitride (TaN) and combining it with the second conductive film 5009 formed from a W film; forming the first conductive film 5008 by tantalum nitride (TaN) and combining it with the second conductive film 5009 formed from an Al film; and forming the first conductive film 5008 by tantalum nitride (TaN) and combining it with the second conductive film 5009 formed from a Cu film.

Then, mask 5010 are formed from resist, and a first etching treatment is performed in order to form electrodes and wirings. An ICP (inductively coupled plasma) etching method is used in Embodiment 8. A gas mixture of $CF_4$ and $Cl_2$ is used as an etching gas, and a plasma is generated by applying a 500 W RF electric power (13.56 $MH_z$) to a coil shape electrode at 1 Pa. A 100 W RF electric power (13.56 $MH_z$) is also applied to the substrate side (test piece stage), effectively applying a negative self-bias voltage. In case of mixing $CF_4$ and $Cl_2$, the W film and the Ta film are etched to the approximately same level.

Edge portions of the first conductive layer and the second conductive layer are made into a tapered shape in accordance with the effect of the bias voltage applied to the substrate side under the above etching conditions by using a suitable resist mask shape. The angle of the tapered portions is from 15 to 45°. The etching time may be increased by approximately 10 to 20% in order to perform etching without any residue remaining on the gate insulating film. The selectivity of a silicon oxynitride film with respect to a W film is from 2 to 4 (typically 3), and therefore approximately 20 to 50 nm of the exposed surface of the silicon oxynitride film is etched by this over-etching process. First shape conductive layers 5011 to 5016 (first conductive layers 5011*a* to 5016*a* and second conductive layers 5011*b* to 5016*b*) are thus formed of the first conductive layers and the second conductive layers in accordance with the first etching process. Reference numeral 5007 denotes a gate insulating film, and the regions not covered by the first shape conductive layers 5011 to 5016 are made thinner by etching of about 20 to 50 nm. (FIG. 10B)

A first doping process is then performed, and an impurity element which imparts n-type conductivity is added. Ion doping or ion injection may be performed for the method of doping. Ion doping is performed under the conditions of a dose amount of from $1\times10^{13}$ to $5\times10^{14}$ atoms/cm$^2$ and an acceleration voltage of 60 to 100 keV. A periodic table group 15 element, typically phosphorus (P) or arsenic (As) is used as the impurity element which imparts n-type conductivity, and phosphorus (P) is used here. The conductive layers 5011 to 5015 become masks with respect to the n-type conductivity imparting impurity element in this case, and first impurity regions 5017 to 5025 are formed in a self-aligning manner. The impurity element which imparts n-type conductivity is added to the first impurity regions 5017 to 5025 with a concentration in the range of $1\times10^{20}$ to $1\times10^{21}$ atoms/cm$^3$. (FIG. 10B)

A second etching process is performed next without removing a resist mask, as shown in FIG. 10C. The W film is etched selectively using a mixture of $CF_4$, $Cl_2$, and $O_2$ as a etching gas. The second shape conductive layers 5026 to 5031 (first conductive layers 5026*a* to 5031*a* and second conductive layers 5026*b* to 5031*b*) are formed by second etching process. Reference numeral 5007 denotes a gate insulating film, and regions not covered by the second shape conductive layers 5026 to 5031 are additionally etched on the order of 20 to 50 nm, forming thinner regions.

The etching reaction of a W film or a Ta film in accordance with a mixed gas of $CF_4$ and $Cl_2$ can be estimated from the radicals generated and from the ion types and vapor pressures of the reaction products. Comparing the vapor pressures of fluorides and chlorides of W and Ta, the W fluoride compound $WF_6$ is extremely high, and the vapor pressures of $WCl_5$, $TaF_5$, and $TaCl_5$ are of similar order. Therefore the W film and the Ta film are both etched by the $CF_4$ and $Cl_2$ gas mixture. However, if a suitable quantity of $O_2$ is added to this gas mixture, $CF_4$ and $O_2$ react, forming CO and F, and a large amount of F radicals or F ions is generated. As a result, the etching speed of the W film having a high fluoride vapor pressure is increased. On the other hand, even if F increases, the etching speed of Ta does not relatively increase. Further, Ta is easily oxidized compared to W, and therefore the surface of Ta is oxidized by the addition of $O_2$. The etching speed of the Ta film is further reduced because Ta oxides do not react with fluorine and chlorine. Therefore, it becomes possible to have a difference in etching speeds between the W film and the Ta film, and it becomes possible to make the etching speed of the W film larger than that of the Ta film.

Figure 11A:
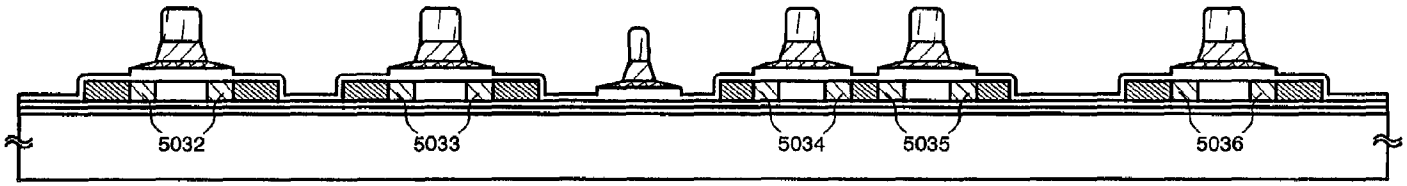
FIGS. 11A to 11C are views showing the example of the fabricating process of the EL display device of the portable information apparatus of the present invention.

A second doping process is then performed, as shown in FIG. 11A. The dose amount is smaller than that of the first doping process in this case, and an impurity element which imparts n-type conductivity is doped under high acceleration voltage conditions. For example, doping performed with the acceleration voltage set from 70 to 120 keV, and a dose amount of $1\times10^{13}$ atoms/cm$^3$, and a new impurity region is formed inside the first impurity region is formed inside the first impurity region formed in the island shape semiconductor layers of FIG. 10B. The second conductive layers 5026 to 5030 are used as masks with respect to the impunity element, and doping is performed so as to also add the impurity element into regions under the first conductive layers 5026*a* to 5030*a*. A concentration of phosphorus (P) added to third impurity regions 5032 to 5036 is provided with a gradual concentration gradient in accordance with a film thickness of the taper portion of the first conductive layers 5026*a* to 5030*a*. Further, in the semiconductor layer overlapping the taper portion of the first conductive layers 5026*a* to 5030*a*, from an end portion of the taper portion of the second conductive layer toward an inner side, the impurity concentration is more or less reduced, however, the concentration stays to be substantially the same degree.

Figure 11B:
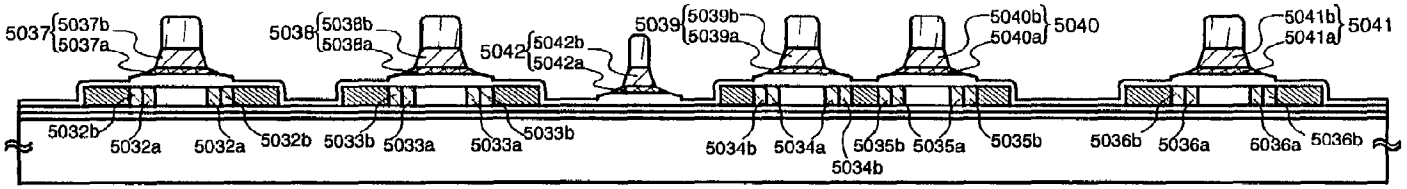

A third etching process is carried out as shown in FIG. 11B. The third etching is carried out by using $CHF_6$ for an etching gas and using a reactive ion etching process (RIE process). The third etching process is carried out for partially etching a taper portion of the first conductive layers 5026*a* to 5031*a* and reducing a region overlapping the semiconductor layer. By the third etching, there are formed third conductive layers 5037 through 5042 (first conductive layers 5037*a* to 5042*a* and second conductive layers 5037*b* to 5042*b*). Reference numeral 5007 denotes a gate insulating film, and regions not covered by the third shape conductive layers 5037 to 5042 are additionally etched on the order of 20 to 50 nm, forming thinner regions.

By the third etching, there are formed third impurity regions 5032*a* to 5036*a* overlapping the first conductive layers 5037*a* to 5041*a* in third impurity regions 5032 to 5036. Second impurity regions 5032*b* to 5036*b* between first impurity region and third impunity region.

Figure 11C:
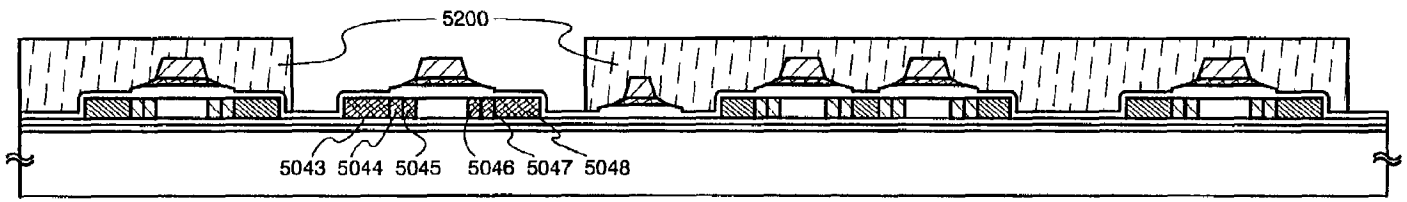

Fourth impurity regions 5043 to 5054 added with an impurity element having a conductivity type which is the opposite of the first conductivity type impurity element, are then formed as shown in FIG. 11C in the island shape semiconductor layers 5004 which form p-channel TFTs. The third shaped conductive layer 5038*b* is used as a mask with respect to the impurity element, and the impurity regions are formed in a self-aligning manner. The island shape semiconductor layers 5003, 5005, 5006 and wiring portion 5042 which form n-channel TFTs, are covered over their entire surface areas by resist mask 5200. Phosphorus is added to the impurity regions 5043 to 5054 at a different concentration, and ion doping is performed here using diborane ($B_2H_6$), so that the respective impurity regions have the impurity concentration of $2\times10^{20}$ to $2\times10^{21}$ atoms/cm$^3$.

Impurity regions are formed in the respective island shape semiconductor layers by the above processes. The third shaped conductive layers 5037 to 5041 overlapping the island shape semiconductor layers function as gate electrodes. The reference numeral 5042 functions as a island shape source signal line.

A process of activating the impurity elements added to the respective island shape semiconductor layers is then performed with the aim of controlling conductivity type after removing the resist mask 5200. Thermal annealing using an annealing furnace is performed for this process. In addition, laser annealing and rapid thermal annealing (RTA) can also be applied. Thermal annealing is performed with an oxygen concentration equal to or less than 1 ppm, preferably equal to or less than 0.1 ppm, in a nitrogen atmosphere at 400 to 700° C., typically between 500 and 600° C. Heat treatment is performed for 4 hours at 500° C. in Embodiment 8. However, for cases in which the wiring material used in the third conductive layers 5037 to 5042 is weak with respect to heat, it is preferable to perform activation after forming an interlayer insulating film (having silicon as its main constituent) in order to protect the wirings and the like.

In addition, heat treatment is performed for 1 to 12 hours at 300 to 450° C. in an atmosphere containing between 3 and 100% hydrogen, performing hydrogenation of the island shape semiconductor layers. This process is one of terminating dangling bonds in the island shape semiconductor layers by hydrogen which is thermally excited. Plasma hydrogenation (using hydrogen excited by a plasma) may also be performed as another means of hydrogenation.

Figure 12A:
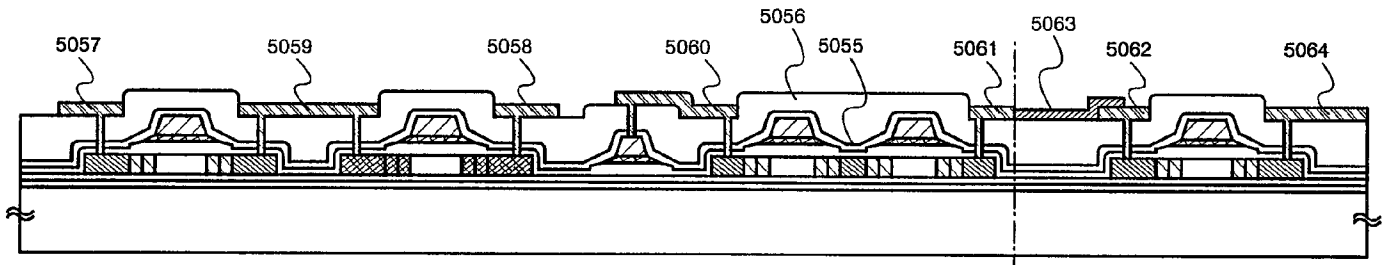
FIGS. 12A and 12B are views showing the example of the fabricating process of the EL display device of the portable information apparatus of the present invention.

As shown in FIG. 12A, a first interlayer insulating film 505 is formed next of a silicon oxynitride film having a thickness of 100 to 200 nm. A second interlayer insulating film 5056 made of an organic insulating material is then formed on the first interlayer insulating film 5055. After that, the first interlayer film, the second interlayer 5056 and the contact hole for the gate insulating film 5007 are formed. The pixel electrode 5063 which is contact to the connect wiring 5062 is patterned to formed after forming each wirings (including connect wiring and signal wiring) 5057 to 5062 and 5064.

As the second interlayer insulating film 5056, a film made of organic resin is used, and as the organic resin, polyimide, polyamide, acrylic, BCB (benzocyclobutene) or the like can be used. Especially, since the second interlayer insulating film 5056 has rather the meaning of flattening, acrylic excellent in flatness is desirable. In this embodiment, an acrylic film is formed to such a thickness that stepped portions formed by the TFTs can be adequately flattened. It is appropriate that the thickness is preferably made 1 to 5 μm (most preferably 2 to 4 μm).

The formation of the contact holes are performed by dry etching or wet etching. Contact holes reaching the n-type impurity regions 5017, 5018, 5021 and 5023 to 5025 or the p-type impurity regions 5043 to 5048, a contact hole reaching to a wiring 5042, a contact hole reaching electric current supply line (not shown), and a contact hole (not shown) reaching a gate electrode are formed, respectively.

Besides, as the wirings (inclusive of connection line and signal line) 5057 to 5062, and 5064, a lamination film of three-layer structure is used, in which a Ti film with a thickness of 100 nm, an aluminum film containing Ti with a thickness of 300 nm, and a Ti film with a thickness of 150 nm are continuously formed by sputtering into one is patterned into a desired shape. Of course, the other conductive film may be used.

Further, in Embodiment 8, a MgAg film with a thickness of 110 nm is formed as a pixel electrode 5063, and then subjected to patterning. A contact is obtained by arranging the pixel electrode 5063 so as to overlap with the connection wiring 5062 while contacting therewith. This pixel electrode 5063 becomes a cathode of an EL element (FIG. 12A).

Figure 12B:
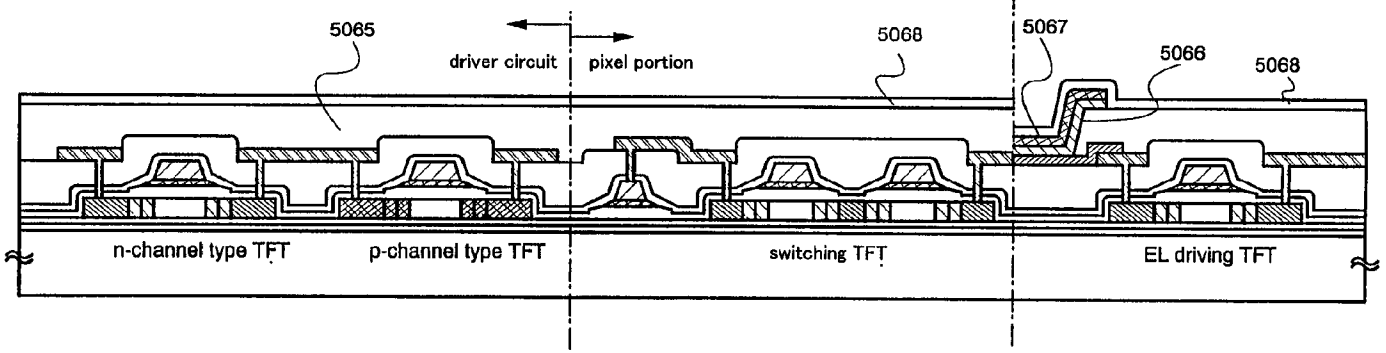
Figure 13:
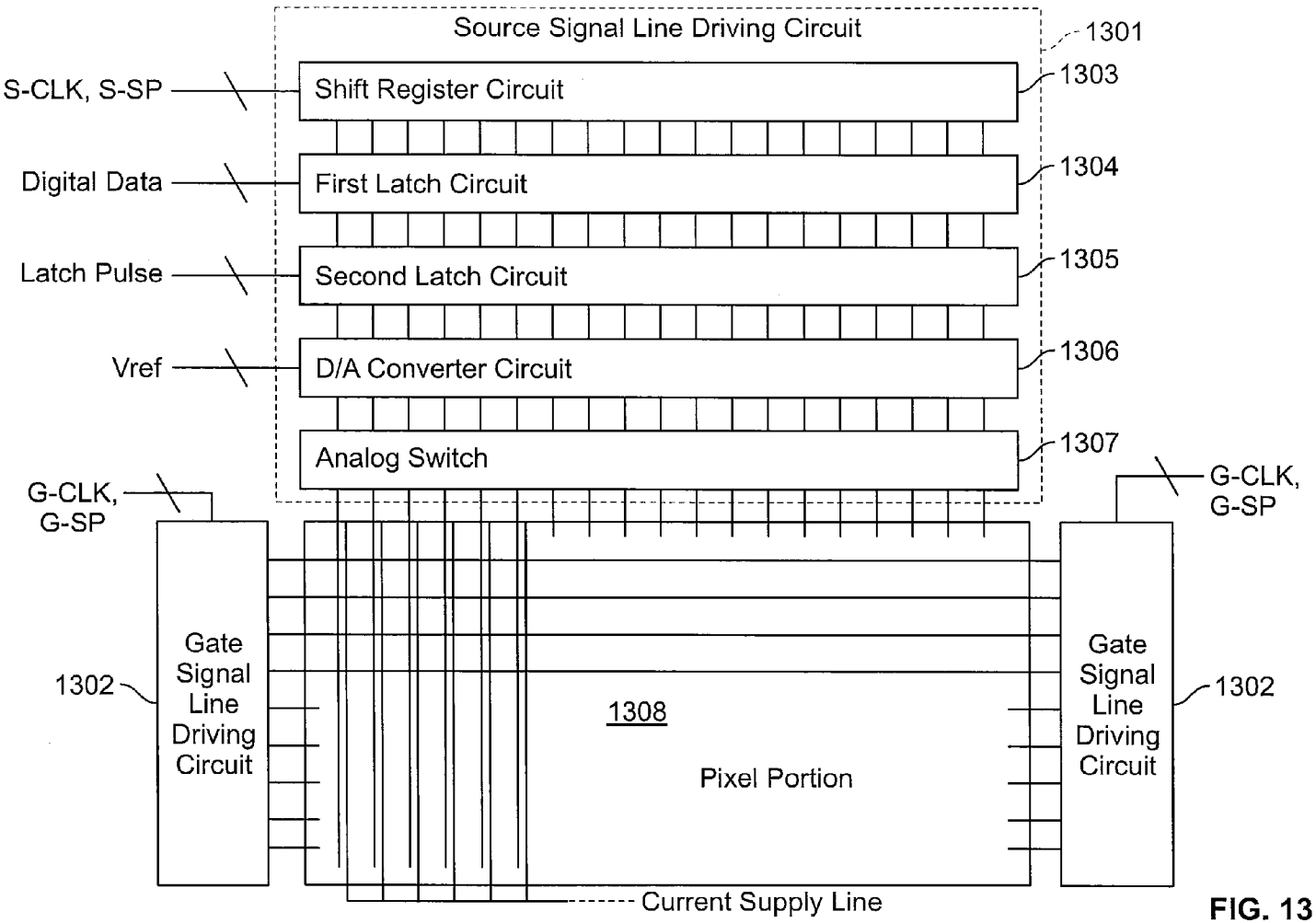
FIG. 13 (Prior Art)
FIG. 13 is a view for schematically showing the whole circuit structure of an EL display device of a conventional portable information apparatus.
Figure 14:
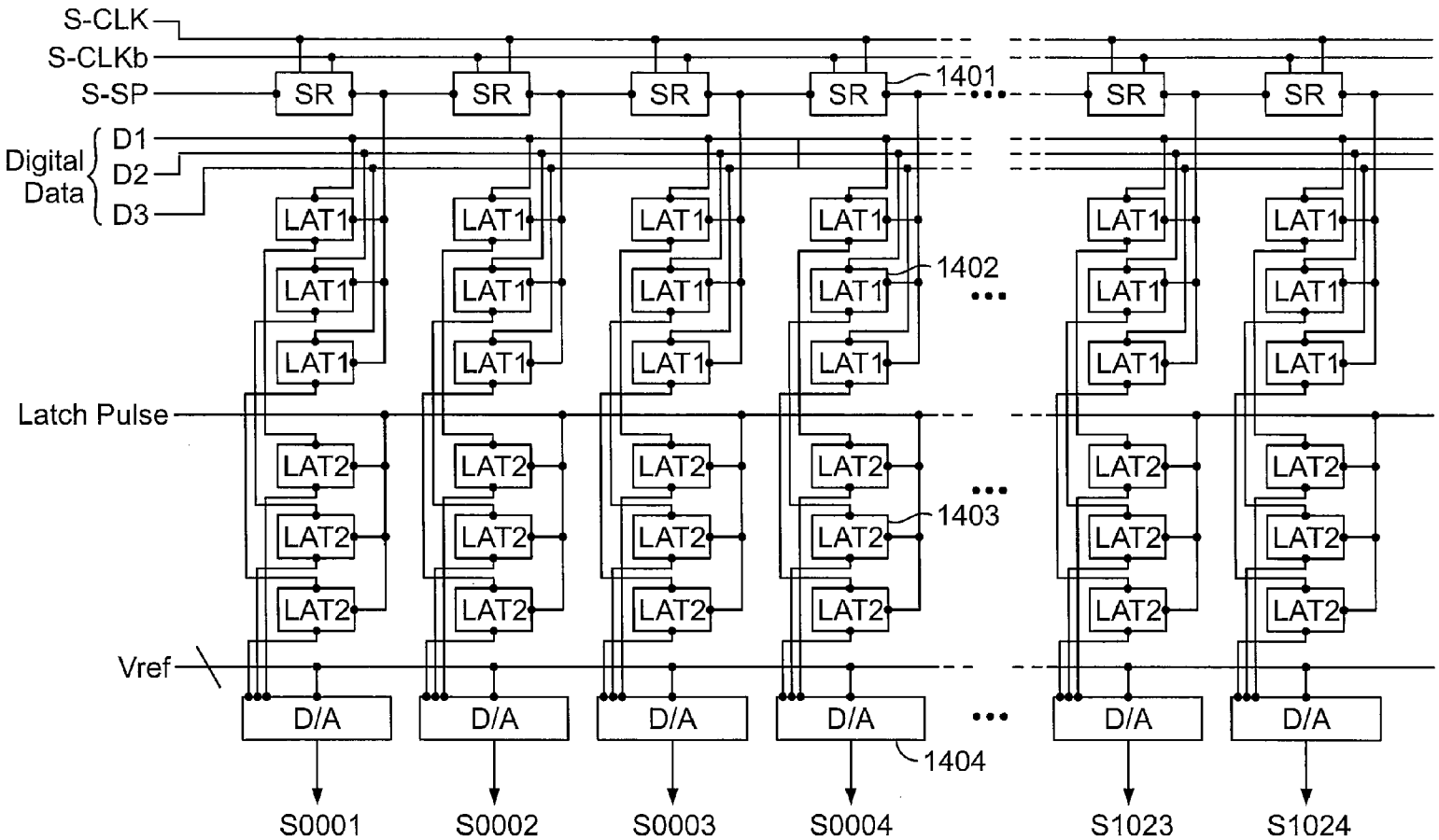
FIG. 14 (Prior Art)
FIG. 14 is a view showing a circuit structural example of a source signal line driving circuit of the EL display device of the conventional portable information apparatus.
Figure 15:
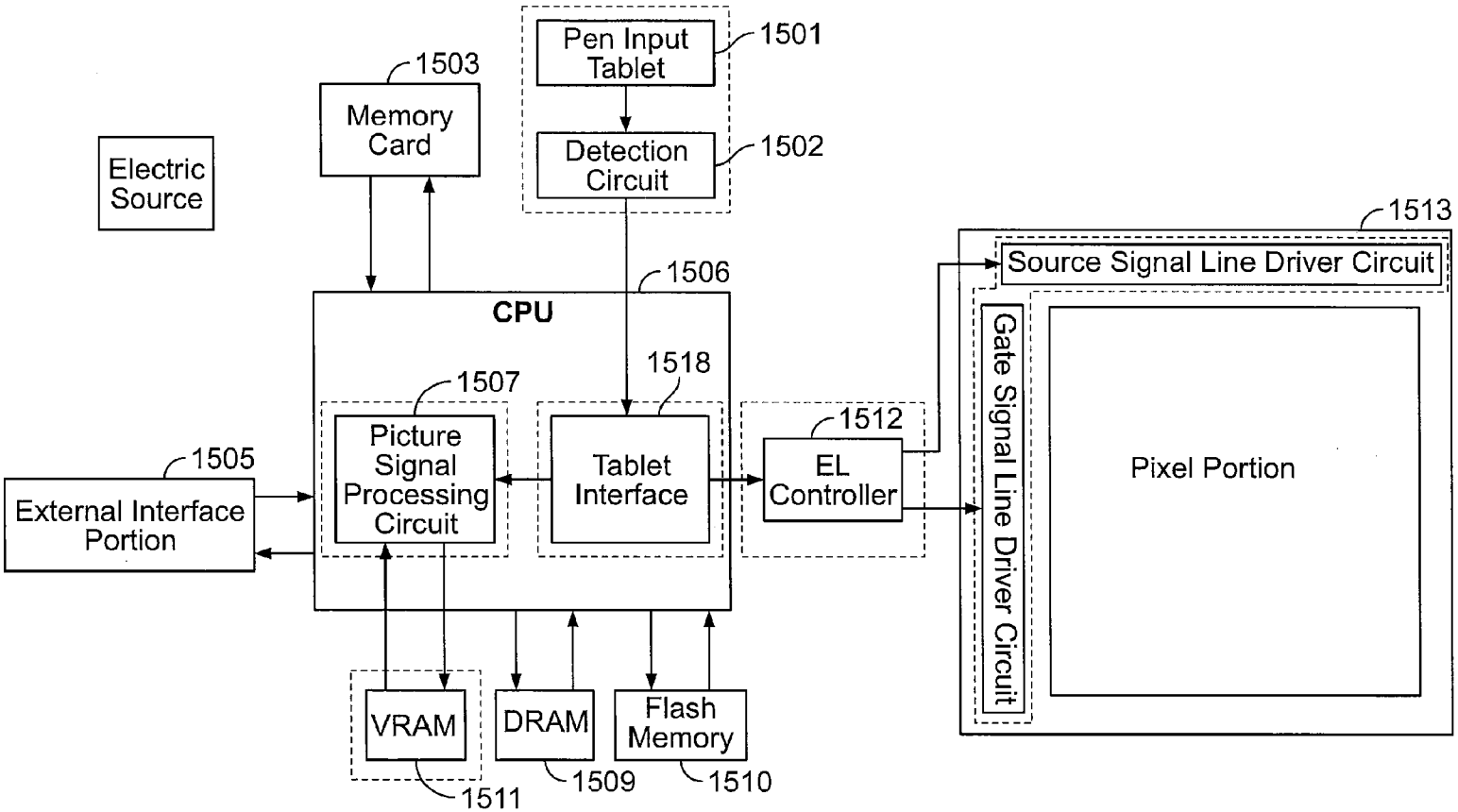
FIG. 15 (Prior Art)
FIG. 15 is a block diagram of a conventional portable information terminal.
Figure 16:
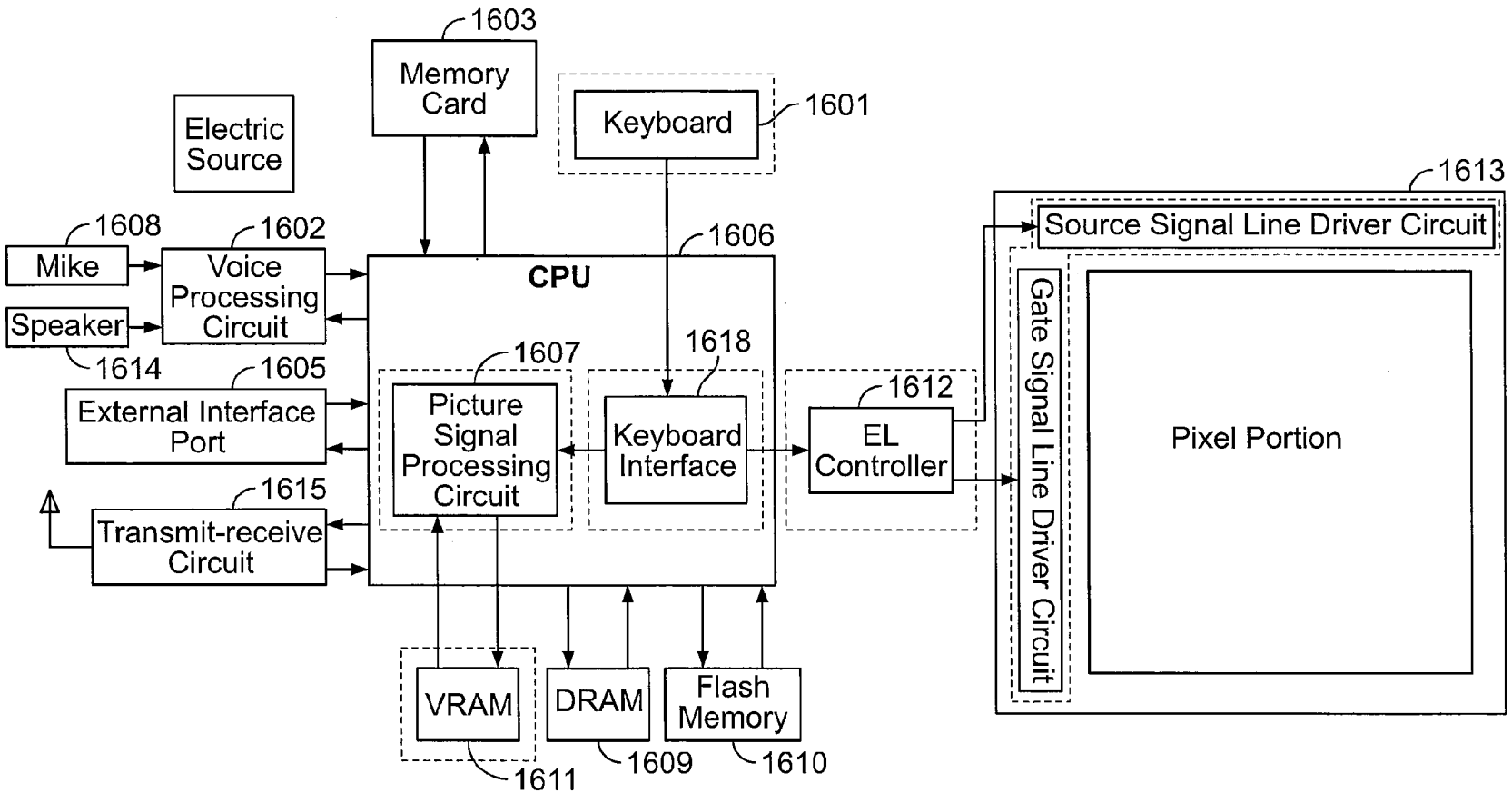
FIG. 16 (Prior Art)
FIG. 16 is a block diagram of a conventional portable telephone.

Then, as shown in FIG. 12B, an insulating film containing silicon (silicon oxide film in Embodiment 8) is formed into a thickness of 500 nm, and an opening is formed at a position corresponding to the pixel electrode 5063 to form the third interlayer insulating film 5065. Upon the formation of the opening, taper-shape side walls can easily be formed by using a wet etching method. If the side walls of the opening is sufficiently smooth, degradation of the EL layer caused by the step becomes a remarkable problem.

Then, an EL layer 5066 and an anode (opposite electrode) 5067 are continuously formed by vapor deposition without exposing them to the atmosphere. Note that the thickness of the EL layer 5066 is preferably set as 80 to 200 nm (typically 100 to 120 nm), and the thickness of the anode 5067 is preferably formed by an ITO film.

In this step, the EL layer and the anode are sequentially formed with respect to the pixels corresponding to a red color, a green color, and a blue color, respectively. Note that, the EL layer lacks withstand property against solutions, and therefore the respective colors must be formed individually without using a photolithography technology. For that reason, it is preferred that portions other than desired pixels are masked using metallic masks, and the EL layer and the anode are selectively formed only for the necessary portions.

In other words, a mask for masking all the portions except the pixels corresponding to a red color is first set, and the EL layer emitting a red color is selectively formed using the mask. Then, a mask for masking all the portions except the pixels corresponding to a green color is set, and the EL layer emitting a green color is selectively formed using the mask. Succeedingly, similarly, a mask for masking all the portions except the pixels corresponding to a blue color is set, and the EL layer emitting a blue color is selectively formed using the mask. Note that, in this case, a description is made such that a different mask is used for each case, however, the same mask may be used for all the cases.

Employed in this case is a system in which three kinds of EL elements corresponding to RGB are formed. However, the following systems may be used: a system in which an EL element emitting a white color and a color filter are combined; a system in which an EL element emitting a blue or blue-green color and a fluorescing body (fluorescing color conversion layer: CCM) are combined; and a system in which a transparent electrode is used for a cathode (pixel electrode) and an EL element corresponding to the RGB is overlapped therewith.

Note that known materials may be used for the EL layer 5066. As the known materials, organic materials are preferably used when taking a driver voltage into an account. For example, a four-layer structure consisting of a positive hole injection layer, a positive transportation layer, a light emitting layer, and an electron injection layer may be used as the EL layer.

Next, the anode 5067 is formed using a metal mask on the pixels having the switching TFTs of which the gate electrodes are connected to the same gate signal line (pixels on the same line).

Note that, in Embodiment 8, although ITO is used as the anode 5067 and MgAg is used as the cathode 5063, the present invention is not limited to this. Other known materials may be used for the anode 5067 and the cathode 5063.

Finally, a passivation film 5068 made from a silicon nitride film is formed into a thickness of 300 nm. By forming the passivation film 5068, the EL layer 5066 can be protected from moisture, etc., and the reliability of the EL element may be enhanced.

Consequently, the EL display panel with the structure as shown in FIG. 12B is completed. Note that, in the manufacturing process of the EL display panel in Embodiment 8, the source signal lines are formed from Ta and W, which are materials for forming gate electrodes, and the gate signal lines are formed from Al, which is a material for forming wirings, but different materials may be used.

TFT of the active matrix type EL display device formed by above-mentioned steps is taking a top gate structure. However, Embodiment 8 can also be applied to the bottom gate structure TFT and other structure TFT.

Further, though the glass substrate is used in Embodiment 8, substrates other than the glass substrate such as plastic substrate, stainless substrate, mono-crystalline wafers can also be used to perform not limited to the glass substrate.

Incidentally, the EL display in Embodiment 8 exhibits the very high reliability and has the improved operational characteristic by providing TFTs having the most suitable structure in not only the pixel portion but also the driver circuit portion. Further, it is also possible to add a metallic catalyst such as Ni in the crystallization process, thereby increasing crystallinity. It therefore becomes possible to set the driving frequency of the source signal line driver circuit to 10 $MH_z$ or higher.

First, a TFT having a structure in which hot carrier injection is reduced without decreasing the operating speed as much as possible is used as an n-channel TFT of a CMOS circuit forming the driver circuit portion. Note that the driver circuit referred to here includes circuits such as a shift register, a buffer, a level shifter, a latch in line-sequential drive, and a transmission gate in dot-sequential drive.

In Embodiment 8, the active layer of the n-channel TFT contains the source region, the drain region, the LDD region overlapping with the gate electrode with the gate insulating film sandwiched therebetween ($L_{ov}$ region), the LDD region not overlapping with the gate electrode with the gate insulating film sandwiched therebetween ($L_{off}$ region), and the channel forming region.

Further, there is not much need to worry about degradation due to the hot carrier injection with the p-channel TFT of the CMOS circuit, and therefore LDD regions may not be formed in particular. It is of course possible to form ILDD regions similar to those of the n-channel TFT as a measure against hot carriers.

In addition, when using a CMOS circuit in which electric current flows in both directions in the channel forming region, namely a CMOS circuit in which the roles of the source region and the drain region interchange, it is preferable that LDD regions be formed on both sides of the channel forming region of the n-channel TFT forming the CMOS circuit, sandwiching the channel forming region. A circuit such as a transmission gate used in dot-sequential drive can be given as an example of such. Further, when a CMOS circuit in which it is necessary to suppress the value of the off current as much as possible is used, the n-channel TFT forming the CMOS circuit preferably has a $L_{ov}$ region. A circuit such as the transmission gate used in dot-sequential drive can be given as an example of such.

Note that, in practice, it is preferable to perform packaging (sealing), without exposure to the atmosphere, using a protecting film (such as a laminated film or an ultraviolet cured resin film) having good airtight properties and little outgassing, or a transparent sealing material, after completing through the state of FIG. 12B. At this time, the reliability of the EL element is increased by making an inert atmosphere on the inside of the sealing material and by arranging a drying agent (barium oxide, for example) inside the sealing material.

Further, after the airtight properties have been increased by the packaging process, a connector (flexible printed circuit: FPC) is attached in order to connect terminals led from the elements or circuits formed on the substrate with external signal terminals. Then, a finished product is completed. This state at which the product is ready for shipment is referred to as an EL display device throughout this specification.

Furthermore, in accordance with the process shown in Embodiment 8, the number of photo masks required for manufacture of an EL display device can be suppressed. As a result, the process can be shortened, and the reduction of the manufacturing cost and the improvement of the yield can be attained.

[Embodiment 9]

In this embodiment, an example in which an EL display device of a portable information apparatus of the present invention has been fabricated, will be described with reference to FIGS. 19A to 19C.

Figure 19A:
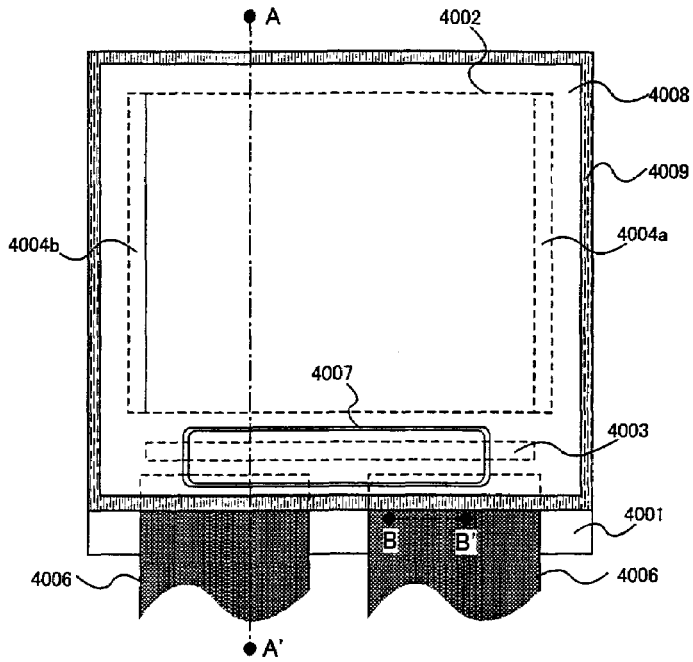
FIGS. 19A to 19C are a top view and sectional views of an EL display device of a portable information apparatus of the present invention.
Figure 19B:
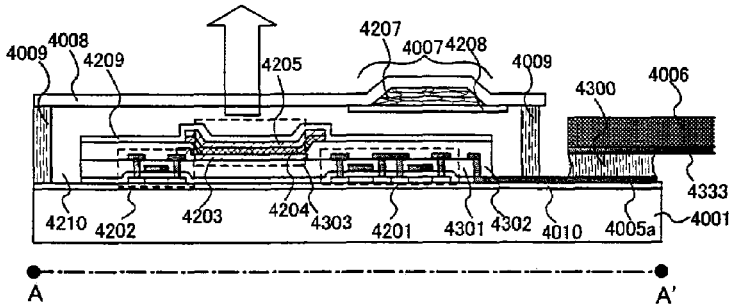
Figure 19C:
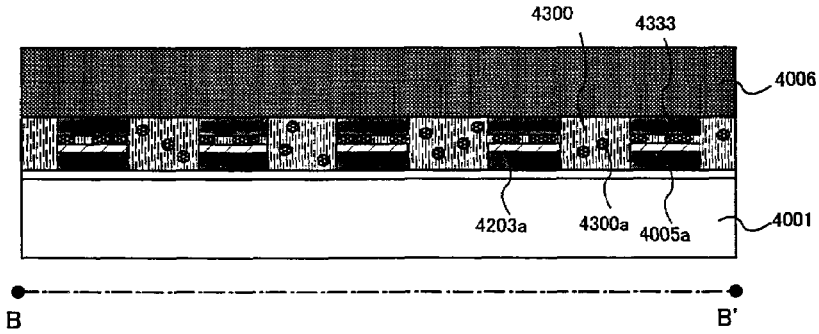

FIG. 19A is a top view of an EL display device, FIG. 19B is a sectional view taken along a line A–A' of FIG. 19A, and FIG. 19C is a sectional view taken along a line B–B' of FIG. 19A.

A seal member 4009 is provided so as to surround a pixel portion 4002, a source signal line driving circuit 4003, and first and second gate signal line driving circuits 4004*a* and 4004*b*, which are provided on a substrate 4001. Further, a sealing member 4008 is provided over the pixel portion 4002, the source signal line driving circuit 4003, and the first and the second gate signal line driving circuits 4004*a* and 4004*b*. Thus, the pixel portion 4002, the source signal line driving circuit 4003, and the first and the second gate signal line driving circuits 4004*a* and 4004*b* are sealed with a filler 4210 and by the substrate 4001, the seal member 4009, and the sealing member 4008.

Further, the pixel portion 4002, the source signal line driving circuit 4003, and the first and the second gate signal line driving circuits 4004*a* and 4004*b* provided on the substrate 4001 include a plurality of TFTs. FIG. 19B typically shows driving TFTs (here, an n-channel TFT and a p-channel TFT are shown) 4201 included in the source signal line driving circuit 4003 and a pixel TFT (a TFT for controlling current to an EL element: an EL driving TFT) included in the pixel portion 4002, which are formed on an. under film 4010.

In this embodiment, the p-channel TFT and the n-channel TFT fabricated by a well-known method are used as the driving TFTs 4201, and a p-channel TFT fabricated by a well-known method is used as the EL driving TFT 4202.

An interlayer insulating film (flattening film) 4301 is formed on the driving TFTs 4201 and the EL driving TFT 4202, and a pixel electrode (anode) 4203 electrically connected to a drain region of the EL driving TFT 4202 is formed thereon. A transparent conductive film having a high work function is used as the pixel electrode 4203. A compound of indium oxide and tin oxide, a compound of indium oxide and zinc oxide, zinc oxide, tin oxide, or indium oxide can be used for the transparent conductive film. Further, the transparent conductive film added with gallium may be used.

An insulating film 4302 is formed on the pixel electrode 4203, and an opening portion is formed in the insulating film 4302 over the pixel electrode 4203. In this opening portion, an EL (electroluminescence) layer 4204 is formed on the pixel electrode 4203. A well-known organic EL material or inorganic EL material can be used for the EL layer 4204. Although the organic EL material includes a low molecular system (monomer system) and a high molecular system (polymer system), either may be used.

As a formation method of the EL layer 4204, a well-known evaporation technique or coating technique may be used. The structure of the EL layer may be a laminate structure obtained by freely combining a hole injection layer, a hole transfer layer, a light emitting layer, an electron transfer layer, or an electron injection layer, or a single layer structure.

A cathode 4205 made of a conductive film (typically, a conductive film containing aluminum, copper or silver as its main ingredient, or a laminate film of those and another conductive films) having a light shielding property is formed on the EL layer 4204. It is desirable that moisture and oxygen existing on the interface between the cathode 4205 and the EL layer 4204 are removed to the utmost. Accordingly, it is necessary to make such contrivance that the EL layer 4204 is formed in a nitrogen or rare gas atmosphere, and the cathode 4205 is formed while the EL layer is not exposed to oxygen or moisture. In this embodiment, a multi-chamber system (cluster tool system) film forming apparatus is used, so that the film formation as described above is enabled. A predetermined voltage is applied to the cathode 4205.

In the manner as described above, an EL element 4303 constituted by the pixel electrode (anode) 4203, the EL layer 4204, and the cathode 4205 is formed. Then, a protection film 4209 is formed on the insulating film 4302 so as to cover the EL element 4303. The protection film 4209 is effective to prevent oxygen, moisture and the like from penetrating into the EL element 4303.

Reference numeral 4005*a* designates a drawing wiring line connected to a power supply line and is electrically connected to a source region of the EL driving TFT 4202. The drawing wiring line 4005*a* passes between the seal member 4009 and the substrate 4001, and is electrically connected to an FPC wiring line 4333 included in an FPC 4006 through an anisotropic conductive film 4300.

As the sealing member 4008, a glass member, a metal member (typically, a stainless member), a ceramic member, or a plastic member (including a plastic film) can be used. As the plastic member, an FRP (Fiberglass-Reinforced Plastics) plate, a PVF (polyvinyl fluoride) film, a Mylar film, a polyester film or an acryl resin film can be used. Further, a sheet having such a structure that an aluminum foil is interposed between PVF films or Mylar films can also be used.

However, in the case where the radiation direction of light from the EL element is directed toward the side of a cover member, the cover member must be transparent. In this case, a transparent material such as a glass plate, a plastic plate, a polyester film, or an acryl film is used.

As the filler 4210, in addition to an inert gas such as nitrogen or argon, ultraviolet ray curing resin or thermosetting resin can be used, and PVC (polyvinyl chloride), acryl, polyimide, epoxy resin, silicone resin, PVB (polyvinyl butyral), or EVA (ethylene-vinyl acetate) can be used. In this embodiment, nitrogen was used as the filler.

Further, in order to expose the filler 4210 to a hygroscopic material (preferably, barium oxide) or a material capable of adsorbing oxygen, a recess portion 4007 is provided on the surface of the sealing member 4008 on the side of the substrate 4001 and the hygroscopic material or the material 4207 capable of adsorbing oxygen is disposed. Then, in order to prevent the hygroscopic material or the material 4207 capable of adsorbing oxygen from scattering, the hygroscopic material or the material capable of adsorbing oxygen are held in the recess portion 4007 by a recess cover member 4208. Note that, the recess cover member 4208 is formed into a fine mesh, and has such a structure that air or moisture is permeated and the hygroscopic material or the material 4207 capable of adsorbing oxygen is not permeated. The deterioration of the EL element 4303 can be suppressed by providing therewith the hygroscopic material or the material 4207 capable of adsorbing oxygen.

As shown in FIG. 19C, at the same time as the formation of the pixel electrode 4203, a conductive film 4203*a* is formed to be in contact with the drawing wiring line 4005*a*.

The anisotropic conductive film 4300 includes a conductive filler 4300*a*. The substrate 4001 and the FPC 4006 are thermally compressed, so that the conductive film 4203*a* on the substrate 4001 and the FPC wiring line 4333 on the FPC 4006 are electrically connected through the conductive filler 4300*a*.

[Embodiment 10]

In this embodiment, a description will be given of by way of an example of a case using, as an EL display device of a portable information apparatus of the present invention, an EL display device with downward outgoing light in which light emitted from an EL element is radiated to the side of a pixel substrate.

When a design rule is made a 1 μm rule, and a pixel pitch is set as about 100 ppi, a memory circuit, a D/A converter and the like in the inside of a pixel can be arranged under a source signal line, and a problem of lowering of an opening ratio can be solved. With this structure, the present invention can be applied to not only an EL display device with upward outgoing light in which light emitted from an EL element is radiated in a direction opposite to the side of a pixel substrate but also the EL display device with downward outgoing light.

Figure 30:
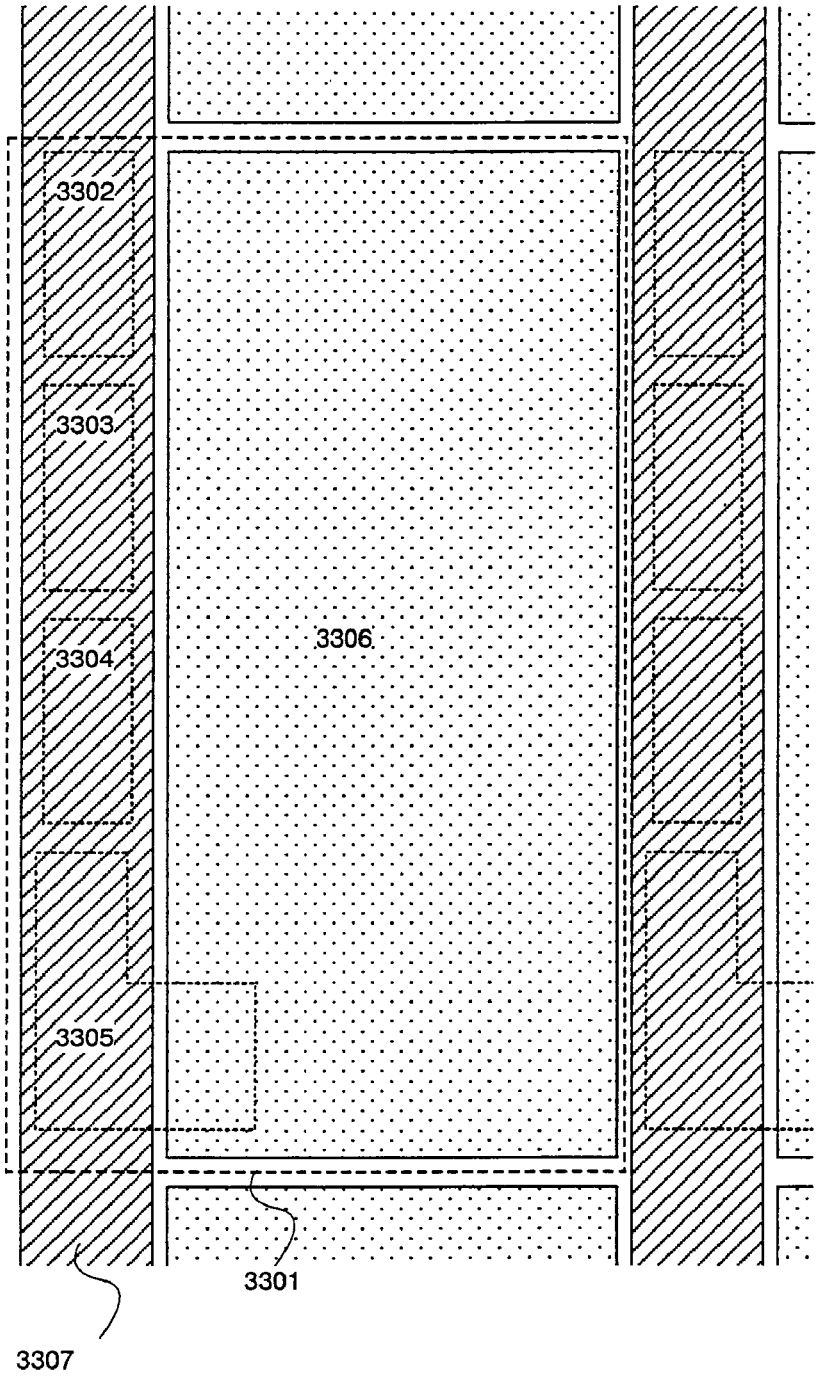
FIG. 30 is a top view of a pixel of an EL display device of a portable information apparatus of the present invention.

FIG. 30 is a top view schematically showing a pixel of the EL display device with downward outgoing light and having the above structure.

Reference numeral 3301 designates a pixel; 3302 to 3304, memory circuits; 3305, a D/A converter (in the drawing, expressed as D/A); 3306, a pixel electrode; and 3307, a source signal line. A transparent electrode is used as the pixel electrode 3306. Note that, a power supply line, a counter electrode, a color filter, a storage capacitor, and the like are not shown. Here, the memory circuits 3302 to 3304 and the D/A converter 3305 are formed under the source signal line 3307.

Note that, although not shown, the memory circuits 3302 to 3304, the D/A converter 3305 and the like can also be disposed under a gate signal line, not the source signal line 3307.

[Embodiment 11]

In a pixel of an EL display device of an information terminal instrument of the present invention, although a static memory (Static RAM: SRAM) is used as a memory circuit, the memory circuit is not limited to only the SRAM. As a memory circuit applicable to the pixel portion of the EL display device of the information terminal instrument of the present invention, a dynamic memory (Dynamic RAM: DRAM) or the like can be cited.

Further, although particularly not shown, as another type memory circuit, the pixel of the EL display device of the information terminal instrument of the present invention can be constructed by using a ferroelectric memory (Ferroelectric RAM: FRAM). The FRAM is a nonvolatile memory having a writing speed equivalent to the SRAM or the DRAM, and by using its feature of low writing voltage etc., the consumed electric power of the EL display device of the information terminal instrument of the present invention can be further reduced. In addition, a construction can also be made by using a flash memory or the like.

[Embodiment 12]

In an EL display device included in a portable information apparatus of the present invention, external emission quantum efficiency can be remarkably improved by using an EL material in which phosphorescence from a triplet exciton can be used for light emission. By this, the consumed electric power of an EL element can be reduced, its life can be lengthened, and its weight can be reduced.

Here, there is a report in which the triplet exciton is used and the external quantum efficiency is improved. (T. Tsutsui, CIRCUIT Adachi, S. Saito, Photochemical Processes in Organized Molecular Systems, ed. K Honda, (Elsevier Sci. Pub., Tokyo, 1991) p. 437).

A molecular formula of an EL material (coumarin pigment) reported in the above paper is as follows:

[Chemical Formula 1]

(M. A. Baldo, D. F. O'Brien, Y You, A. Shoustikov, S. Sibley, M. E. Thompson, S. R. Forrest, Nature 395 (1988) p. 151.)

A molecular formula of an EL material (Pt complex) reported in the above paper is as follows:

[Chemical Formula 2]

(M. A. Baldo, S. Lamansky, P. E. Burrows, M. E. Thompson, S. R. Forrest, Appl. Phys. Lett., 75 (1999) p.4.) (T. Tsutsui, M.-J. Yang, M. Yahiro, K Nakamura, T. Watanabe, T. Tsuji, Y Fukuda, T. Wakimoto, S. Mayaguchi, Jpn. Appl. Phys., 38 (12B) (1999) L1502.)

A molecular formula of an EL material (Ir complex) reported in the above paper is as follows:

[Chemical Formula 3]

Next, a description will be given of the characteristics of an EL material which can use phosphorescence from the triplet exciton as light emission.

In an EL display device included in a portable information apparatus of the present invention, DC voltage was applied to a power supply line by an arbitrary waveform generator, switching ON-OFF was made, and a response time was measured. An ON period (selection period) and an OFF period (non-selection period, voltage 0 V) were respectively made 250 μs.

As an optical system for measuring the luminous brightness of an EL element, a photomultiplier was set in a lens-barel of a microscope, and the output of the photomultiplier was measured by an oscilloscope. Note that, in the present specification, the response time is defined as rising from the non-selection state to the selection state, or falling from the selection state to the non-selection state. Specifically, the response time was a time from the instant of switching of a driving waveform to the point when an optical response pursuant to that was changed to 90% of a full response.

Figure 34:
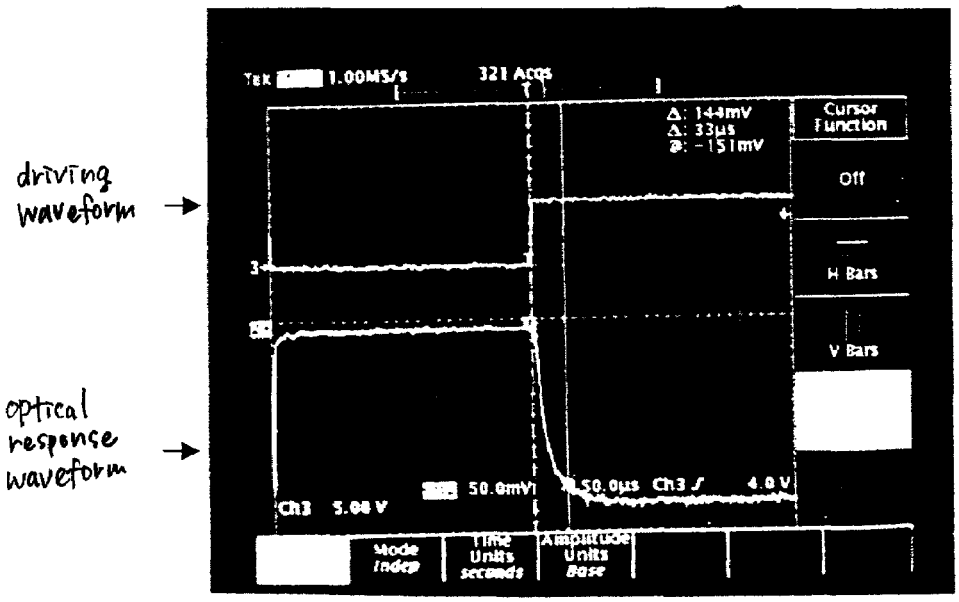
FIG. 34 is a view showing characteristics of an EL material using phosphorescence from a triplet excitation.

FIG. 34 shows a driving waveform of a signal inputted to the power supply line and an optical response waveform signifying the luminous brightness of the EL element. The upper part indicates the driving waveform, and the lower part indicates the optical response waveform. The minus output type photomultiplier was used, and a voltage of 0V to 6V was applied. At this time, the response time was 33 μs.

As described above, if phosphorescence from the triplet exciton can be used, in principle, the external quantum efficiency 3 to 4 times as high as that of the case using fluorescence from the singlet exciton can be realized.

[Embodiment 13]

Figure 31:
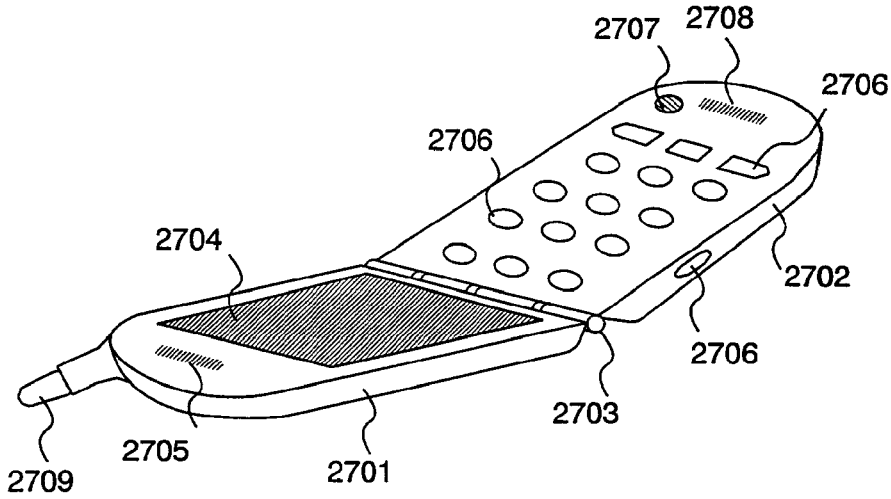
FIG. 31 is a view showing an example of a portable information terminal of the present invention.

In this embodiment, an external appearance of a portable information terminal of the present invention will be described. FIG. 31 shows a portable information terminal having a structure of the present invention, in which reference numeral 2701 designates a display panel; and 2702, an operation panel. The display panel 2701 and the operation panel 2702 are connected to each other at a connection portion 2703. At the connection portion 2703, an angle θ between a plane of the operation panel 2701 on which a display portion 2704 is provided and a plane of the operation panel 2702 on which an operation key 2706 is provided can be arbitrarily changed.

The display panel 2701 includes the display portion 2704. The portable information terminal shown in FIG. 31 has a function as a telephone, the display panel 2701 includes a voice output portion 2705, and a voice is outputted from the voice output portion 2705. An EL display device is used for the display portion 2704.

The aspect ratio of the display portion 2704 can be selected to be an arbitrary one such as 16:9 or 4:3. It is desirable that the size of the display portion 2704 is about 1 inch to 4.5 inches in diagonal.

The operation panel 2702 includes the operation key 2706, a power switch 2707, and a voice input portion 2708. Note that, in FIG. 31, although the operation key 2706 and the power switch 2707 are separately provided, such a structure may be adopted that the power switch 2707 is included in the operation key 2706. In the voice input portion 2708, a voice is inputted.

Note that, in FIG. 31, although the display panel 2701 includes the voice output portion 2705, and the operation panel 2702 includes the voice input portion 2708, this embodiment is not limited to this structure. The display panel 2701 may include the voice input portion 2708, and the operation panel 2702 may include the voice output portion 2705. Further, both the voice output portion 2705 and the voice input portion 2708 may be provided on the display panel 2701, or both the voice output portion 2705 and the voice input portion 2708 may be provided on the operation panel 2702.

Figure 32:
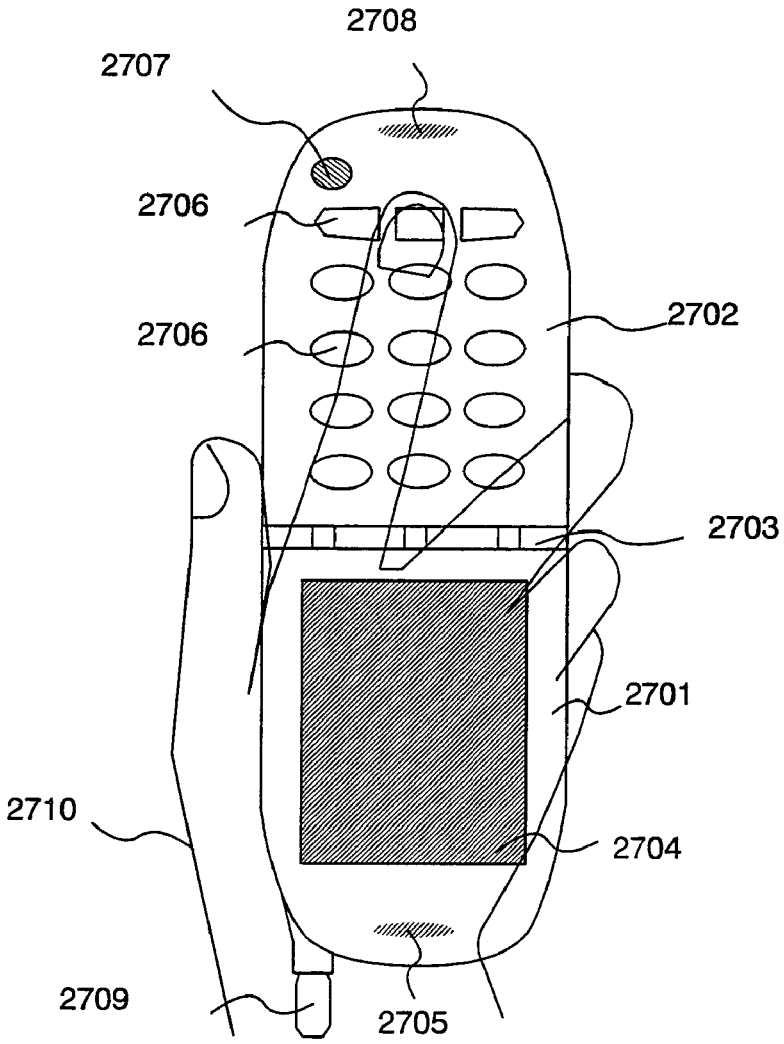
FIG. 32 is a view showing an example of the portable information apparatus of the present invention.
Figure 33:
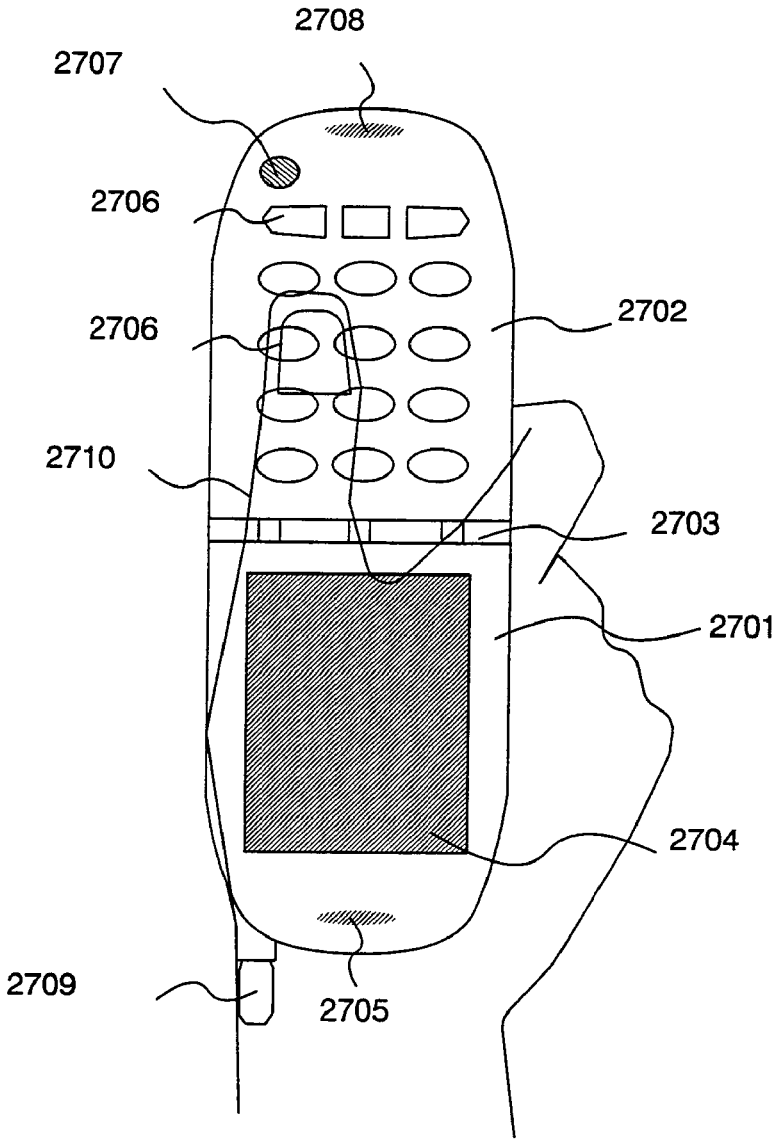
FIG. 33 is a view showing an example of the portable information apparatus of the present invention.

Note that, FIG. 32 shows an example in which the operation key 2706 of the portable information terminal shown in FIG. 31 is operated by an index finger. FIG. 33 shows an example in which the operation key 2706 of the portable information terminal shown in FIG. 31 is operated by a thumb. Note that, the operation key 2706 may be provided at the side of the operation panel 2702. The operation can be made by only the index finger of one hand (dominant hand) or only the thumb.

[Embodiment 14]

In this embodiment, an electronic instrument using a portable information apparatus of the present invention will be described with reference to FIGS. 28A to 28C and FIGS. 27A and 27B.

Figure 28A:
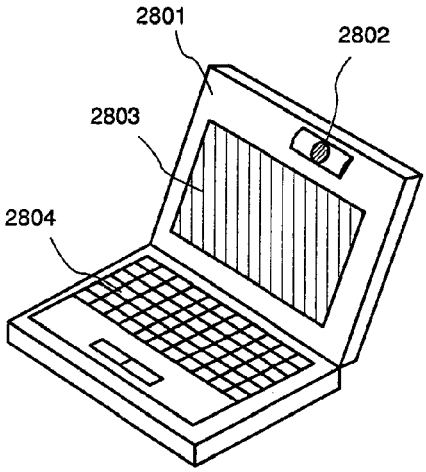
FIGS. 28A to 28C are views showing application examples of a portable information apparatus of the present invention.

As the portable information apparatus of the present invention, there is a personal computer. FIG. 28A shows the personal computer which includes a main body 2801, an image input portion 2802, a display portion 2803, a keyboard 2804, and the like. Reduction in consumed electric power of the personal computer can be realized by using an EL display device including memory circuits for each pixel as the display portion 2803.

Figure 28B:
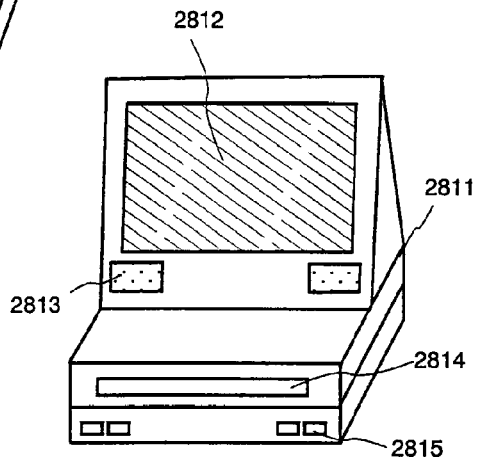

As the portable information apparatus of the present invention, there is a navigation apparatus. FIG. 28B shows the navigation apparatus which includes a main body 2811, a display portion 2812, a speaker portion 2813, a memory medium 2814, an operation switch 2815, and the like. Reduction in consumed electric power of the navigation apparatus can be realized by using an EL display device including memory circuits for each pixel as the display portion 2812.

Figure 28C:
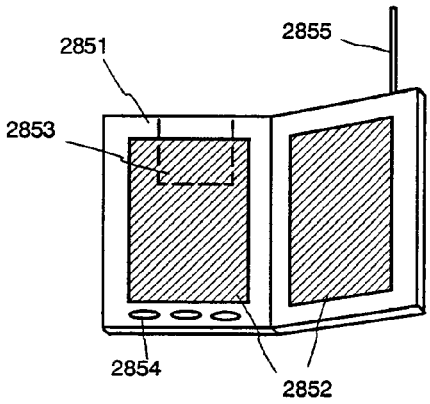
Figure 29A:
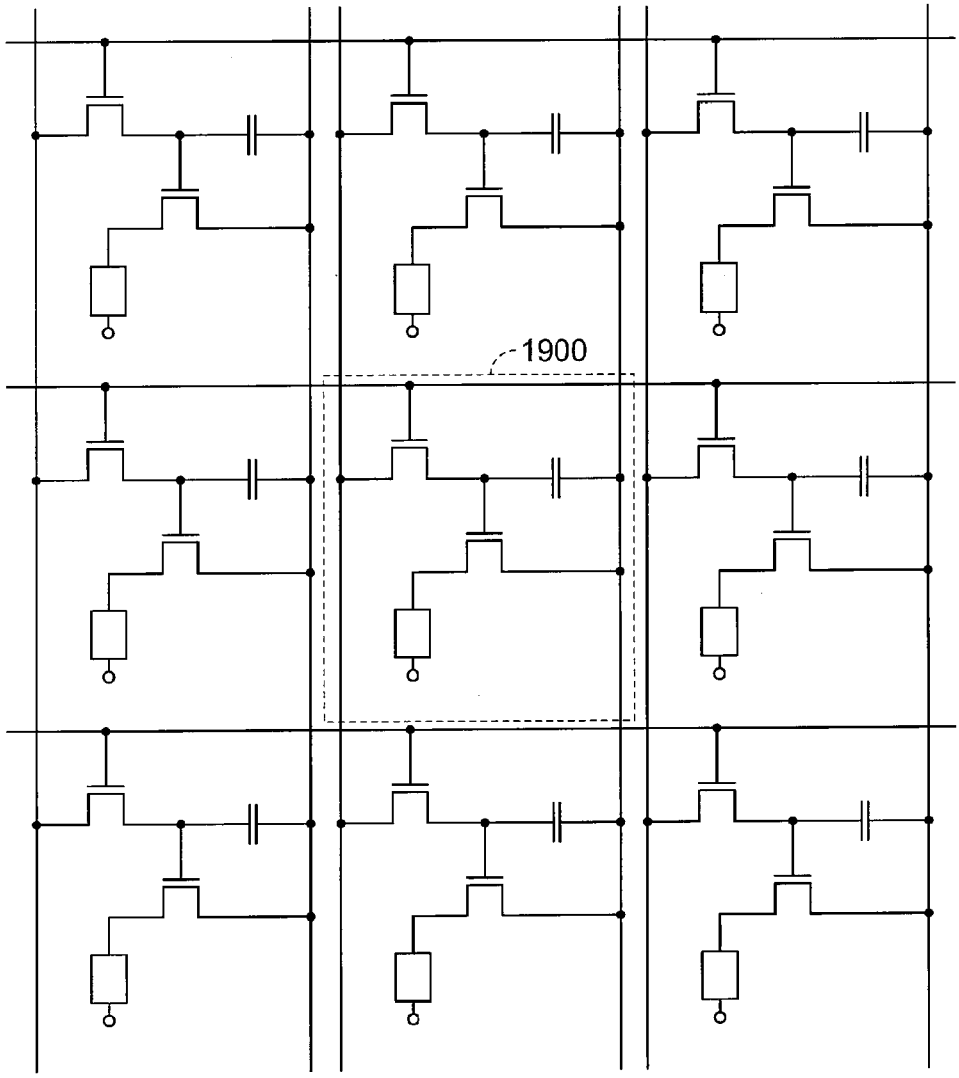
FIG. 29A (Prior Art)
FIGS. 29A and 29B are views showing a structural example of a pixel portion of a conventional active matrix type EL display device.
Figure 29B:
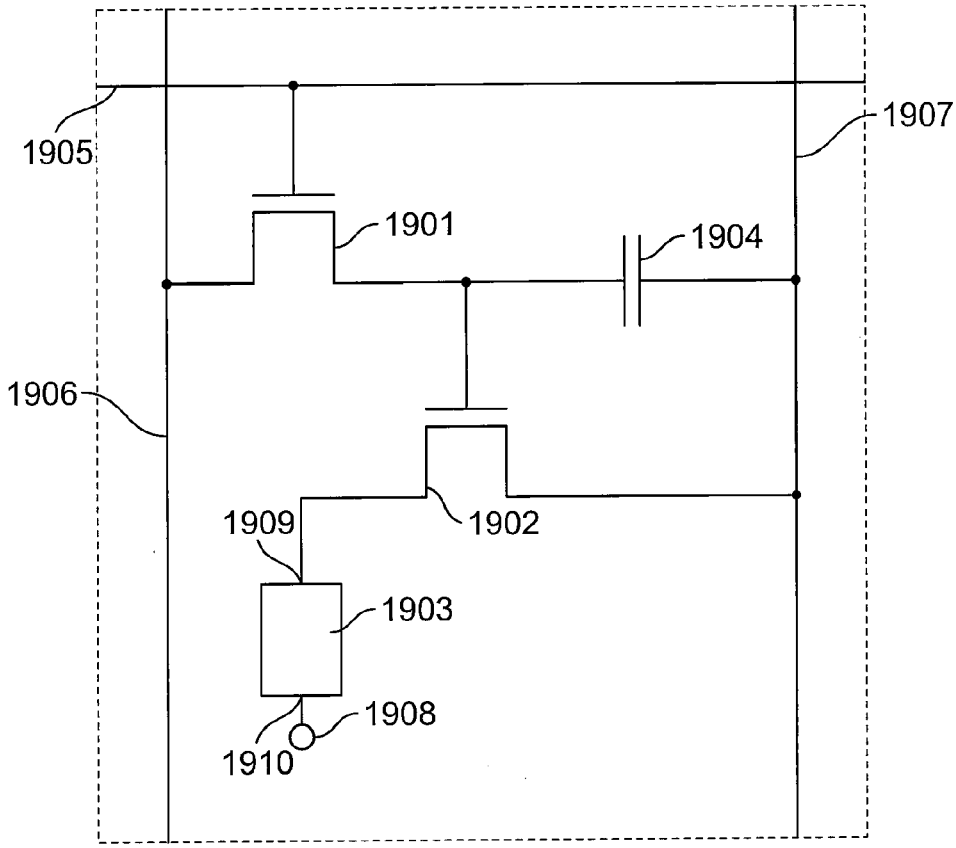
FIG. 29B (Prior Art)

As the portable information apparatus of the present invention, there is an electronic book. FIG. 28C shows the electronic book which includes a main body 2851, a display portion 2852, a memory medium 2853, an operation switch 2854, an antenna 2855, and the like, and displays data stored in a minidisk (MD) or a DVD (Digital Versatile Disc) or data received by the antenna. Reduction in consumed electric power of the electronic book can be realized by using an EL display device including memory circuits for each pixel as the display portion 2852.

Figure 27A:
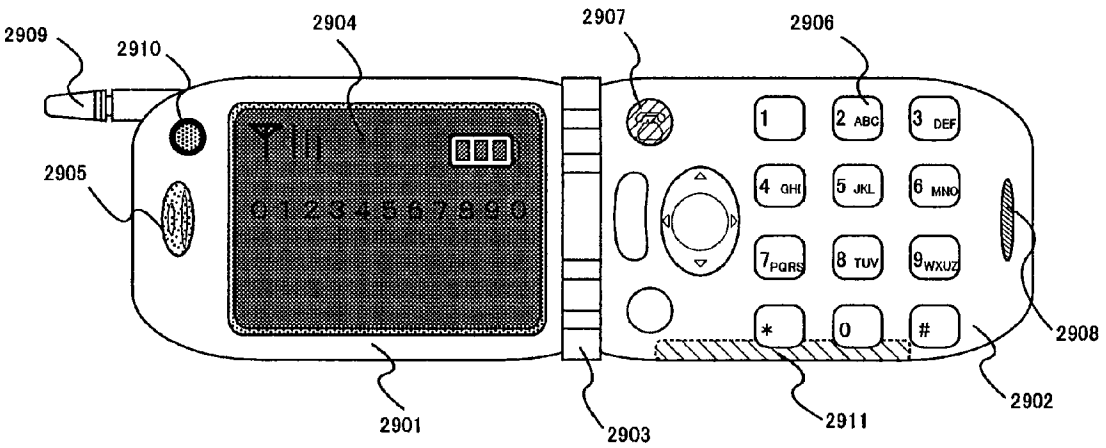
FIGS. 27A and 27B are views showing application examples of a portable information apparatus of the present invention.

As the portable information apparatus of the present invention, there is a portable telephone. FIG. 27A shows the portable telephone which includes a display panel 2901, an operation panel 2902, a connection portion 2903, a display portion 2904, a voice output portion 2905, an operation key 2906, a power switch 2907, a voice input portion 2908, an antenna 2909, a CCD light receiving portion 2910, an external input port 2911, and the like. Reduction in consumed electric power of the portable telephone can be realized by using an EL display device including memory circuits for each pixel as the display portion 2904.

Figure 27B:
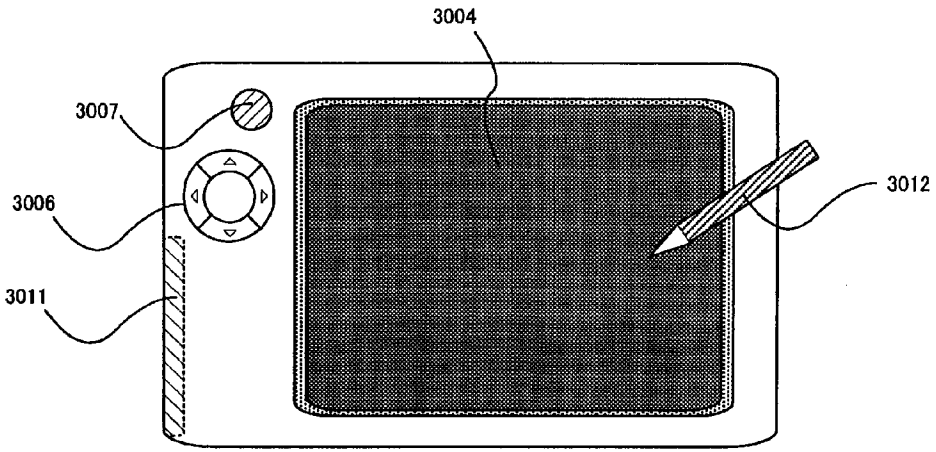

As the portable information apparatus of the present invention, there is a PDA. FIG. 27B shows the PDA which includes a display portion and pen input tablet 3004, an operation key 3006, a power switch 3007, an external input port 3011, an input pen 3012, and the like. Reduction in consumed electric power of the PDA can be realized by using an EL display device including memory circuits for each pixel as the display portion 3004.

[Embodiment 15]

In this embodiment, in an EL display device including a pixel with a structure similar to the structure shown in FIG. 20, a case where an operation for converting a signal held in a memory circuit included in each pixel and inputted to a D/A converter into a corresponding analog signal is controlled by using a DAC controller, will be described with reference to FIG. 36.

Note that, in this embodiment, the operation for converting the signal held in the memory circuit included in each pixel and inputted to the D/A converter into the corresponding analog signal and for outputting it from the D/A converter is called a readout operation of the memory circuit.

As a structure of the DAC controller, a circuit of a well-known structure can be freely used.

Figure 36:
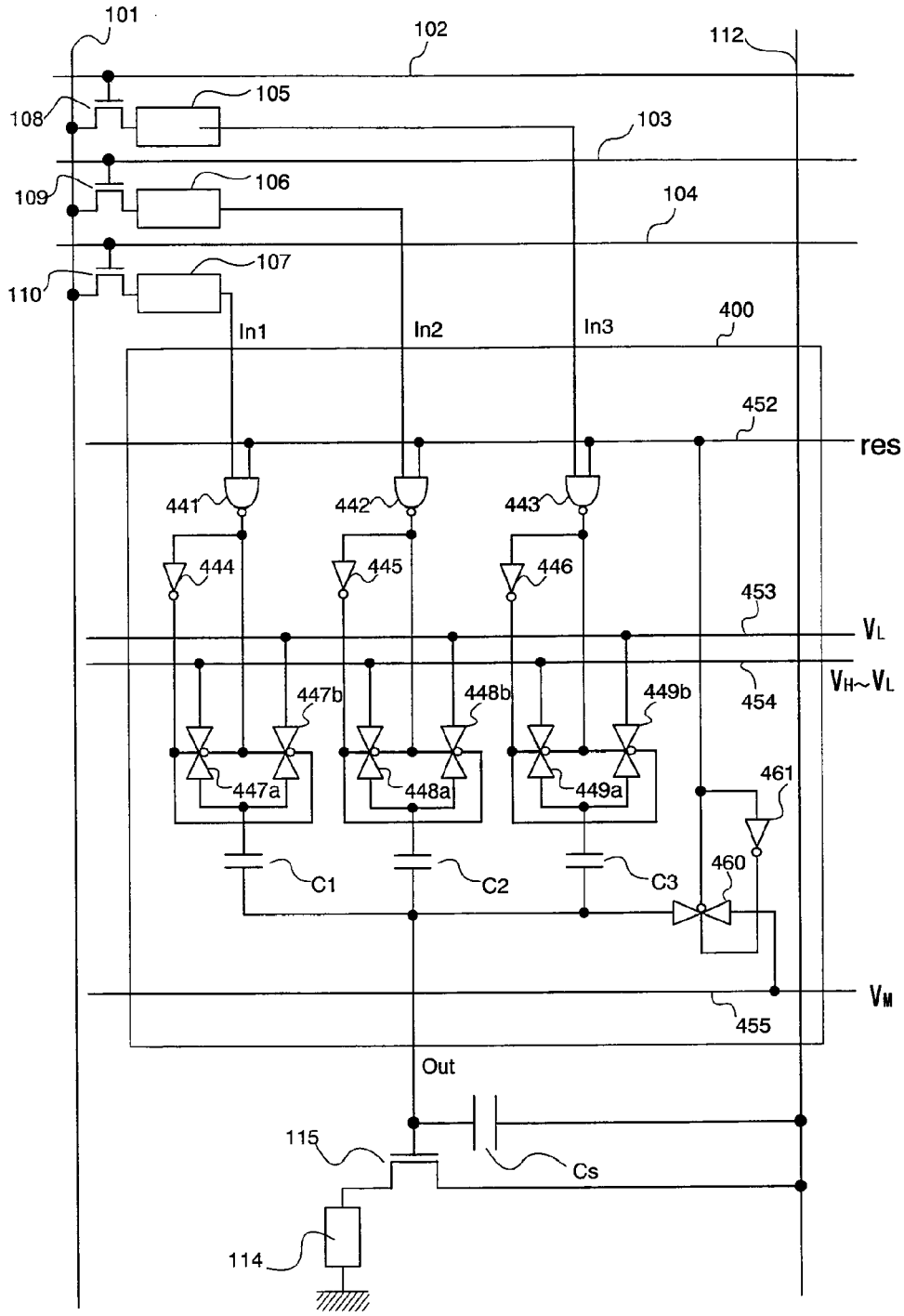
FIG. 36 is a view showing a structure of a pixel of an EL display device of a portable information apparatus of the present invention.

In FIG. 36, a pixel includes writing TFTs 108 to 110, memory circuits 105 to 107, a source signal line 101, a power supply line 112, writing gate signal lines 102 to 104, a D/A converter 400, an EL driving TF11 115, an EL element 114, and a storage capacitor $C_s$.

One of a source region and a drain region of each of the writing TFTs 108 to 110 is connected to the source signal line 101, and the other is connected to the input of each of the memory circuits 105 to 107. A gate electrode of each of the writing TFTs 108 to 110 is connected to each of the writing gate signal lines 102 to 104. The output of each of the memory circuits 105 to 107 is connected to each of input terminals in1 to in3 of the D/A converter 400. The output "out" of the D/A converter 400 is connected to a gate electrode of the EL driving TFT 115 and one electrode of the storage capacitor Cs. One of a source region and a drain region of the EL driving TFT 115 is connected to the power supply line 112, and the other is connected to one electrode of the EL element 114. The side where the storage capacitor Cs is not connected to the gate electrode of the EL driving TFT 115 is connected to the power supply line 112.

The D/A converter 400 is constituted by NAND circuits 441 to 443, inverters 444 to 446 and 461, switches 447*a* to 449*a*, switches 447*b* to 449*b*, a switch 460, capacitors C1 to C3, a reset signal line 452, a low voltage side gradation power line 453, a high voltage side gradation power line 454, and an intermediate voltage side gradation power line 455.

Since an operation up to storing of digital signals into the memory circuits 105 to 107 is the same as the operation explained in this embodiment mode or Embodiment 1, the explanation is omitted.

Hereinafter, the operation of the D/A converter 400 will be described.

The switch 460 is turned on by a signal res inputted to the reset signal line 452, the potentials of the capacitors C1 to C3 at the side where they are connected to the out terminal are fixed to potential VM of the intermediate voltage side gradation power line 455. Further, the potential of the high voltage side gradation power line 454 is set to be equal to the potential $V_L$ of the lower voltage side gradation power line 453. At this time, even if digital signals are inputted to the input terminals in1 to in3, the signals are not written into the capacitors C1 to C3.

Thereafter, the signal res of the reset signal line 452 is changed, the switch 460 is turned off, and fixing of the potentials of the capacitors C1 to C3 at the out terminal side is released. Next, the potential of the high voltage side gradation power line 454 is changed to a value $V_H$ different from the potential VL of the low voltage side gradation power line 453. At this time, the outputs of the NAND circuits 441 to 443 are changed in accordance with signals inputted to the terminals in1 to in3, and in each of the switches 447 to 449, one of the two switches is turned on, and the potential $V_H$ of the high voltage side gradation power line or the potential $V_L$ of the low voltage side gradation power line is applied to the electrodes of the capacitors C1 to C3.

Here, the values of the capacitors C1 to C3 are set to correspond to the respective bits. For example, the values are set so that C1:C2:C3 becomes 1:2:4.

The potentials of the capacitors C1 to C3 at the out terminal side are changed by voltages applied to the capacitors C1 to C3, and the output potentials are changed. That is, an analog signal corresponding to the inputted digital signals of the terminals in1 to in3 is outputted from the out terminal.

The output of the analog signal from the D/A converter 400 with respect to the inputted digital signal can be controlled by controlling the signal res inputted to the reset signal line 452 and the potential of the high voltage gradation power line 454 through the DAC controller.

After the digital signals are once written in the memory circuits included in the pixel, the above operation is repeated by using the DAC controller, and the readout operation of the digital signals held in the memory circuits is repeated, so that a still picture can be displayed.

At this time, the operations of the source signal line driving circuit and the gate signal line driving circuit can be stopped.

Note that, in FIG. 36, although the description has been given by way of the example in which the thee memory circuits are arranged, the invention is not limited to this. In general, the invention can be applied to an EL display device including a pixel of a structure in which n (n is a natural number not less than 2) memory circuits are arranged in each pixel.

As the DAC controller, a circuit of a well-known structure can be freely used.

[Embodiment 16]

In this embodiment, an example of a structure of a pixel of the present invention will be described with reference to FIG. 35.

Figure 35:
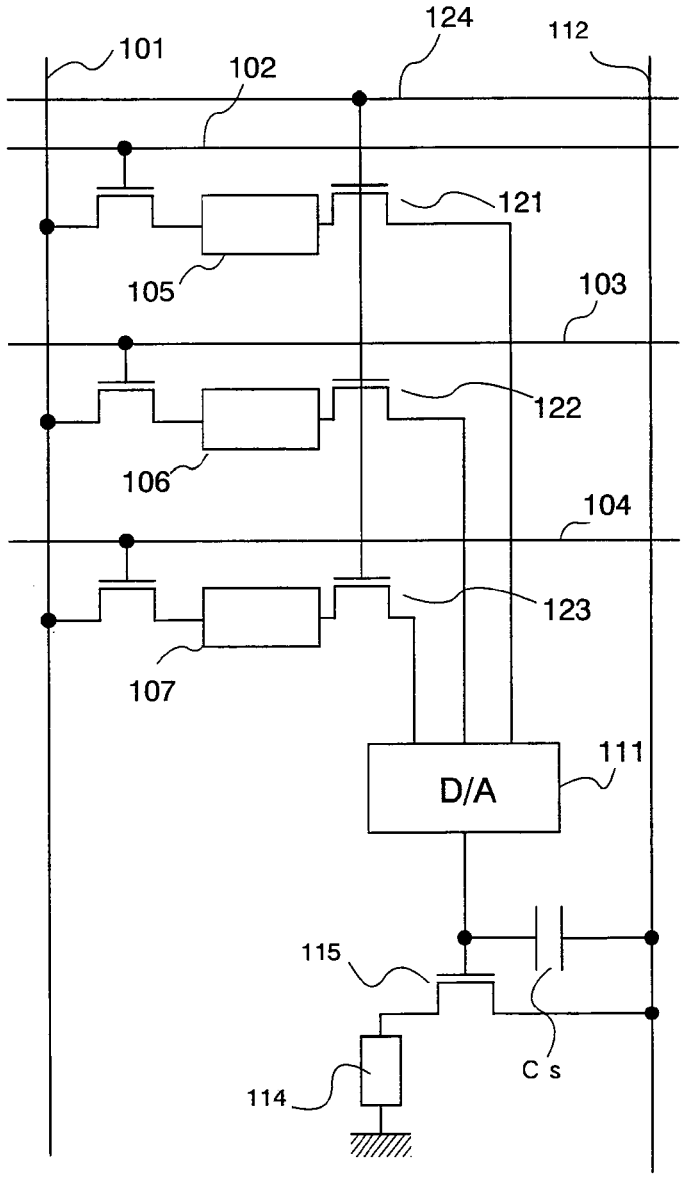
FIG. 35 is a view showing a structure of a pixel of an EL display device of a portable information apparatus of the present invention.

In FIG. 35, the same portions as those of FIG. 24 are designated by the same characters, and the explanation thereof is omitted.

In FIG. 35, the outputs of memory circuits 105 to 107 are respectively inputted to a D/A 111 through reading TFTs 121 to 123. Here, gate electrodes of the reading TFTs 121 to 123 are connected to a reading gate signal line 124.

In the pixel of the structure of FIG. 35, since the operation of writing signals into the respective memory circuits 105 to 107 is the same as that of this embodiment mode or this embodiment, the explanation thereof is omitted here.

When a still picture is displayed, after digital signals are once stored in the memory circuits 105 to 107, a signal is inputted to the reading gate signal line 124 so that the reading TFTs 121 to 123 are turned on, and the digital signals held in the memory circuits 105 to 107 are inputted to the D/A 111. Here, in the case where each pixel includes the reading TFTs as in this embodiment, inputting digital signals held in the memory circuits 105 to 107 to the D/A 111 is called a readout operation of the signals of the memory circuits.

The on and off states of the reading TFTs 121 to 123 are changed and the readout operation is repeated, so that the still picture can be displayed.

Here, although the readout operation is carried out while the reading gate signal line is selected, the reading gate signal line 124 can be driven by using a reading gate signal line driving circuit.

As the structure of the reading gate signal line driving circuit, a well-known gate signal line driving circuit or the like can be freely used.

Note that, in FIG. 35, although the description has been given by way of the example in which the three memory circuits are arranged, the invention is not limited to this. In general, the invention can be applied to an EL display device including a pixel of a structure in which n (n is a natural number not less than 2) memory circuits are arranged in each pixel.

[Embodiment 17]

In this embodiment, a structure of a pixel of an EL display device of the present invention will be described with reference to FIG. 37.

Figure 37:
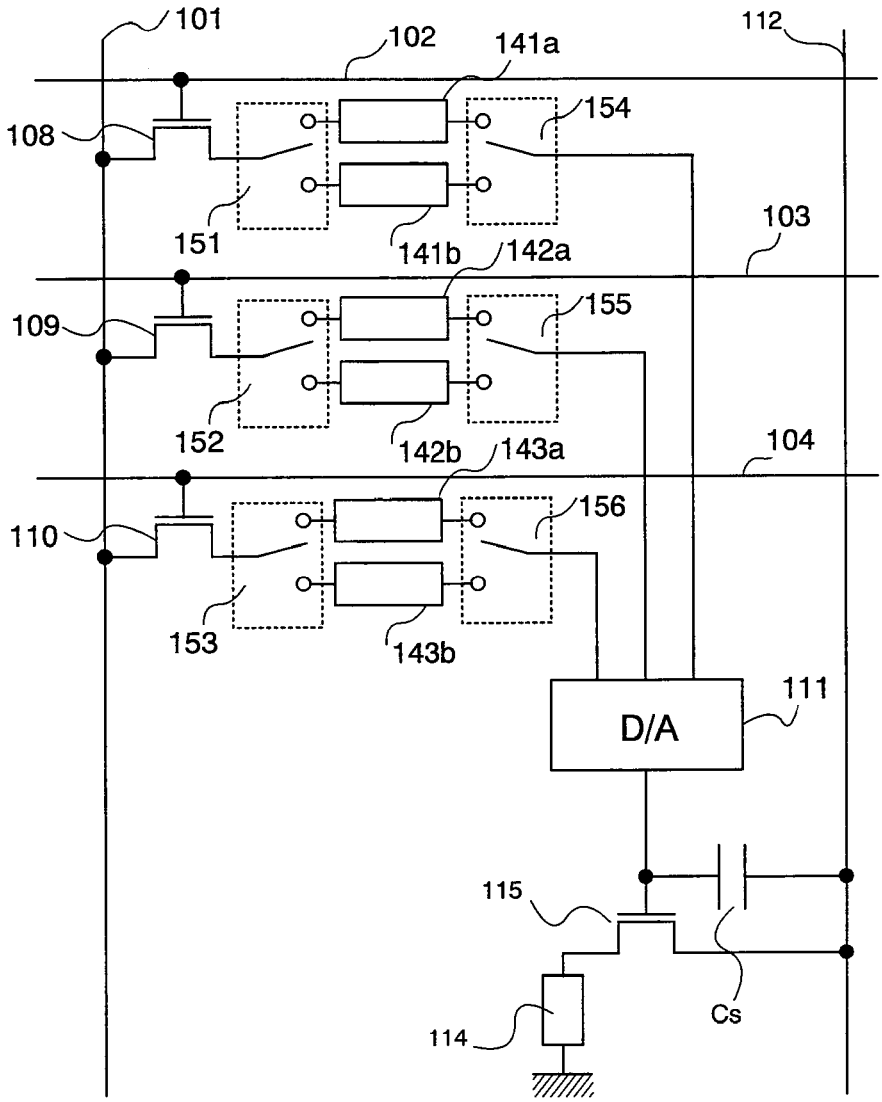
FIG. 37 is a view showing a structure of a pixel of an EL display device of a portable information apparatus of the present invention.

In FIG. 37, the same portions as those of FIG. 24 are designated by the same characters, and the explanation is omitted.

Memory circuits 141*a* to 143*a* and memory circuits 141*b* to 143*b* are arranged in each pixel.

A selection switch 151 selects connection between a writing TFT 108 and the memory circuit 141*a* or memory circuit 141*b*. A selection switch 152 selects connection between a writing TFT 109 and the memory circuit 142*a* or memory circuit 142*b*. A selection switch 153 selects connection between a writing TFT 110 and the memory circuit 143*a* or memory circuit 143*b*.

A selection switch 154 selects connection between a D/A 111 and the memory circuit 141*a* or memory circuit 141*b*. A selection switch 155 selects connection between the D/A 111 and the memory circuit 142*a* or memory circuit 142*b*. A selection switch 156 selects connection between the D/A 111 and the memory circuit 143*a* or memory circuit 143*b*.

By the selection switches 151 to 153 and the selection switches 154 to 156, it is possible to select the case where digital signals are stored in the memory circuits 141*a* to 143*a* or the case where digital signals are stored in the memory circuits 141*b* to 143*b*. Further, it is possible to select the case where the digital signals are inputted to the D/A 111 from the memory circuits 141*a* to 143*a* or the case where the digital signals are inputted to the D/A 111 from the memory circuits 141*b* to 143*b*.

In each pixel, since the operation of inputting digital signals to the respective selected memory circuits and the operation of reading out the digital signals held in the respective selected memory circuits are the same as that of this embodiment mode or Embodiment 1, the explanation thereof is omitted.

The pixel can store 3-bit digital signals for one frame period by using the memory circuits 141*a* to 143*a*, and can store 3-bit signals for another frame period different from the above frame period by using the memory circuits 141*b* to 143*b*.

In FIG. 37, although the circuit is shown in which 3-bit digital signals for 2 frames are stored, the embodiment is not limited to this. In general, the embodiment can be applied to an EL display device including a pixel which can store n-bit (n is a natural number not less than 2) digital signals for m (m is a natural number not less than 2) frames.

According to the present invention, in the portable information apparatus incorporating the EL display device, digital signals are stored by using a plurality of memory circuits disposed in the inside of each pixel. When a still picture is displayed, the digital signals stored in the memory circuits are repeatedly used for respective frame periods. In this way, when the still picture is continuously displayed, the source signal line driving circuit and the like can be stopped. Further, since circuits such as a picture signal processing circuit for processing signals inputted to the EL display device can also be stopped when the still picture is continuously displayed, the invention greatly contributes to the reduction in consumed electric power of the portable information apparatus.

Chemical Formula 1

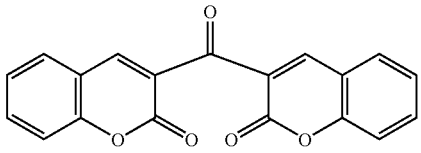

Chemical Formula 2

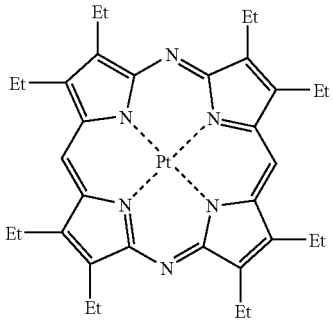

Chemical Formula 3

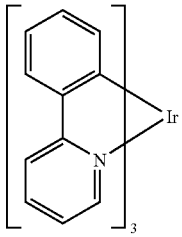

What is claimed is:

1. A portable information apparatus having an electroluminescence display device, said electroluminescence display device comprising;

at least first and second gate signal lines;

a source signal line; and at least one pixel comprising:

at least first and second memories electrically connected to the source signal line; and a D/A converter or converting digital signals stored in the at least first and second memories into an analog signal, wherein operations of the at least first and second memories are controlled by the at least first and second gate signal lines, respectively.

2. A portable information apparatus having an electroluminescence display device, said electroluminescence display device comprising:

a gate signal line;

at least first and second source signal lines; and at least one pixel comprising:

at least first and second memories; and a D/A converter for converting digital signals stored in the at least first and second memories into an analog signal, wherein operations of the at least first and second memories are controlled by the gate signal line.

3. A portable information apparatus having an electroluminescence display device, said electroluminescence display device comprising;

a plurality of power supply lines;

a plurality of pixels, each of said plurality of pixels having n memory circuits and a D/A converter for converting digital signals stored in said n memory circuits into an analog signal;

a thin film transistor having a gate electrode, a source region and a drain region, with said gate electrode being connected to receive an analog signal from the D/A converter of one said pixels, and one of said source region and said drain region being connected to one of said plurality of power supply lines; and an electroluminescence element connected to one of said source region and said drain region that is not connected to one of said plurality of power supply lines.

4. A portable information apparatus having an electroluminescence display device, said electroluminescence display device comprising:

a power supply line;

at lest one pixel comprising:

n×m memory circuits;

a D/A converter for converting digital signals stored in said n×m memory circuits into an analog signal;

a thin film transistor having a gate electrode, a source region and drain region, with said gate electrode being connected to receive an analog signal from the D/A converter, and one of said source region and said drain, region being connected to said power supply line; and an electroluminescence element connected to one of said source region and said drain region that is not connected to said power supply line.

5. The portable information apparatus of claim 4, wherein said at least one pixel stores digital signals for m frames.

6. A portable information apparatus according to claim 1, wherein:

the electroluminescence display device includes a source signal line, and the memory circuits and the D/A converter are disposed to overlap with the source signal line.

7. A portable information apparatus according to claim 1, wherein:

the electroluminescence display device includes a gate signal line, and the memory circuits and the D/A converter are disposed to overlap with the gate signal line.

8. A portable information apparatus having an electroluminescence display device, said electroluminescence display device comprising;

n gate signal lines;

a source signal line crossing said n gate signal lines;

a power supply line disposed parallel to said n gate signal lines or said source signal line;

a pixel comprising:

n first thin film transistors, each of said a first thin film transistors having a first gate electrode, a first source region and a first drain region, with said first gate electrode being; connected to one of said a gate signal lines, and one of said first source region and said first drain region being connected to said source signal line;

n memory circuits, with an input terminal of each of said a memory circuits being connected to another one of said first source region and said first drain region;

a D/A converter connected to an output terminal of each of said n memory circuit;

a second thin film transistor having a second gate electrode, a second source region and a second drain region, with said second gate electrode being connected to an output terminal of said D/A converter and one of said second source region and said second drain region being connected to said power supply line; and an electroluminescence element connected to another of one of said second source region and said second drain region.

9. A portable information apparatus having an electroluminescence display device, said electroluminescence display device comprising:

n source signal coal lines;

a gate signal line crossing said n source signal lines:

a power supply line disposed parallel to said n source signal lines or said gate signal line;

a pixel comprising:

n first thin film transistors, each of said n first thin film transistors having a first gate electrode, a first source region and a first drain region, with said first gate electrode being connected to said gate signal line, and one of said first source region and said first drain region being connected to one of said n source signal lines;

n memory circuits, with so input terminal of each of said n mentor circuits being connected to another one of said first source region and said first drain region;

a D/A converter connected to an output terminal of each of said n memory circuit;

a second thin film transistor having a second gate electrode, a second source region and a second drain region, with said second gate electrode being connected to an output terminal of said D/A converter and one of said second source region arid said second drain region being connected to said power supply line; and an electroluminescence element connected to another one of said second source region and said second drain region.

10. A portable information apparatus according to claim 8, wherein the electroluminescence display device, includes a source signal line driving circuit, and the source signal line driving circuit includes shift registers, first latch circuits for holding n-bit digital signals by sampling pulses from the shift registers, second latch circuits to which the n-bit digital signals held in the first latch circuits are transferred, and switches for sequentially selecting one bit by one bit the n-bit digital signals transferred to the second latch circuits to input them to the source signal line.

11. A portable information apparatus according to claim 8, wherein the electroluminescence display device includes a source signal line driving circuit, and the source signal line driving circuit includes shift registers, first latch circuits for holding one-bit digital signal by sampling pulses from the shift registers, and second latch circuits to which the one-bit digital signals held in the first latch circuits are transferred.

12. A portable information apparatus according to claim 9, wherein the electroluminescence display device includes a source signal line driving circuit, and the source signal line driving circuit includes shift registers, and latch circuits for holding n-bit digital signals by sampling pulses from the shift registers.

13. A portable information apparatus according to claim 9, wherein the electroluminescence display device includes a source signal line driving circuit, and the source signal line driving circuit includes shift registers, latch circuits for holding n-bit digital signals by sampling pulses from the shift registers, and n switches for inputting the n-bit digital signals held in the latch circuits to then source signal lines.

14. A portable information apparatus according to claim 1, wherein each of the memory circuits is a memory selected front the group consisting of a static memory (SRAM), a ferroelectric memory (FRAM) and a dynamic memory (DRAM).

15. A portable information apparatus according to claim 1, wherein the memory circuits are formed on a substrate selected from the group consisting of a glass substrate, a plastic substrate, a stainless substrate, and a single crystal wafer.

16. A portable information apparatus according to claim 1, wherein the portable information apparatus is one selected from the group consisting of a portable telephone, a personal computer, a navigation system, a PDA, and an electronic book.

17. A method of driving a portable information apparatus including an electroluminescence display device and a CPU, where the electroluminescence display device includes a plurality of pixels and an EL controller for outputting signals to the plurality of pixel, and the CPU includes a picture signal processing circuit for controlling the EL controller, the method comprising:

storing digital signals in a plurality of memory circuits included in each of the plurality of pixels, repeatedly reading the stored digital signals, converting the repeatedly read digital signals into corresponding analog signals, inputting the analog signals to an electroluminescence element, and wherein an operation of the picture signal processing circuit is stopped by the CPU while the electroluminescence display device carries out a display by using the analog signals.

18. A method of driving a portable information apparatus incorporating an electroluminescence a plurality of pixels, and a VRAM, the method comprising;

storing digital signals in a plurality of memory circuits included in each of the plurality of pixels, repeatedly reading the stored digital signals, converting the repeatedly read digital signals into corresponding analog signals, inputting the analog signals to an electroluminescence element, and wherein, a data readout operation of the VRAM is stopped by the CPU while the electroluminescence display device carries out a display by using the analog signals.

19. A portable information apparatus accordion to claim 2, wherein:

the electroluminescence display device include a source signal line, and the memory circuits and the D/A converter are disposed to overlap with the source signal line.

20. A portable information apparatus according to claim 3, wherein:

the electroluminescence display device includes a source signal line, and the memory circuits and the D/A converter are disposed to overlap with the source signal line.

21. A portable information apparatus according to claim 4, wherein:

the electroluminescence display device includes a source signal line, and the memory circuits and the D/A converter are disposed to overlap with the source signal line.

22. A portable information apparatus according to claim 5, wherein:

the electroluminescence display device includes a source signal line, and the memory circuits and the D/A converter are disposed to overlap with the source signal line.

23. A portable information apparatus according to claim 2, wherein:

the electroluminescence display device includes a gate signal line, and the memory circuits and the D/A converter are disposed to overlap with the gate signal line.

24. A portable information apparatus according to claim 3, wherein:

the electroluminescence display device includes a gate signal line , and the memory circuits and the D/A converter are disposed to overlap with the gate signal line.

25. A portable information apparatus according to claim 4, wherein:

the electroluminescence display device includes a gate signal hue, and the memory circuits and the D/A converter are disposed to overlap with the gate signal line.

26. A portable information apparatus according to claim 5, wherein:

the electroluminescence display device includes a gate signal line, and the memory circuits and the D/A converter are disposed to overlap with the gate signal line.

27. A portable information apparatus according to claim 2, wherein each of the memory circuits is a memory selected from the group consisting of a static memory (SRAM), a ferroelectric memory (FRAM) and a dynamic memory (DRAM).

28. A portable information apparatus according to claim 3, wherein each of the memory circuits is a memory selected from the group consisting of a static memory (SRAM), a ferroelectric memory (FRAM) and a dynamic memory (DRAM).

29. A portable information apparatus according to claim 4, wherein each of the memory circuits is a memory selected from the group consisting of a static memory (SRAM), a ferroelectric memory (FRAM) and a dynamic memory (DRAM).

30. A portable information apparatus according to claim 5, wherein each of the memory circuits is a memory selected from the group consisting of a static memory (SRAM), a ferroelectric memory (FRAM) and a dynamic memory (DRAM).

31. A portable information apparatus according to claim 6, wherein each of the memory circuits is a memory selected from the group consisting of a static memory (SRAM), a ferroelectric memory (FRAM) and a dynamic memory (DRAM).

32. A portable information apparatus according to claim 7, wherein each of the memory is memory selected from the group consisting of a static memory (SRAM), a ferroelectric memory (FRAM) and a dynamic memory (DRAM).

33. A portable information apparatus according to claim 8, wherein each of the memory is memory selected from the group consisting of a static memory (SRAM), a ferroelectric memory (FRAM) and a dynamic memory (DRAM).

34. A portable information apparatus according to claim 9, wherein each of the memory circuits us a memory selected from the group consisting of a static memory (SRAM), a ferroelectric memory (FRAM) and a dynamic memory (DRAM).

35. A portable information apparatus according to claim 10, wherein each of the memory circuits is a memory selected from the group consisting of a static memory (SRAM), a ferroelectric memory (FRAM) and a dynamic memory (DRAM).

36. A portable information apparatus according to claim 11, wherein each of the memory circuits is a memory selected from the group consisting of a static memory (SRAM), a ferroelectric memory (FRAM) and a dynamic memory (DRAM).

37. A portable information apparatus according to claim 12, wherein each of the memory circuits is a memory selected from the group consisting of a static memory (SRAM), a ferroelectric memory (FRAM) and a dynamic memory (DRAM).

38. A portable information apparatus according to claim 13, wherein each of the memory circuits is a memory selected from the group consisting of a static memory (SRAM), a ferroelectric memory (FRAM) and a dynamic memory (DRAM).

39. A portable information apparatus according to claim 2, wherein the memory circuits are formed on a substrate selected from the group consisting of a glass substrate, a plastic substrate, a stainless substrate, and a single crystal wafer.

40. A portable information apparatus according to claim 3, wherein the memory circuits are formed on a substrate selected from the group consisting of a glass substrate, a plastic substrate, a stainless substrate, and a single crystal wafer.

41. A portable information apparatus accordion to claim 4, wherein the memory circuits are formed on a substrate selected from the group consisting of a glass substrate, a plastic substrate, a stainless substrate, and a single crystal wafer.

42. A portable information apparatus accordion to claim 5, wherein the memory circuits are formed on a substrate selected from the group consisting of a glass substrate, a plastic substrate, a stainless substrate, and a single crystal wafer.

43. A portable information apparatus accordion to claim 6, wherein the memory circuits are formed on a substrate selected from the group consisting of a glass substrate, a plastic substrate, a stainless substrate, and a single crystal wafer.

44. A portable information apparatus accordion to claim 7, wherein the memory circuits are formed on a substrate selected from the group consisting of a glass substrate, a plastic substrate, a stainless substrate, and a single crystal wafer.

45. A portable information apparatus accordion to claim 8, wherein the memory circuits are formed on a substrate selected from the group consisting of a glass substrate, a plastic substrate, a stainless substrate, and a single crystal wafer.

46. A portable information apparatus accordion to claim 9, wherein the memory circuits are formed on a substrate selected from the group consisting of a glass substrate, a plastic substrate, a stainless substrate, and a single crystal wafer.

47. A portable information apparatus accordion to claim 10, wherein the memory circuits are formed on a substrate selected from the group consisting of a glass substrate, a plastic substrate, a stainless substrate, and a single crystal wafer.

48. A portable information apparatus accordion to claim 11, wherein the memory circuits are formed on a substrate selected from the group consisting of a glass substrate, a plastic substrate, a stainless substrate, and a single crystal wafer.

49. A portable information apparatus accordion to claim 12, wherein the memory circuits are formed on a substrate selected from the group consisting of a glass substrate, a plastic substrate, a stainless substrate, and a single crystal wafer.

50. A portable information apparatus accordion to claim 13, wherein the memory circuits are formed on a substrate selected from the group consisting of a glass substrate, a plastic substrate, a stainless substrate, and a single crystal wafer.

51. A portable information apparatus accordion to claim 14, wherein the memory circuits are formed on a substrate selected from the group consisting of a glass substrate, a plastic substrate, a stainless substrate, and a single crystal wafer.

52. A portable information apparatus according claim 2, wherein the portable information apparatus is one selected from the consisting of a portable telephone, a personal computer, a navigation system, a PDA, and an electronic book.

53. A portable information apparatus according claim 3, wherein the portable information apparatus is one selected from the consisting of a portable telephone, a personal computer, a navigation system, a PDA, and an electronic book.

54. A portable information apparatus according claim 4, wherein the portable information apparatus is one selected from the consisting of a portable telephone, a personal computer, a navigation system, a PDA, and an electronic book.

55. A portable information apparatus according claim 5, wherein the portable information apparatus is one selected from the consisting of a portable telephone, a personal computer, a navigation system, a PDA, and an electronic book.

56. A portable information apparatus according claim 6, wherein the portable information apparatus is one selected from the consisting of a portable telephone, a personal computer, a navigation system, a PDA, and an electronic book.

57. A portable information apparatus according claim 7, wherein the portable information apparatus is one selected from the consisting of a portable telephone, a personal computer, a navigation system, a PDA, and an electronic book.

58. A portable information apparatus according claim 8, wherein the portable information apparatus is one selected from the consisting of a portable telephone, a personal computer, a navigation system, a PDA, and an electronic book.

59. A portable information apparatus according claim 9, wherein the portable information apparatus is one selected from the consisting of a portable telephone, a personal computer, a navigation system, a PDA, and an electronic book.

60. A portable information apparatus according claim 10, wherein the portable information apparatus is one selected from the consisting of a portable telephone, a personal computer, a navigation system, a PDA, and an electronic book.

61. A portable information apparatus according claim 11, wherein the portable information apparatus is one selected from the consisting of a portable telephone, a personal computer, a navigation system, a PDA, and an electronic book.

62. A portable information apparatus according claim 12, wherein the portable information apparatus is one selected from the consisting of a portable telephone, a personal computer, a navigation system, a PDA, and an electronic book.

63. A portable information apparatus according claim 13, wherein the portable information apparatus is one selected from the consisting of a portable telephone, a personal computer, a navigation system, a PDA, and an electronic book.

64. A portable information apparatus according claim 14, wherein the portable information apparatus is one selected from the consisting of a portable telephone, a personal computer, a navigation system, a PDA, and an electronic book.

65. A portable information apparatus according claim 15, wherein the portable information apparatus is one selected from the consisting of a portable telephone, a personal computer, a navigation system, a PDA, and an electronic book.

66. A method of driving a portable information apparatus according to claim 17, wherein one readout operation is carried out for one frame period in the plurality of memory circuits.

67. A method of driving a portable information apparatus according to claim 18, wherein one readout operation is carried out for one frame period in the plurality of memory circuits.

68. A method of driving a portable information apparatus according to claim 17, wherein the memory circuit is a memory selected from the group consisting of a static memory (SRAM), a ferroelectric memory (FRAM) and a dynamic memory (DRAM).

69. A method of driving a portable information apparatus according to claim 18, wherein the memory circuit is a memory selected from the group consisting of a static memory (SRAM), a ferroelectric memory (FRAM) a dynamic memory (DRAM).

70. A method of driving a portable information apparatus according to claim 17, wherein the memory circuits are formed on a substrate selected from the group consisting of a glass substrate, a plastic substrate, and a single crystal wafer.

71. A method of driving a portable information apparatus according to claim 18, wherein the memory circuits are formed on a substrate selected from the group consisting of a glass substrate, a plastic substrate, and a single crystal wafer.

72. A method of driving a portable information apparatus according to claim 17, wherein the portable information apparatus is one selected from the group consisting of a portable telephone, a personal computer, a navigation system, a PDA, and an electronic book.

73. A method of driving a portable information apparatus according to claim 18, wherein the portable information apparatus is one selected from the group consisting of a portable telephone, a personal computer, a navigation system, a PDA, and an electronic book.

* * * * *